US009278520B2

(12) United States Patent
Kamiyanagi et al.

(10) Patent No.: US 9,278,520 B2
(45) Date of Patent: Mar. 8, 2016

(54) LIQUID DISCHARGING APPARATUS

(71) Applicant: SEIKO EPSON CORPORATION, Tokyo (JP)

(72) Inventors: Masashi Kamiyanagi, Nagano (JP); Toshiyuki Suzuki, Nagano (JP); Osamu Shinkawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/790,164

(22) Filed: Jul. 2, 2015

(65) Prior Publication Data

US 2016/0039203 A1 Feb. 11, 2016

(30) Foreign Application Priority Data

Aug. 6, 2014 (JP) ..... 2014-160254

(51) Int. Cl.
*B41J 29/393* (2006.01)
*B41J 29/38* (2006.01)
*B41J 2/045* (2006.01)

(52) U.S. Cl.
CPC ..... *B41J 2/04551* (2013.01); *B41J 2/04586* (2013.01)

(58) Field of Classification Search
CPC .. B41J 2/04501; B41J 2/0457; B41J 2/04541; B41J 2/04551; B41J 2/04573; B41J 2/04578; B41J 2/04581; B41J 2/04588; B41J 2/14233; B41J 2/14274; B41J 2002/14354; B41J 2002/17583
USPC ..... 347/9–11, 14, 19, 22–35, 54, 68, 92
See application file for complete search history.

(56) References Cited

U.S. PATENT DOCUMENTS 5,500,657 A * 3/1996 Yauchi ..... B41J 2/0451 347/9
5,818,473 A * 10/1998 Fujii ..... B41J 2/04541 347/11
6,238,112 B1 * 5/2001 Girones ..... B41J 2/2139 347/19
7,150,513 B2 12/2006 Shinkawa et al.
7,328,960 B2 * 2/2008 Sakagami ..... B41J 2/0451 347/19
7,331,645 B2 * 2/2008 Nishihara ..... B41J 2/04581 347/10

FOREIGN PATENT DOCUMENTS

JP 2004-276544 A 10/2004

* cited by examiner

*Primary Examiner* — Anh T. N. Vo
(74) *Attorney, Agent, or Firm* — Global IP Counselors, LLP

(57) ABSTRACT

A liquid discharging apparatus includes: a recording head that includes M numbers of the discharging units; a drive unit that drives the discharging unit; a residual vibration detecting unit that detects residual vibration occurring in the discharging unit; and a determining unit that determines a state of discharge of the liquid in the discharging unit on the basis of a detection result. The determining unit is capable of performing the determination in two or more determination modes, and determines at least one of one or a plurality of target discharging units that is to be a target of the determination during a determination time period, and a drive discharging unit that the drive unit is to drive so as to determine the state of discharge of the liquid in the target discharging unit from the M numbers of discharging units depending on the determination mode.

17 Claims, 25 Drawing Sheets

EXPERIMENTAL VALUE AND CALCULATED VALUE OF RESIDUAL VIBRATION (AIR BUBBLE)

EXPERIMENTAL VALUE AND CALCULATED VALUE OF RESIDUAL VIBRATION (DRY)

EXPERIMENTAL VALUE AND CALCULATED VALUE
OF RESIDUAL VIBRATION (PAPER DUST)

FIG. 15A

UNIT PRINTING OPERATION TIME PERIOD Tu-P

| | SI (b1, b2) | Ts1 | | Ts2 | |
|---|---|---|---|---|---|
| | | Sa | Sb | Sa | Sb |
| LARGE DOT | (1, 1) | H | L | H | L |
| MEDIUM DOT | (1, 0) | H | L | L | H |
| SMALL DOT | (0, 1) | L | H | H | L |
| NON-RECORDING | (0, 0) | L | H | L | H |

FIG. 15B

UNIT DETERMINATION OPERATION TIME PERIOD Tu-T

| | SI (b1, b2) | Ts1 | | Ts2 | |
|---|---|---|---|---|---|
| | | Sa | Sb | Sa | Sb |
| DETERMINATION TARGET | (1, 1) | H | L | H | L |
| OTHER THAN DETERMINATION TARGET | (0, 0) | L | H | L | H |

FIG. 22

| Flag | Tc (COMPARISON CONTENT) | RS |
|---|---|---|
| 1 | Tc < Tth1 | 2: ABNORMAL DISCHARGE (AIR BUBBLE) |
| | Tth1 ≤ Tc ≤ Tth2 | 1: NORMAL |
| | Tth2 < Tc ≤ Tth3 | 3: ABNORMAL DISCHARGE (PAPER DUST) |
| | Tth3 < Tc | 4: ABNORMAL DISCHARGE (THICKENING) |
| 0 | N/A | 5: ABNORMAL DISCHARGE |

DRIVEN ALONE

DRIVEN SIMULTANEOUSLY

LIQUID DISCHARGING APPARATUS

This application claims priority to Japanese Patent Application No. 2014-160254 filed on Aug. 6, 2014. The entire disclosure of Japanese Patent Application No. 2014-160254 is hereby incorporated herein by reference.

BACKGROUND

1. Technical Field

The present invention relates to a liquid discharging apparatus.

2. Related Art

A liquid discharging apparatus such as an ink jet printer that forms an image on a medium by discharging ink from a discharging unit may experience an abnormal discharge that means ink cannot be normally discharged from the discharging unit due to thickening of ink, mingling of air bubbles with ink, and the like. An abnormal discharge occurring in the discharging unit prevents accurate formation of a dot that is supposed to be formed by ink discharged from the discharging unit and thus decreases quality of the image formed on the medium. In order to prevent such a decrease in image quality due to an abnormal discharge, a technology is suggested in which an abnormal discharge is detected by determining a state of discharge of ink from the discharging unit (for example, JP-A-2004-276544).

It is preferable to detect an abnormal discharge promptly so as to prevent a decrease in image quality due to an abnormal discharge. An abnormal discharge is caused by various events depending on a status of use of the liquid discharging apparatus, such as thickening of ink due to long-term non-use of the liquid discharging apparatus, mingling of air bubbles during printing, temporal degradation of the discharging unit, and physical failure of the discharging unit due to vibrations occurring in the discharging unit when liquid is discharged from the discharging unit. Thus, in order to detect an abnormal discharge promptly, a determination of the state of discharge in the discharging unit is required to be flexibly performed depending on the status of use of the liquid discharging apparatus, such as not only when the liquid discharging apparatus is booted but also when a printing process of forming an image on the medium is performed or after the printing process is performed.

However, as in the technology disclosed in JP-A-2004-276544, a determination of the state of discharge may be performed in limited cases due to temporal restrictions when a determination of the state of discharge is performed on all discharging units provided in the liquid discharging apparatus. In this case, detection of an abnormal discharge is delayed, and the possibility of forming a low-quality image is increased.

SUMMARY

An advantage of some aspects of the invention is to provide a technology that enables a determination of a state of discharge of ink from a discharging unit to be flexibly performed depending on a status of use of a liquid discharging apparatus.

According to an aspect of the invention, there is provided a liquid discharging apparatus that discharges liquid to a medium from a discharging unit to form an image on the medium. The liquid discharging apparatus includes: a recording head that includes M numbers (where M is a natural number greater than or equal to two) of the discharging units; a drive unit that drives the discharging unit; a residual vibration detecting unit that detects residual vibration occurring in the discharging unit when the discharging unit is driven by the drive unit; and a determining unit that determines a state of discharge of the liquid in the discharging unit on the basis of a detection result of the residual vibration detecting unit. The determining unit is capable of performing the determination in two or more determination modes, and determines at least one of one or a plurality of target discharging units that is to be a target of the determination during a determination time period, and a drive discharging unit that the drive unit is to drive so as to determine the state of discharge of the liquid in the target discharging unit from the M numbers of discharging units depending on the determination mode.

In this case, it is possible to perform the determination of the state of discharge of the liquid in the discharging unit in the plurality of determination modes. Thus, the liquid discharging apparatus according to the aspect of the invention can determine the state of discharge of the liquid in the discharging unit in one of the plurality of determination modes depending on the status of use of the liquid discharging apparatus. Therefore, it is possible to flexibly perform the determination in response to the status of use of the liquid discharging apparatus in comparison with the case where the determination can be performed in only one determination mode.

In addition, in this case, at least one of the number of target discharging units and the drive discharging unit that is driven so as to determine the state of discharge in the target discharging unit is determined depending on the determination mode. The liquid discharging apparatus, when being capable of performing the determination in the plurality of determination modes having a different number of target discharging units, can select the determination mode in which the determination is performed for a small number of discharging units as the target discharging unit when, for example, only a short time period can be secured as the determination time period. The liquid discharging apparatus can select the determination mode in which the determination is performed for all of the discharging units provided in the liquid discharging apparatus as the target discharging unit when a sufficiently long time period can be secured as the determination time period. Thus, it is possible to flexibly perform the determination depending on the status of use of the liquid discharging apparatus. In addition, the liquid discharging apparatus, when being capable of performing the determination in the plurality of determination modes having a different drive discharging unit, can select the determination mode in which the determination is only performed for the target discharging unit that is necessary for the determination of the state of discharge in the target discharging unit as the drive discharging unit when, for example, only a short time period can be secured as the determination time period. The liquid discharging apparatus can select the determination mode in which the determination is performed for the target discharging unit that is necessary for the determination of the state of discharge in the target discharging unit as the drive discharging unit and is performed for the discharging unit that is different from the target discharging unit, for example, the discharging unit that neighbors the target discharging unit as the drive discharging unit when a sufficiently long time period can be secured as the determination time period. Thus, it is possible to flexibly perform the determination depending on the status of use of the liquid discharging apparatus.

In the liquid discharging apparatus according to the aspect, the two or more determination modes may include a first determination mode in which the M numbers of discharging units are set as the target discharging unit during the determination time period.

In this case, the determination modes include the first determination mode in which the state of discharge of the liquid is determined for all of the M numbers of discharging units provided in the liquid discharging apparatus. Thus, it is possible to detect an abnormal discharge in all of the discharging units, and it is possible to form a high-quality image by preventing degradation of image quality due to an abnormal discharge.

In the liquid discharging apparatus according to the aspect, the liquid discharging apparatus may be capable of performing a printing process of forming an image on the medium on the basis of image data that represents an image which is to be formed on the medium, and the determining unit may perform the determination in the first determination mode during a printing preparation time period from supply of the image data to the liquid discharging apparatus until initiation of the printing process by the liquid discharging apparatus.

In this case, the state of discharge of the liquid is determined for all of the discharging units in the first determination mode during the printing preparation time period. Thus, it is possible to form a high-quality image by preventing degradation of image quality due to an abnormal discharge during the printing process that is performed after the printing preparation time period.

In the liquid discharging apparatus according to the aspect, the liquid discharging apparatus may be capable of performing a printing process of forming an image on the medium on the basis of image data that represents an image which is to be formed on the medium, and the determining unit may perform the determination in the first determination mode when the printing process based on the image data is completed.

In this case, the state of discharge of the liquid is determined for all of the discharging units in the first determination mode after completion of the printing process. Thus, even when an abnormal discharge occurs during the printing process, it is possible to promptly detect the abnormal discharge, and it is possible to quickly respond to the abnormal discharge.

In the liquid discharging apparatus according to the aspect, the liquid discharging apparatus may be capable of operating in a normal power mode, and a power saving mode in which the amount of power that the liquid discharging apparatus consumes is less than the amount of power that the liquid discharging apparatus consumes in the normal power mode, and the determining unit may perform the determination in the first determination mode when the liquid discharging apparatus transitions from operating in the power saving mode to operating in the normal power mode.

In this case, even if an abnormal discharge such as thickening and the like of the liquid in the discharging unit occurs in the time period during which the liquid discharging apparatus operates in the power saving mode, it is possible to promptly detect the abnormal discharge, and it is possible to quickly respond to the abnormal discharge.

The liquid discharging apparatus according to the aspect, may further include a transport mechanism that transports the medium. The determining unit may perform the determination in the first determination mode when a recovery is made from a state where transport of the medium is difficult to a transportable state in the transport mechanism.

In this case, even if an abnormal discharge occurs due to vibrations accompanied by a work of recovering the state of transport of the medium, contact of the medium with the discharging unit, or the like when the work for making a recovery from the state where transport of the medium is difficult, such as a so-called paper jam, to a transportable state of the medium is performed, it is possible to promptly detect the abnormal discharge, and it is possible to quickly respond to the abnormal discharge.

In the liquid discharging apparatus according to the aspect, the two or more determination modes may include a second determination mode in which Q numbers (where Q is a natural number satisfying $1 \leq Q < M$) of discharging units are set as the target discharging unit during the determination time period.

In this case, the determination modes include the second determination mode in which the state of discharge of the liquid is determined for a part of the M numbers of discharging units provided in the liquid discharging apparatus. Thus, it is possible to determine the state of discharge of the liquid in the discharging unit even in a short determination time period during which it is difficult to perform the determination in the first determination mode. Thus, it is possible to flexibly perform the determination in response to the status of use of the liquid discharging apparatus.

The determining unit in this aspect may compute a determinable number that is the number of discharging units determinable during the determination time period and may determine the Q numbers of target discharging units on the basis of the determinable number.

In the liquid discharging apparatus according to the aspect, the medium may include a printing area in which an image is to be formed, the liquid discharging apparatus may include a transport mechanism that changes the position of the medium relative to the recording head, and the determining unit may perform the determination in the second determination mode when the position of the medium relative to the recording head is a position where the liquid discharged from the discharging unit hits outside the printing area.

In this case, the determination is performed in the second determination mode when the liquid discharged from the discharging unit hits the outside of the printing area.

Specifically, the determination is performed in the second determination mode during the time period in which the medium is transported to a position where the liquid discharged from the discharging unit hits the marginal area that is the area other than the printing area in the medium when the liquid discharging apparatus is, for example, a line printer.

When the liquid discharging apparatus is, for example, a serial printer, the determination is performed in the second determination mode during the time period in which the medium or the recording head is transported to a position where the liquid discharged from the discharging unit hits outside the medium.

As such, in this case, the determination is performed in the second determination mode during the time period from the end of one printing process until initiation of another printing process that is initially performed after the one printing process when the printing process is intermittently performed. Thus, even if an abnormal discharge occurs during performance of one printing process, it is possible to detect the abnormal discharge before initiation of another printing process. In consequence, it is possible to form a high-quality image by preventing degradation of image quality due to the abnormal discharge during another printing process.

In the liquid discharging apparatus according to the aspect, the two or more determination modes may include a third determination mode in which the target discharging unit and the discharging unit that is different from the target discharging unit are set as the drive discharging unit so as to determine the state of discharge of the liquid in the target discharging unit.

In this case, the target discharging unit and the discharging unit that is different from the target discharging unit (hereinafter, referred to as "another discharging unit") are driven in the determination of the state of discharge of the liquid in the target discharging. unit. Thus, it is possible to distinguish whether an abnormal discharge is due to failure of the target discharging unit such as breakage of a partition between the target discharging unit and the other discharging unit or is due to a cause that is different from failure of the target discharging unit, such as thickening and the like of the liquid in the target discharging unit. That is, in this case, it is possible to detect an abnormal discharge in the discharging unit and detect failure of the discharging unit.

In this aspect, the third determination mode may set the M numbers of discharging units as the target discharging unit during the determination time period.

In the liquid discharging apparatus according to the aspect, the two or more determination modes may include a third determination mode of performing a first determination of setting the target discharging unit as the drive discharging unit so as to determine the state of discharge of the liquid in the target discharging unit, and a second determination of setting an abnormal discharging unit that is the discharging unit determined as having an abnormal state of discharge of the liquid in the first determination and setting the abnormal discharging unit and the discharging unit that is different from the abnormal discharging unit as the drive discharging unit so as to determine the state of discharge of the liquid in the abnormal discharging unit.

In this case, it is possible to detect an abnormal discharge in the target discharging unit by performing the first determination. In addition, it is possible to distinguish whether an abnormal discharge in the target discharging unit is due to failure of the target discharging unit, such as breakage of the partition between the target discharging unit and the other discharging unit or is due to a cause that is different from failure of the target discharging unit, such as thickening and the like of the liquid in the target discharging unit by performing the first determination and the second determination. That is, in this case, it is possible to detect an abnormal discharge in the discharging unit and detect failure of the discharging unit.

In this aspect, the third determination mode may perform the first determination and the second determination and may set the M numbers of discharging units as the target discharging unit in the first determination during the determination time period.

In the liquid discharging apparatus according to the aspect, the determining unit may perform the determination in the third determination mode when the liquid discharging apparatus is booted.

In this case, the determination is performed in the third determination mode after the power of the liquid discharging apparatus is booted. Thus, when an abnormal discharge or failure occurs in the discharging unit during the time period in which the power is OFF, it is possible to promptly detect the abnormal discharge or the failure, and it is possible to prevent a decrease in printed image quality in advance.

In the liquid discharging apparatus according to the aspect, the determining unit may perform the determination in the third determination mode when the discharging unit is initially filled with the liquid.

In this case, the determination is performed in the third determination mode when the discharging unit is initially filled with the liquid. Thus, when there is an initial failure in the recording head, the initial failure can be detected.

In the liquid discharging apparatus according to the aspect, the liquid discharging apparatus may be capable of performing a recovery process so as to set the state of discharge of the liquid in the discharging unit to normal, and the determining unit may perform the determination in the third determination mode when the recovery process is performed.

In this case, the determination is performed in the third determination mode after performance of the recovery process. Thus, when an abnormal discharge or failure occurs in the discharging unit during performance of the recovery process, it is possible to promptly detect the abnormal discharge or the failure, and it is possible to prevent a decrease in printed image quality in advance.

In the liquid discharging apparatus according to the aspect, the drive unit may drive the discharging unit by supplying a drive signal to the discharging unit, and the determining unit may determine the waveform of the drive signal that the drive unit is to supply to the drive discharging unit depending on the determination mode.

In this case, the waveform of the drive signal is determined depending on the determination mode. Thus, it is possible to change accuracy of the determination, discharge or non-discharge of the liquid in the determination, and the like for each determination mode. Thus, it is possible to appropriately perform the determination depending on the status of use of the liquid discharging apparatus.

In the liquid discharging apparatus according to the aspect, the determining unit may be capable of performing the determination in a first determination mode in which the M numbers of discharging units are set as the target discharging unit during the determination time period, a second determination mode in which the Q numbers (where Q is a natural number satisfying $1 \leq Q < M$) of discharging units are set as the target discharging unit during the determination time period, and a third determination mode in which the target discharging unit and the discharging unit that is different from the target discharging unit are set as the drive discharging unit so as to determine the state of discharge of the liquid in the target discharging unit, and may determine the waveform of the drive signal as a non-discharge waveform that causes the liquid not to be discharged from the drive discharging unit at the time of supply of the drive signal to the drive discharging unit when the determination is performed in the first determination mode or in the second determination mode.

In this case, the determination is performed in the first determination mode and in the second determination mode without discharging the liquid from the discharging unit. Thus, it is possible to save the amount of consumption of the liquid.

In the liquid discharging apparatus according to the aspect, the determining unit may determine the waveform of the drive signal as a discharge waveform that causes the liquid to be discharged from the drive discharging unit at the time of supply of the drive signal to the drive discharging unit when the determination is performed in the third determination mode.

In this case, it is possible to increase the amplitude of residual vibration by discharging the liquid from the discharging unit. Thus, it is possible to increase accuracy of the determination of the state of discharge of the liquid in the discharging unit and increase accuracy of determination of whether a failure occurs in the discharging unit.

The liquid discharging apparatus according to the aspect, may further include a recovery mechanism that performs a recovery process so as to set the state of discharge of the liquid in the discharging unit to normal. The recovery mechanism may perform the recovery process when the determining unit determines that the state of discharge of the liquid is abnormal in a predetermined number or more of the discharging units.

In this case, the recovery process of recovering the state of discharge in the discharging unit to normal is performed when an abnormal discharge is detected in a predetermined number or more of discharging units and when it is determined that the quality of the image formed on the medium is decreased. Thus, it is possible to form a high-quality image by preventing degradation of image quality due to an abnormal discharge.

BRIEF DESCRIPTION OF THE DRAWINGS

The invention will be described with reference to the accompanying drawings, wherein like numbers reference like elements.

FIGS. 15A and 15B are descriptive diagrams illustrating the content of decoding by a decoder.

FIG. 22 is a descriptive diagram for describing determination information.

DESCRIPTION OF EXEMPLARY EMBODIMENTS

Hereinafter, an embodiment of the invention will be described with reference to drawings. In each drawing, dimensions and the scale of each unit are appropriately differentiated from actual ones. While a variety of technically preferred limitations are placed on the embodiment described below as the embodiment is a preferred specific example of the invention, the scope of the invention is not limited to the embodiment unless the invention is intentionally described as limited in the description below.

A. Embodiment

In the present embodiment, a liquid discharging apparatus will be described as an ink jet printer that forms an image on a recording paper P (an example of a "medium") by discharging ink (an example of "liquid").

1. Summary of Printing System

A configuration of an ink jet printer 1 according to the present embodiment will be described with reference to FIG. 1 and FIG. 2.

Figure 1:
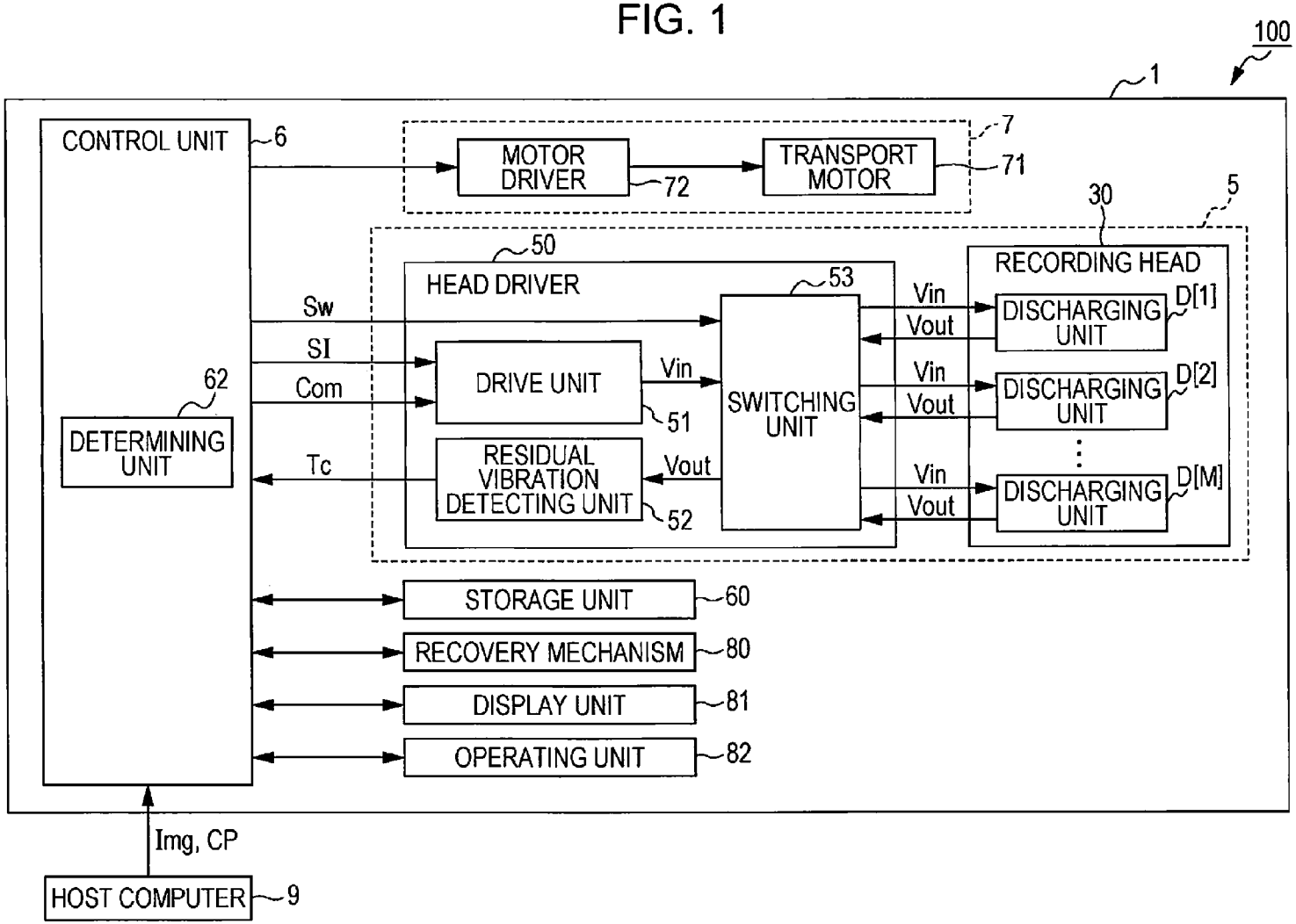
FIG. 1 is a block diagram illustrating a summary of a configuration of a printing system according to an embodiment of the invention.

FIG. 1 is a functional block diagram illustrating a configuration of a printing system 100 that is provided with the ink jet printer 1. The printing system 100 is provided with the ink jet printer 1 and a host computer 9 such as a personal computer or a digital camera.

The host computer 9 outputs print data Img and copy number information CP. The print data Img represents an image that is to be formed (printed) in the ink jet printer 1. The copy number information CP indicates a printed copy number Wcp of an image that the ink jet printer 1 is to form.

The ink jet printer 1 performs a printing process of forming the image represented by the print data Img that is supplied from the host computer 9 on the recording paper P by the printed copy number Wcp indicated by the copy number information CP. A series of processes by the ink jet printer 1 from receiving the print data Img and the copy number information CP until performing the printing process of forming the image represented by the print data Img by the printed copy number Wcp indicated by the copy number information CP may be referred to as a print job below:

The present embodiment includes the assumption that the ink jet printer 1 is a line printer.

The ink jet printer 1, as illustrated in FIG. 1, is provided with a head unit 5, a transport mechanism 7, a control unit 6, a storage unit 60, a recovery mechanism 80, a display unit 81, and an operating unit 82. A discharging unit D that discharges ink is disposed in the head unit 5. The transport mechanism 7 changes the position of the recording paper P relative to the head unit 5. The control unit 6 controls operation of each unit in the ink jet printer 1. The storage unit 60 stores a control program for the ink jet printer 1 and other various information. The recovery mechanism 80 performs a maintenance process (an example of a "recovery process") of recovering a state of discharge of ink in the discharging unit D normally when an abnormal discharge is detected in the discharging unit D. The display unit 81 is configured of a liquid crystal display, an LED lamp, or the like and displays an error message and the like. The operating unit 82 is used by a user of the ink jet printer 1 to input various commands and the like to the ink jet printer 1.

An abnormal discharge means an abnormal state of discharge of ink in the discharging unit D. In other words, an abnormal discharge collectively refers to a state where ink cannot be accurately discharged from a nozzle N (refer to later-described FIG. 3 and FIG. 4) that is provided in the discharging unit D.

More specifically, an abnormal discharge includes a state where the discharging unit D cannot discharge ink, a state where the discharging unit D cannot discharge the amount of ink necessary for forming the image represented by the print data Img because the amount of discharge of ink is small even if ink can be discharged from the discharging unit D, a state where the amount of ink greater than or equal to the amount necessary for forming the image represented by the print data Img is discharged from the discharging unit D, a state where ink discharged from the discharging unit D hits a position that is different from an expected hit position for forming the image represented by the print data Img, and the like.

The maintenance process collectively refers to a process for returning the state of discharge of ink in the discharging unit D to normal, such as a wiping process of wiping a foreign object such as paper dust attached near the nozzle N of the discharging unit D with a wiper (not illustrated), a flushing process of preliminarily discharging ink from the discharging unit D, and a sucking process of sucking thickened ink, air bubbles, and the like in the discharging unit D with a tube pump (not illustrated).

Figure 2:
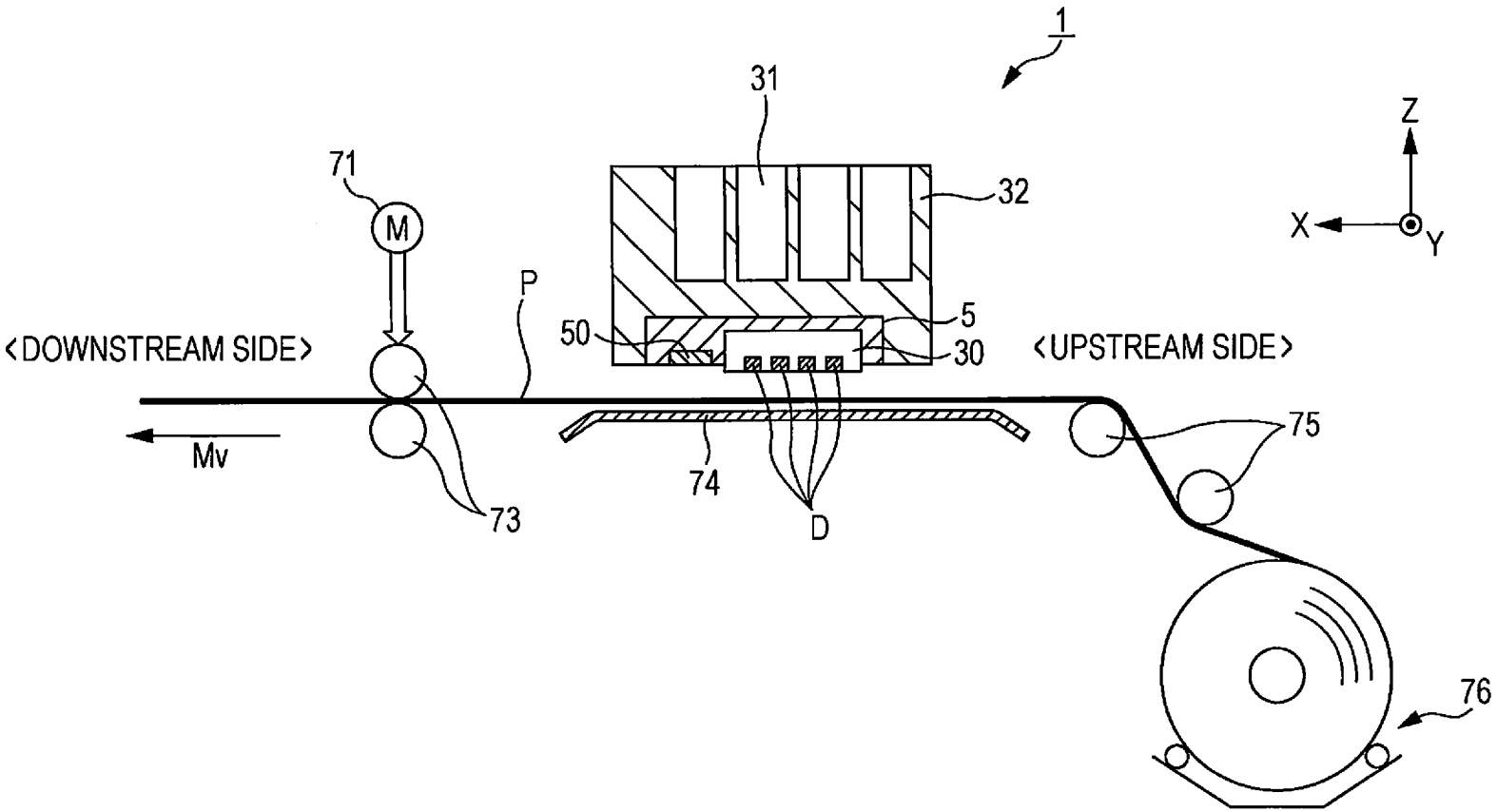
FIG. 2 is a schematic partial sectional view of an ink jet printer.

FIG. 2 is a partial sectional view illustrating a summary of an internal configuration of the ink jet printer 1.

The ink jet printer 1, as illustrated in FIG. 2, is provided with a carriage 32 in which the head unit 5 is mounted. In addition to the head unit 5, four ink cartridges 31 are mounted in the carriage 32.

The four ink cartridges 31 are disposed in one-to-one correspondence with four colors (CMYK) of black (BK), cyan (CY), magenta (MG), and yellow (YL). Each ink cartridge 31 is filled with color ink corresponding to the ink cartridge 31. Each ink cartridge 31 may be disposed at a separate location from the ink jet printer 1 instead of being mounted in the carriage 32.

The transport mechanism 7, as illustrated in FIG. 1, is provided with a transport motor 71 and a motor driver 72. The transport motor 71 serves as a drive source to transport the recording paper P. The motor driver 72 drives the transport motor 71.

In addition, the transport mechanism 7, as illustrated in FIG. 2, is provided with a platen 74, a transport roller 73, a guide roller 75, and an accommodation unit 76. The platen 74 is disposed on the lower side of the carriage 32 (−Z direction in FIG. 2). The transport roller 73 is rotated by operation of the transport motor 71. The guide roller 75 is disposed to be rotatable around the Y axis in FIG. 2. The accommodation unit 76 accommodates the recording paper P that is wound into a roll.

The transport mechanism 7, when the ink jet printer 1 performs the printing process, unwinds the recording paper P from the accommodation unit 76 and transports the recording paper P in the +X direction in FIG. 2 (direction from an upstream side to a downstream side) at a transport speed My along a transport path that is defined by the guide roller 75, the platen 74, and the transport roller 73.

The storage unit 60 is provided with an electrically erasable programmable read-only memory (EEPROM) that is a type of non-volatile semiconductor memory and stores the print data Img supplied from the host computer 9, a random access memory (RAM) for temporarily storing necessary data when various processes such as the printing process is performed or for temporarily loading a control program so as to perform various processes such as the printing process, and a PROM that is a type of non-volatile semiconductor memory and stores a control program for controlling each unit of the ink jet printer 1.

The control unit 6 is configured to include, for example, a central processing unit (CPU), a field-programmable gate array (FPGA), or the like. The CPU or the like operating in accordance with the control program stored on the storage unit 60 controls operation of each unit in the ink jet printer 1.

The control unit 6, as illustrated in FIG. 1, controls the printing process of forming an image on the recording paper P according to the print data Img by controlling the head unit 5 and the transport mechanism 7 on the basis of the print data Img and the like supplied from the host computer 9.

First, the control unit 6 stores the print data Img supplied from the host computer 9 on the storage unit 60. Next, the control unit 6 generates a printing signal SI, a drive waveform signal Com, and the like on the basis of various data such as the print data Img stored on the storage unit 60 so as to control operation of the head unit 5 and drive the discharging unit D. In addition, the control unit 6 generates signals on the basis of the printing signal SI and various data stored on the storage unit 60 so as to control operation of the motor driver 72 and outputs the various generated signals. Although further described later, the drive waveform signal Com according to the present embodiment includes drive waveform signals Com-A and Com-B.

As such, the control unit 6 drives the transport motor 71 so as to transport the recording paper P in the +X direction through control of the motor driver 72 and controls whether to discharge ink from the discharging unit D, the amount of discharge of ink, the timing of discharging ink, and the like through control of the head unit 5. Accordingly, the control unit 6 adjusts the size and arrangement of dots formed by ink discharged to the recording paper P and controls performance of the printing process of forming the image corresponding to the print data Img on the recording paper P.

The control unit 6, as illustrated in FIG. 1, performs a discharge state determination process of determining whether the state of discharge of ink from each discharging unit D is normal. The control unit 6 performing the discharge state determination process functions as a determining unit 62. That is, the determining unit 62 is a functional block that is realized by the control unit 6 operating in accordance with the control program. Details of the determining unit 62 will be described later.

The head unit 5, as illustrated in FIG. 1, is provided with a recording head 30 and a head driver 50. The recording head 30 is provided with M numbers of discharging units D (where M is a natural number greater than or equal to four in the present embodiment). The head driver 50 drives each discharging unit D provided in the recording head 30.

In the description below, each of the M numbers of discharging units D may be referred to as a first stage, a second stage, . . . , and an M-th stage in order so as to distinguish the M numbers of discharging units D from each other. In addition, in the description below, an m-th stage discharging unit D may be represented as a discharging unit D[m] (where the variable m is a natural number satisfying 1≤m≤M).

Each of the M numbers of discharging units D receives supply of ink from one of the four ink cartridges 31.

Each discharging unit D is filled with ink supplied from the ink cartridge 31 and is capable of discharging the ink from the nozzle N provided in the discharging unit D. Each discharging unit D forms an image on the recording paper P by discharging ink to the recording paper P at the timing when the transport mechanism 7 transports the recording paper P onto the platen 74. Accordingly, it is possible to discharge all of the four CMYK color inks from the M numbers of discharging units D, and thus full color printing is realized.

The head driver 50 is provided with a drive unit 51, a residual vibration detecting unit 52, and a switching unit 53.

The drive unit 51 generates a drive signal Vin on the basis of the signals supplied from the control unit 6 such as the printing signal SI, the drive waveform signal Com, and the like that the control unit 6 outputs so as to drive each of the M numbers of discharging units D provided in the recording head 30. The drive unit 51 supplies the generated drive signal Vin to the discharging unit D through the later-described switching unit 53. Each discharging unit D, when being supplied with the drive signal Vin, is driven on the basis of the supplied drive signal Vin and is capable of discharging the ink filling the inside of the discharging unit D to the recording paper P.

The residual vibration detecting unit 52 detects, as a residual vibration signal Vout, residual vibration occurring in the discharging unit D after the discharging unit D is driven by the drive signal Vin. The residual vibration detecting unit 52, on the basis of the detected residual vibration signal Vout, outputs a detection signal Tc that represents the length in time of one cycle of the residual vibration.

The switching unit 53 causes each discharging unit D to be electrically connected to one of the drive unit 51 and the residual vibration detecting unit 52 on the basis of a switching control signal Sw that is supplied from the control unit 6.

Details of the head driver 50 will be described later.

2. Configuration of Recording Head

The recording head 30 and the discharging unit D disposed in the recording head 30 will be described with reference to FIG. 3 and FIG. 4.

Figure 3:
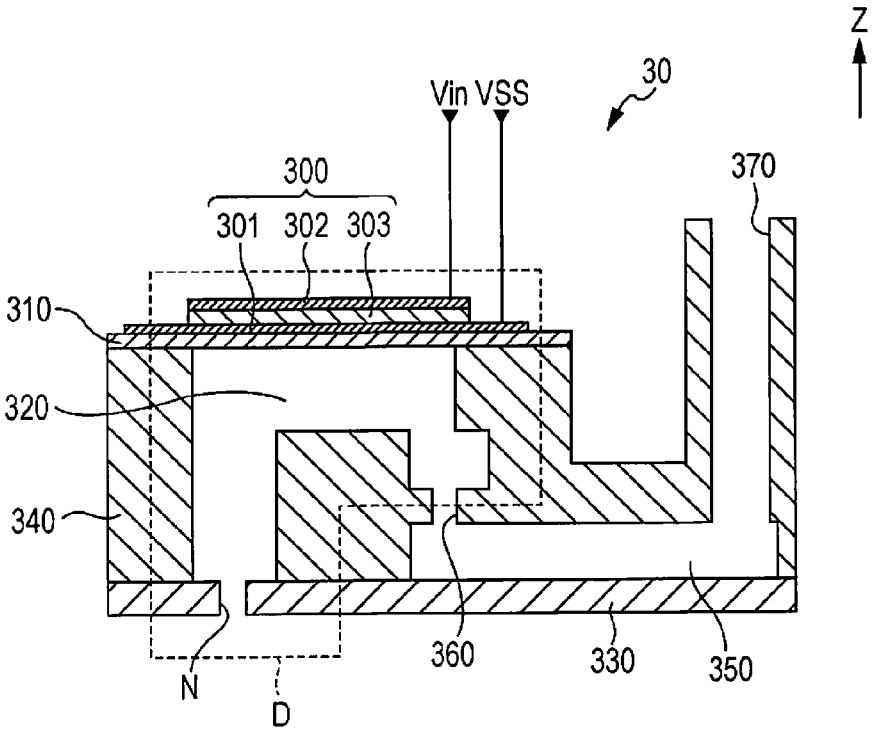
FIG. 3 is a schematic sectional view of a recording head.

FIG. 3 is an example of a schematic partial sectional view of the recording head 30. For convenience of illustration, FIG. 3 illustrates one discharging unit D among the M numbers of discharging units D included in the recording head 30, a reservoir 350 that communicates with the one discharging unit D through an ink supply port 360, and an ink intake port 370 for supplying ink to the reservoir 350 from the ink cartridge 31 in the recording head 30.

The discharging unit D, as illustrated in FIG. 3, is provided with a piezoelectric element 300, a cavity 320 that is filled with ink, the nozzle N that communicates with the cavity 320, and a vibrating plate 310. In the discharging unit D, the piezoelectric element 300 being driven by the drive signal Vin causes the ink in the cavity 320 to be discharged from the nozzle N. The cavity 320 of the discharging unit D is a space defined by a cavity plate 340 that is formed into a predetermined shape such as having a recessed portion, a nozzle plate 330 in which the nozzle N is formed, and the vibrating plate 310. The cavity 320 communicates with the reservoir 350 through the ink supply port 360. The reservoir 350 communicates with one ink cartridge 31 through the ink intake port 370.

The present embodiment employs, for example, a unimorph (monomorph) type as illustrated in FIG. 3 as the piezoelectric element 300. The piezoelectric element 300 includes a lower electrode 301, an upper electrode 302, and a piezoelectric body 303 that is disposed between the lower electrode 301 and the upper electrode 302. When a voltage is applied between the lower electrode 301 and the upper electrode 302 by setting the lower electrode 301 to a predetermined reference potential VSS and supplying the drive signal Vin to the upper electrode 302, the piezoelectric element 300 is bent upward in FIG. 3 in response to the voltage applied, and the piezoelectric element 300 vibrates in consequence.

The vibrating plate 310 is installed on an opening portion of the upper face of the cavity plate 340, and the lower electrode 301 is bonded to the vibrating plate 310. Thus, when the piezoelectric element 300 vibrates owing to the drive signal Vin, the vibrating plate 310 also vibrates. The vibrating plate 310 vibrating changes the volume of the cavity 320 (pressure in the cavity 320) and causes the ink filling the inside of the cavity 320 to be discharged from the nozzle N. Ink is supplied from the reservoir 350 when discharge of ink reduces the amount of ink in the cavity 320. Ink is supplied to the reservoir 350 from the ink cartridge 31 through the ink intake port 370.

Figure 4:
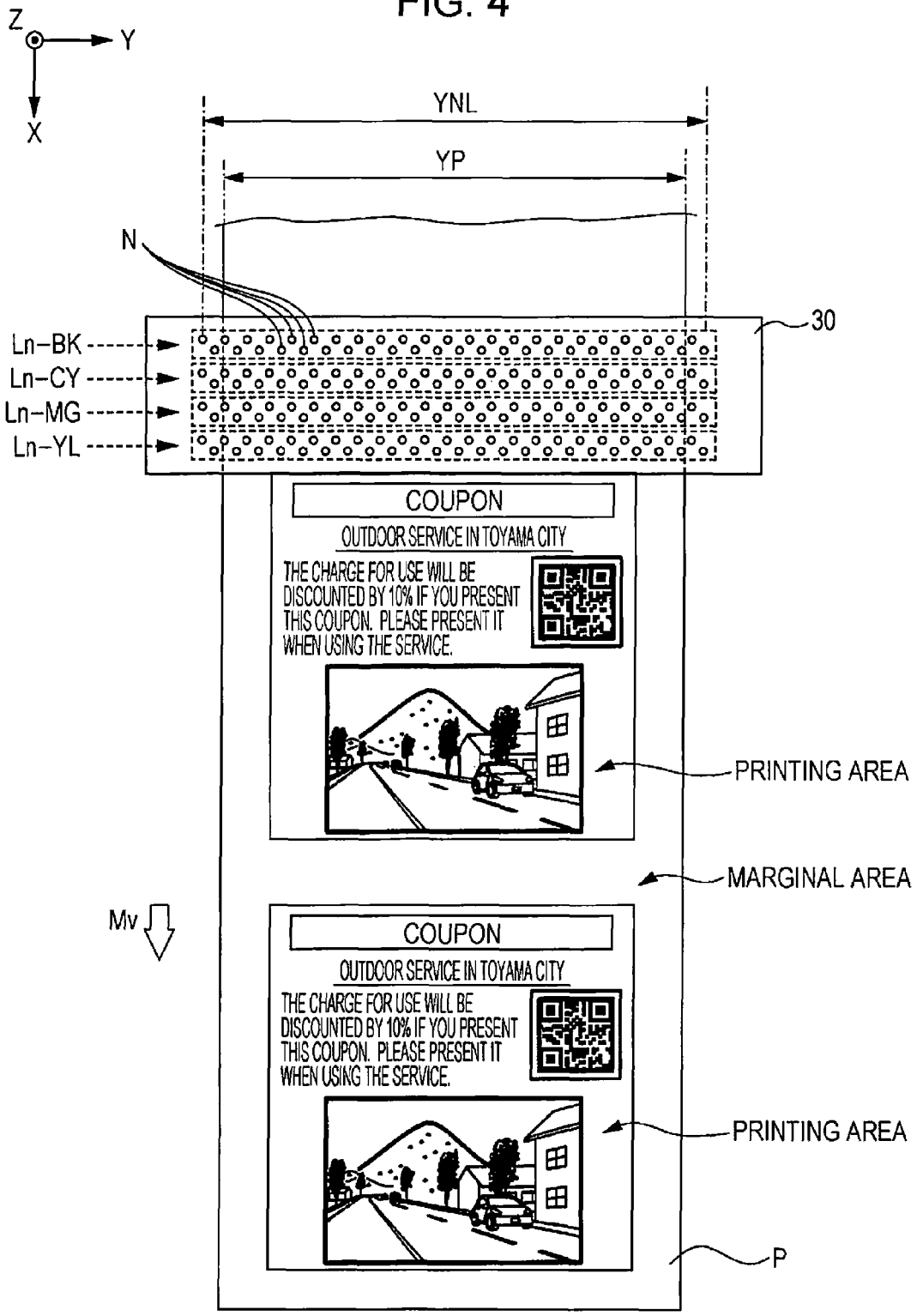
FIG. 4 is a plan view illustrating an example of arrangement of nozzles in the recording head.

FIG. 4 is a descriptive diagram for describing an example of arrangement of M numbers of nozzles N disposed in the recording head 30 when the ink jet printer 1 is viewed in plane from the +Z direction or from the −Z direction.

Disposed in the recording head 30 is, as illustrated in FIG. 4, a nozzle array Ln that is configured of four arrays of a nozzle array Ln-BK configured of a plurality of nozzles N, a nozzle array Ln-CY configured of a plurality of nozzles N, a nozzle array Ln-MG configured of a plurality of nozzles N, and a nozzle array Ln-YL configured of a plurality of nozzles N.

Each of the plurality of nozzles N belonging to the nozzle array Ln-BK is the nozzle N disposed in the discharging unit D that discharges black (BK) ink. Each of the plurality of nozzles N belonging to the nozzle array Ln-CY is the nozzle N disposed in the discharging unit D that discharges cyan (CY) ink. Each of the plurality of nozzles N belonging to the nozzle array Ln-MG is the nozzle N disposed in the discharging unit D that discharges magenta (MG) ink. Each of the plurality of nozzles N belonging to the nozzle array Ln-YL is the nozzle N disposed in the discharging unit D that discharges yellow (YL) ink. Each of the four arrays of the nozzle array Ln is disposed to extend in the Y-axis direction when viewed in plane. A range YNL of extension of the nozzle array Ln in the Y-axis direction is greater than or equal to a range YP of extension of the recording paper P in the Y-axis direction when printing is performed on the recording paper P (specifically, a recording paper P of which the width in the Y-axis direction is equal to the maximum printable width of the ink jet printer 1 among the recording papers P).

The plurality of nozzles N constituting the nozzle array Ln, as illustrated in FIG. 4, is arranged into a so-called zigzag form in which the positions of the even nozzles N are different from the positions of the odd nozzles N in the X-axis direction from the left side (−Y side) of FIG. 4. In the nozzle array Ln, a gap (pitch) between the nozzles N in the Y-axis direction may be appropriately set depending on a printing resolution (dot per inch (dpi)).

The printing process in the present embodiment includes the assumption that not only one long image is formed across the entire area-of the recording paper P but also, as illustrated in FIG. 4, a plurality of images is formed in one-to-one correspondence with a plurality of printing areas after the recording paper P is divided into a plurality of printing areas (for example, an A4-size rectangular area in the case of printing an A4-size image on the recording paper P or a label in the case of a label paper) and a marginal area for defining each of the plurality of printing areas.

3. Operation of Discharging Unit and Residual Vibration

Next, an operation of discharging ink from the discharging unit D and residual vibration occurring in the discharging unit D will be described with reference to FIG. 5A to FIG. 13.

Figure 5A:
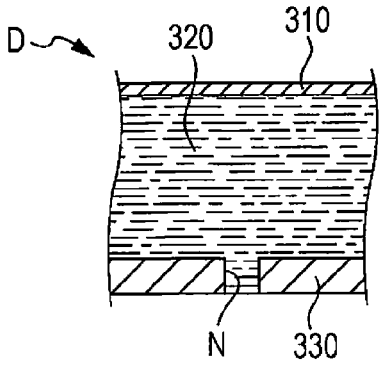
FIGS. 5A to 5C are descriptive diagrams illustrating changes in the sectional shape of a discharging unit when a drive signal is supplied.
Figure 5B:
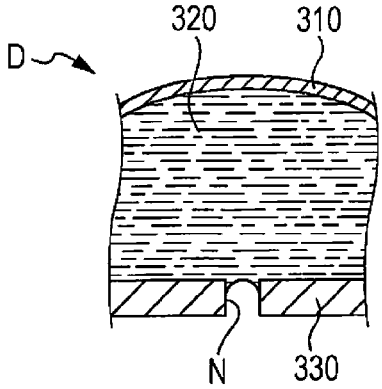
Figure 5C:
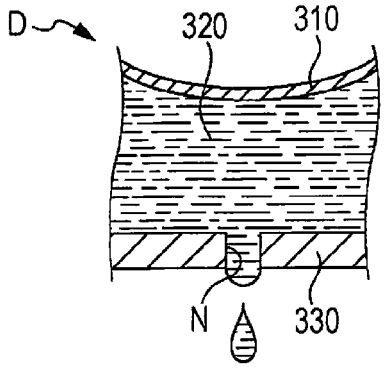

FIGS. 5A to 5C are descriptive diagrams for describing the operation of discharging ink from the discharging unit D.

In the state illustrated in FIG. 5A, when the piezoelectric element 300 provided in the discharging unit D is supplied with the drive signal Vin from the head driver 50, strain occurs in response to an electric field that is applied between the electrodes in the piezoelectric element 300, and the vibrating plate 310 of the discharging unit D is bent upward in FIG. 5A. Accordingly, as illustrated in FIG. 5B, the volume of the cavity 320 in the discharging unit D is enlarged in comparison with the initial state illustrated in FIG. 5A. In the state illustrated in FIG. 5B, when the potential of the drive signal Vin is changed, the vibrating plate 310 is restored by the elastic restoring force thereof and moves downward in FIG. 5B beyond the position of the vibrating plate 310 in the initial state, and the volume of the cavity 320 is rapidly contracted as illustrated in FIG. 5C. The compressive pressure occurring in the cavity 320 causes part of the ink filling the cavity 320 to be discharged as an ink drop from the nozzle N that communicates with the cavity 320.

Vibration of the vibrating plate 310 in each discharging unit D, after a series of processes in the ink discharging operation ends, becomes damped, that is, becomes residual until a next ink discharging operation is initiated. Residual vibrations occurring in the vibrating plate 310 of the discharging unit D are assumed to have a natural vibration frequency that is determined by an acoustic resistance Res depending on the shape of the nozzle N or the ink supply port 360 or the viscosity and the like of ink, an inertance Int depending on the weight of ink in a channel, and a compliance Cm of the vibrating plate 310.

A model for calculating residual vibration occurring in the vibrating plate 310 of the discharging unit D on the basis of the above assumption will be described.

Figure 6:
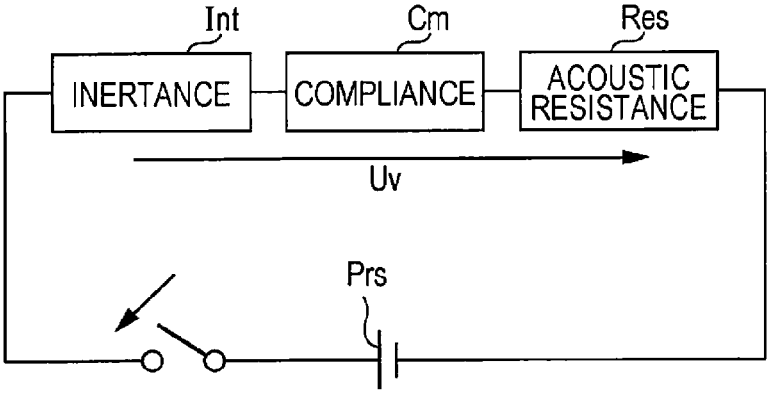
FIG. 6 is a circuit diagram illustrating a simple harmonic vibration model that represents residual vibration in the discharging unit.

FIG. 6 is a circuit diagram illustrating a simple harmonic vibration calculation model that assumes residual vibration of the vibrating plate 310. As such, the model for calculating residual vibration of the vibrating plate 310 is represented by an acoustic pressure Prs, and the inertance Int, the compliance Cm, and the acoustic resistance Res above. Calculating step response with respect to a volume velocity Uv when the acoustic pressure Prs is applied to the circuit in FIG. 6 yields the following equations.

$$Uv=\{Prs/(\omega\cdot Int)\}e^{-\sigma t}\cdot\sin(\omega t)$$

$$\omega=\{1/(Int\cdot Cm)-\alpha^2\}^{1/2}$$

$$\sigma=\mathrm{Res}/(2\cdot Int)$$

A calculation result (calculated value) obtained from the equations is compared with an experiment result (experimental value) in an experiment performed on the residual vibration of the discharging unit D that is separately performed from the calculation. The experiment performed on the residual vibration is an experiment for detecting residual vibrations occurring in the vibrating plate 310 of the discharging unit D after ink is discharged from the discharging unit D in a normal state of discharge of ink.

Figure 7:
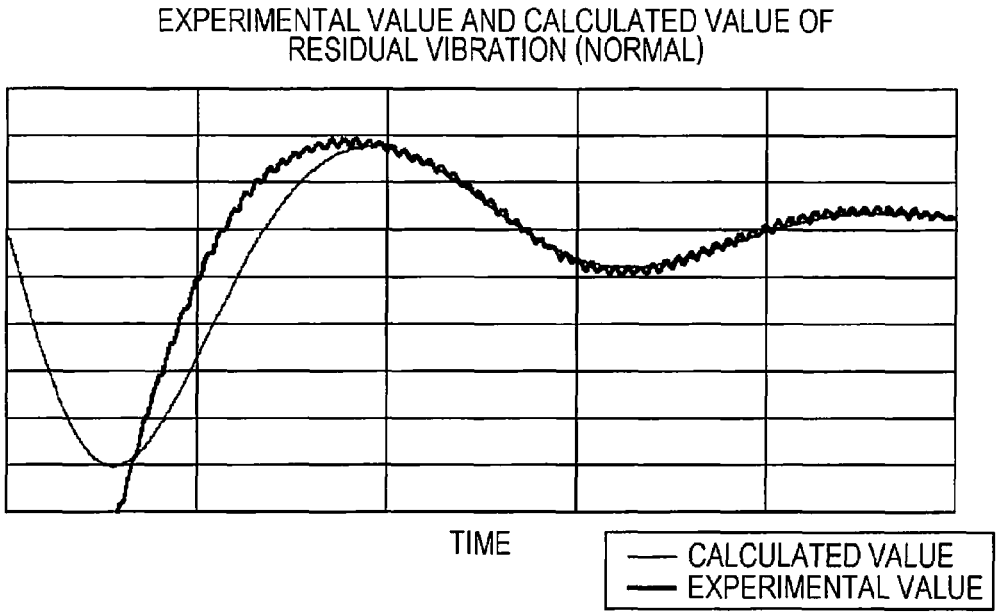
FIG. 7 is a graph illustrating a relationship between an experimental value and a calculated value of residual vibration when a state of discharge in the discharging unit is normal.

FIG. 7 is a graph illustrating a relationship between the experimental value and the calculated value of the residual vibration. It is understood from the graph illustrated in FIG. 7 that two waveforms of the experimental value and the calculated value approximately match when the state of discharge of ink in the discharging unit D is normal.

There may be a case where the state of discharge of ink in the discharging unit D is abnormal, and an ink drop is not normally discharged from the nozzle N of the discharging unit D, that is, where an abnormal discharge occurs even if the discharging unit D performs an ink discharge operation. Examples of causes of such an abnormal discharge include (1) mingling of air bubbles in the cavity 320, (2) thickening or solidification of ink in the cavity 320 due to drying and the like of ink in the cavity 320, and (3) attachment of a foreign object such as paper dust near the outlet of the nozzle N.

An abnormal discharge, as described above, typically means a state where ink cannot be discharged from the nozzle N. That is, a phenomenon of non-discharge of ink occurs and causes missing dots at pixels in the image printed on the recording paper P. In the case of an abnormal discharge, as described above, even when ink is discharged from the nozzle N, ink may not correctly hit the recording paper P due to an excessively small amount of ink or due to deviation of the direction of flight (trajectory) of the discharged ink drop, thus appearing as missing dots at pixels.

In the description below, at least one value of the acoustic resistance Res and the inertance Int is adjusted on the basis of the comparison result illustrated in FIG. 7 for each cause of an abnormal discharge occurring in the discharging unit D so that the calculated value and the experimental value of the residual vibration approximately match.

Figure 8:
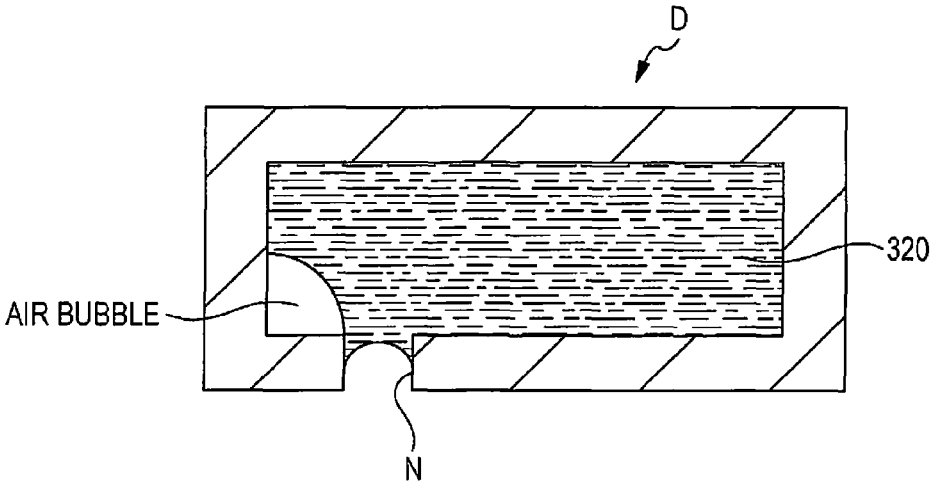
FIG. 8 is a descriptive diagram illustrating a state of the discharging unit when an air bubble mingles in the discharging unit.

First, one of the causes of an abnormal discharge, (1) mingling of air bubbles in the cavity 320 will be reviewed. FIG. 8 is a schematic diagram for describing the case where an air bubble is mingled in the cavity 320. It is considered that the total weight of ink filling the cavity 320 is reduced, and the inertance Int is decreased when an air bubble is mingled in the cavity 320 as illustrated in FIG. 8. In addition, it is considered that when an air bubble is attached near the nozzle N as illustrated in FIG. 8, the diameter of the nozzle N is regarded as increased by the size of the diameter of the air bubble, and the acoustic resistance Res is decreased.

Figure 9:
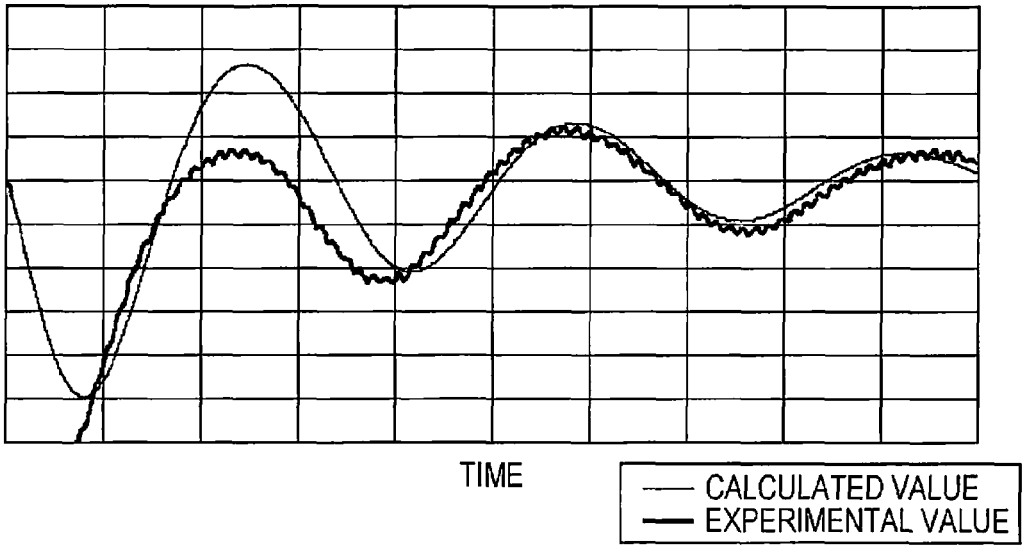
FIG. 9 is a graph illustrating an experimental value and a calculated value of residual vibration in the state where an air bubble mingles in the discharging unit.

Therefore, the result (graph) in FIG. 9 is obtained by decreasing the acoustic resistance Res and the inertance Int in comparison with the normal state of discharge of ink as illustrated in FIG. 7 and matching the calculated value against the experimental value of the residual vibration at the time of mingling of the air bubble. As illustrated in FIG. 7 and FIG. 9, when an abnormal discharge occurs due to mingling of the air bubble in the cavity 320, the frequency of the residual vibration is increased in comparison with the normal state of discharge. It is also found that the damping ratio of the amplitude of the residual vibration is also decreased by a decrease in the acoustic resistance Res and the like, and the amplitude of the residual vibration is slowly decreased.

Figure 10:
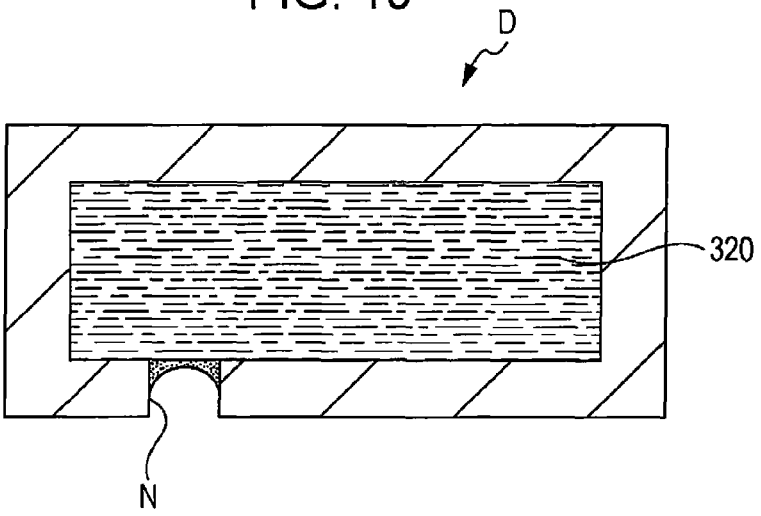
FIG. 10 is a descriptive diagram illustrating a state of the discharging unit when ink solidifies near the nozzle.

Next, one of the causes of an abnormal discharge, (2) thickening or solidification of ink in the cavity 320 will be reviewed. FIG. 10 is a schematic diagram for describing the case where ink dries and solidifies near the nozzle N of the cavity 320. When ink dries and solidifies near the nozzle N as illustrated in FIG. 10, the ink in the cavity 320 is trapped in the cavity 320. In such a case, it is considered that the acoustic resistance Res is increased.

Figure 11:
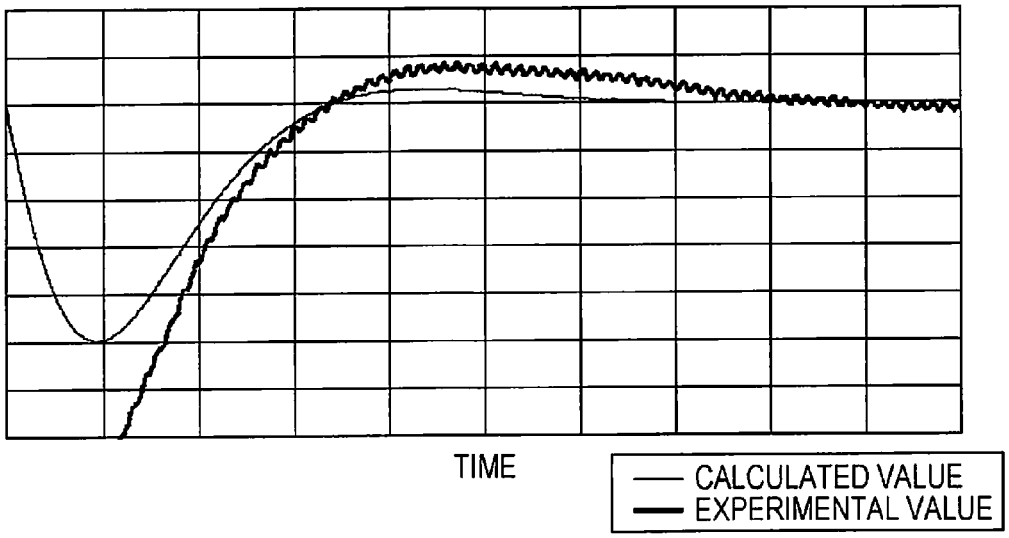
FIG. 11 is a graph illustrating an experimental value and a calculated value of residual vibration in the state where ink cannot be discharged due to solidification of ink near the nozzle.

Therefore, the result (graph) in FIG. 11 is obtained by increasing the acoustic resistance Res in comparison with the normal state of discharge of ink as illustrated in FIG. 7 and matching the calculated value against the experimental value of the residual vibration when ink solidifies or thickens near the nozzle N. The experimental value illustrated in FIG. 11 results from leaving the discharging unit D without mounting an unillustrated cap for several days and measuring the residual vibration of the vibrating plate 310 provided in the discharging unit D in the state where ink solidifies near the nozzle N. As illustrated in FIG. 7 and FIG. 11, when ink solidifies near the nozzle N in the cavity 320, a waveform characterized by an extreme decrease in the frequency of the residual vibration and overdamped residual vibration is obtained in comparison with the normal state of discharge. The reason for the waveform is explained as follows. When the vibrating plate 310 is attracted in the +Z direction (upward) so as to discharge ink, ink from the reservoir flows into the cavity 320, and then the vibrating plate 310 moves in the −Z direction (downward). At this time, there is no way of escape for the ink in the cavity 320, and thus the vibrating plate 310 cannot vibrate rapidly (overdamped).

Figure 12:
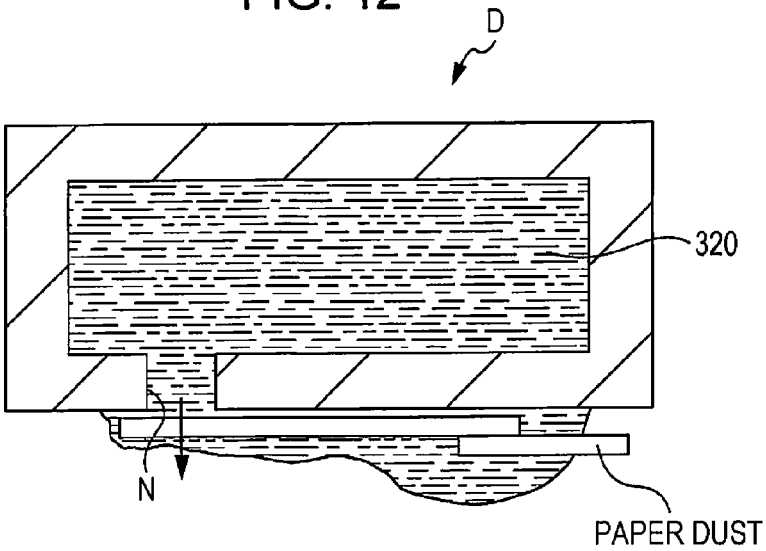
FIG. 12 is a descriptive diagram illustrating a state of the discharging unit when paper dust is attached near an outlet of the nozzle.

Next, one of the causes of an abnormal discharge, (3) attachment of a foreign object such as paper dust near the outlet of the nozzle N will be reviewed. FIG. 12 is a schematic diagram for describing the case where paper dust is attached near the outlet of the nozzle N. As illustrated in FIG. 12, when paper dust is attached near the outlet of the nozzle N, ink oozes from the cavity 320 through the paper dust, and thus ink cannot be discharged from the nozzle N. When paper dust is attached near the outlet of the nozzle N, and ink oozes from the nozzle N, the amount of ink oozing from the cavity 320 when viewed from the vibrating plate 310 is further increased than the normal state of discharge. Thus, it is considered that the inertance Int is increased. In addition, it is considered that the acoustic resistance Res is increased owing to fibers of the paper dust attached near the outlet of the nozzle N.

Figure 13:
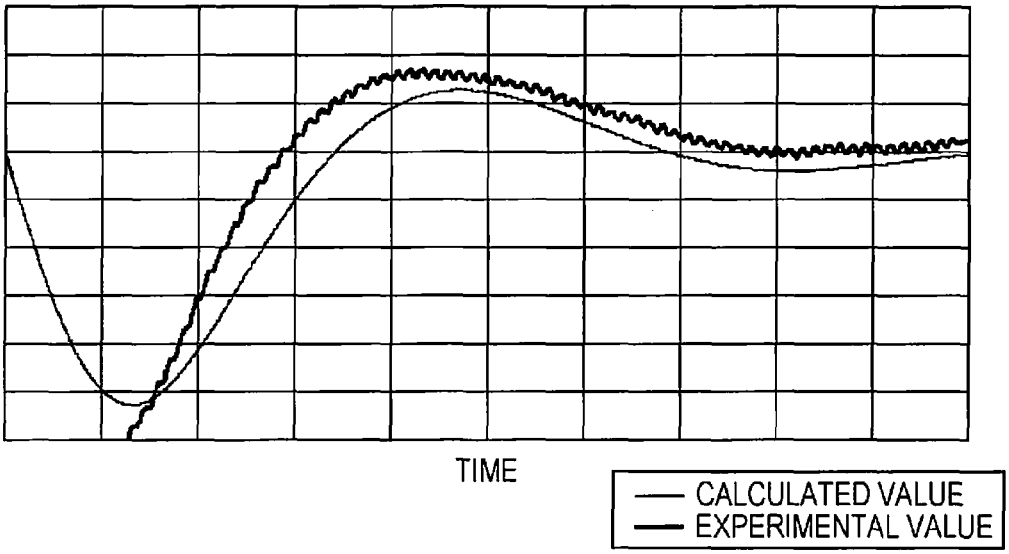
FIG. 13 is a graph illustrating an experimental value and a calculated value of residual vibration in the state where ink cannot be discharged due to attachment of paper dust near the outlet of the nozzle.

Therefore, the result (graph) in FIG. 13 is obtained by increasing the inertance Int and the acoustic resistance Res in comparison with the normal state of discharge of ink as illustrated in FIG. 7 and matching the calculated value against the experimental value of the residual vibration when paper dust is attached near the outlet of the nozzle N. It is understood from the graphs in FIG. 7 and FIG. 13 that when paper dust is attached near the outlet of the nozzle N, the frequency of the residual vibration is decreased in comparison with the normal state of discharge.

In addition, it is understood from the graphs in FIG. 11 and FIG. 13 that the case (3) attachment of a foreign object such as paper dust near the outlet of the nozzle N has a higher frequency of the residual vibration than the case (2) thickening of ink in the cavity 320.

All of the case (2) thickening of ink and the case (3) attachment of paper dust near the outlet of the nozzle N have a low frequency of the residual vibration in comparison with the normal state of discharge of ink. These two causes of an abnormal discharge can be distinguished by comparing the waveform of the residual vibration or specifically, comparing the frequency or the cycle of the residual vibration with a predetermined threshold.

It is apparent from the above description that the state of discharge in each discharging unit D can be determined on the basis of the waveform of the residual vibration or particularly, on the basis of the frequency or the cycle of the residual vibration occurring when each discharging unit D is driven. More specifically, it is possible to determine on the basis of the frequency of the cycle of the residual vibration whether the state of discharge in each discharging unit D is normal and which one of the above causes (1) to (3) is the cause of the abnormal discharge when the state of discharge in each discharging unit D is abnormal.

The ink jet printer 1 according to the present embodiment performs the discharge state determination process of determining the state of discharge by analyzing the residual vibration.

4. Configuration and Operation of Head Driver

Next, a configuration and operation of the head driver 50 (the drive unit 51, the residual vibration detecting unit 52, and the switching unit 53) will be described with reference to FIG. 14 to FIG. 20.

4.1. Drive Unit

Figure 14:
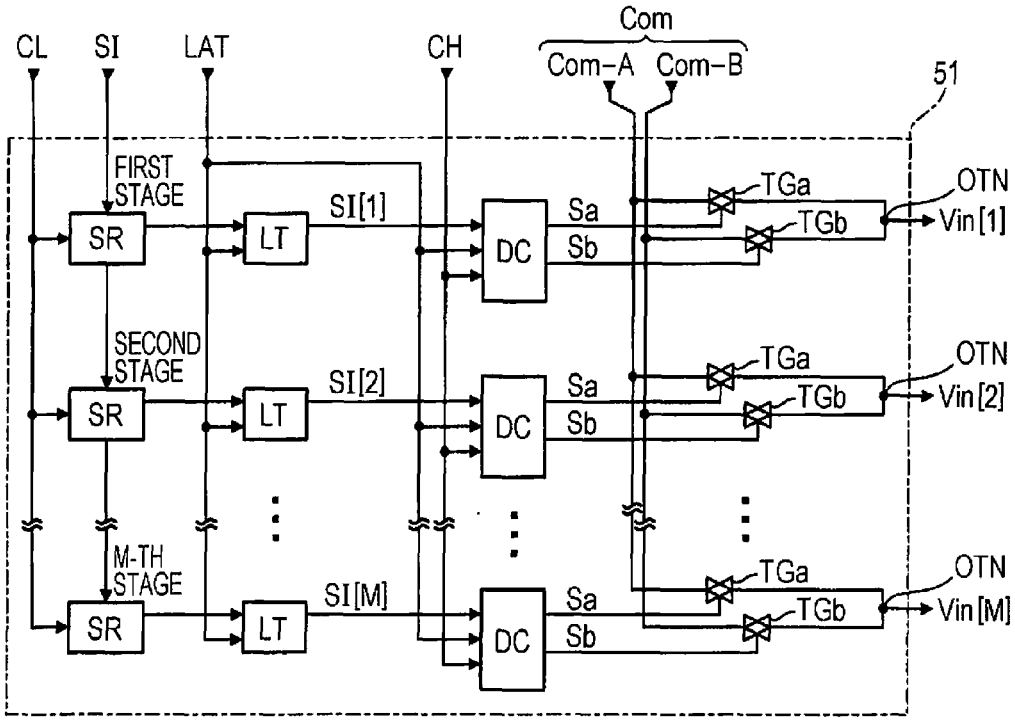
FIG. 14 is a block diagram illustrating a configuration of a drive unit.

FIG. 14 is a block diagram illustrating a configuration of the drive unit 51 in the head driver 50.

As illustrated in FIG. 14, the drive unit 51 includes M numbers of sets each configured of a shift register SR, a latch circuit LT, a decoder DC, and transmission gates TGa and TGb in one-to-one correspondence with the M numbers of discharging units D. In the description below, each element constituting the M numbers of sets may be referred to as a first stage, a second stage, . . . , an M-th stage in order from the top of FIG. 14.

The drive unit 51 is supplied with a clock signal CL, the printing signal SI, a latch signal LAT, a change signal CH, and the drive waveform signal Com (Com-A and Com-B) from the control unit 6.

The printing signal SI is a digital signal that defines the amount of ink discharged from each discharging unit D (each nozzle N) in forming one dot of an image. More specifically, the printing signal SI according to the present embodiment defines the amount of ink that each discharging unit D discharges with two bits of a high-order bit b1 and a low-order bit b2. The printing signal SI, for example, is serially supplied to the drive unit 51 from the control unit 6 in synchronization with the clock signal CL.

Controlling the amount of ink discharged from each discharging unit D with the printing signal SI allows representation of four shades of non-recording, a small dot, a medium dot, and a large dot for each dot on the recording paper P.

Each shift register SR temporarily holds the printing signal SI in two bits for each corresponding discharging unit D. Specifically, the M numbers of shift registers SR in the first stage, the second stage, . . . , and the M-th stage in one-to-one correspondence with the M numbers of discharging units D are in cascade connection with each other, and the serially supplied printing signal SI is sequentially transmitted to the rear stage according to the clock signal CL. When the printing signal SI is transmitted to all of the M numbers of shift registers SR, each of the M numbers of shift registers SR maintains holding the corresponding two bits of data of the printing signal SI.

Each of the M numbers of latch circuits LT, at the timing when the latch signal LAT rises, simultaneously latches two bits of the printing signal SI that correspond to each stage and are held in each of the M numbers of shift registers SR. In FIG. 14, each of SI[1], SI[2], . . . , and SI[M] represents two bits of the printing signal SI that are latched by each latch circuit LT corresponding to the shift registers SR in the first stage, the second stage, . . . , and the M-th stage.

An operation time period that is a time period of performance of at least one of the printing process and the discharge state determination process by the ink jet printer 1 is configured of a plurality of unit operation time periods Tu. Each unit operation time period Tu is configured of a control time period Ts1 and a subsequent control time period Ts2. In the present embodiment, the control time periods Ts1 and Ts2 have the same length in time.

In addition, in the present embodiment, the unit operation time period Tu is classified into two types of unit operation time period Tu of a unit printing operation time period Tu-P (refer to FIG. 16) that is the unit operation time period Tu of performing the printing process and a unit determination operation time period Tu-T (refer to FIG. 17) that is the unit operation time period Tu of performing the discharge state determination process.

The ink jet printer 1 according to the present embodiment, as described above, divides the long recording paper P into the plurality of printing areas and the marginal area that defines each of the plurality of printing areas and forms one image in each printing area.

Specifically, the control unit 6 classifies the time period, among the plurality of unit operation time periods Tu constituting the operation time period, in which at least a part of the printing areas of the recording paper P is positioned on the lower side (−Z side) of the recording head 30 as the unit printing operation time period Tu-P and controls operation of each unit in the ink jet printer 1 so as to perform the printing process during the unit printing operation time period Tu-P.

Meanwhile, the control unit 6 classifies the time period, among the plurality of unit operation time periods Tu constituting the operation time period, in which the marginal area of the recording paper P is positioned on the lower side (−Z side) of the recording head 30 as the unit determination operation time period Tu-T and controls operation of each unit in the ink jet printer 1 so as to perform the discharge state determination process during the unit determination operation time period Tu-T.

The control unit 6 supplies the printing signal SI to the drive unit 51 for each unit operation time period Tu (the unit printing operation time period Tu-P and the unit determination operation time period Tu-T) and supplies the latch signal LAT to the latch circuits LT for each unit operation time period Tu so that the latch circuits LT latch the printing signals SI[1], SI[2], . . . , SI[M]. That is, the control unit 6 controls the drive unit 51 so that the drive signal Vin is supplied to the M numbers of discharging units D for each unit operation time period Tu.

The control unit 6, more specifically, controls the drive unit 51 so that the drive signal Vin for the printing process is supplied to each of the M numbers of discharging units D during the unit printing operation time period Tu-P of performing the printing process among the plurality of unit operation time periods Tu. Accordingly, the M numbers of discharging units D discharge the amount of ink corresponding to the print data Img to the recording paper P during the unit printing operation time period Tu-P, and the printing process of forming the image corresponding to the print data Img on the recording paper P is performed.

In addition, the control unit 6 controls the drive unit 51 so that the drive signal Vin for the determination process is supplied to each of the M numbers of discharging units D during the unit determination operation time period Tu-T of performing the discharge state determination process among the plurality of unit operation time periods Tu. Accordingly, the discharge state determination process of determining whether an abnormal discharge occurs in the discharging unit D is performed during the unit determination operation time period Tu-T.

The decoder DC decodes two bits of the printing signal SI latched by the latch circuit LT and outputs selection signals Sa and Sb during each of the control time periods Ts1 and Ts2.

FIGS. 15A and 15B are descriptive diagrams illustrating the content of decoding that the decoder DC performs during each unit operation time period Tu. FIG. 15A illustrates the content of decoding performed by the decoder DC during the unit printing operation time period Tu-P of performing the printing process, and FIG. 15B illustrates the content of decoding performed by the decoder DC during the unit determination operation time period Tu-T of performing the discharge state determination process.

As illustrated in FIGS. 15A and 15B, when the content of the printing signal SI[m] corresponding to the m-th stage is, for example, (b1, b2)=(1, 0), the decoder DC in the m-th stage sets the selection signal Sa to a high level H and sets the selection signal Sb to a low level L during the control time period Ts1. The decoder DC in the m-th stage sets the selection signal Sb to the high level H and sets the selection signal Sa to the low level L during the control time period Ts2.

The drive unit 51, as illustrated in FIG. 14, is provided with the M numbers of sets of the transmission gates TGa and TGb. The M numbers of sets of the transmission gates TGa and TGb are disposed in one-to-one correspondence with the M numbers of discharging units D. The transmission gate TGa is ON when the selection signal Sa is at the H level and is OFF when the selection signal Sa is at the L level. The transmission gate TGb is ON when the selection signal Sb is at the H level and is OFF when the selection signal Sb is at the L level. When, for example, the content of the printing signal SI[m] in the m-th stage is (b1, b2)=(1, 0), the transmission gate TGa is ON, and the transmission gate TGb is OFF during the control time period Ts1. The transmission gate TGb is ON, and the transmission gate TGa is OFF during the control time period Ts2.

The drive waveform signal Com-A is supplied to one terminal of the transmission gate TGa, and the drive waveform signal Com-B is supplied to one terminal of the transmission gate TGb as illustrated in FIG. 14. The other terminals of the transmission gates TGa and TGb are connected in common to an output terminal OTN toward the switching unit 53.

The transmission gates TGa and TGb are exclusively ON, and the drive waveform signal Com-A or Com-B selected during each of the control time periods Ts1 and Ts2 is output as the drive signal Vin[m] to the output terminal OTN in the m-th stage and is supplied to the discharging unit D[m] in the m-th stage through the switching unit 53.

4.2. Drive Waveform Signal

Figure 16:
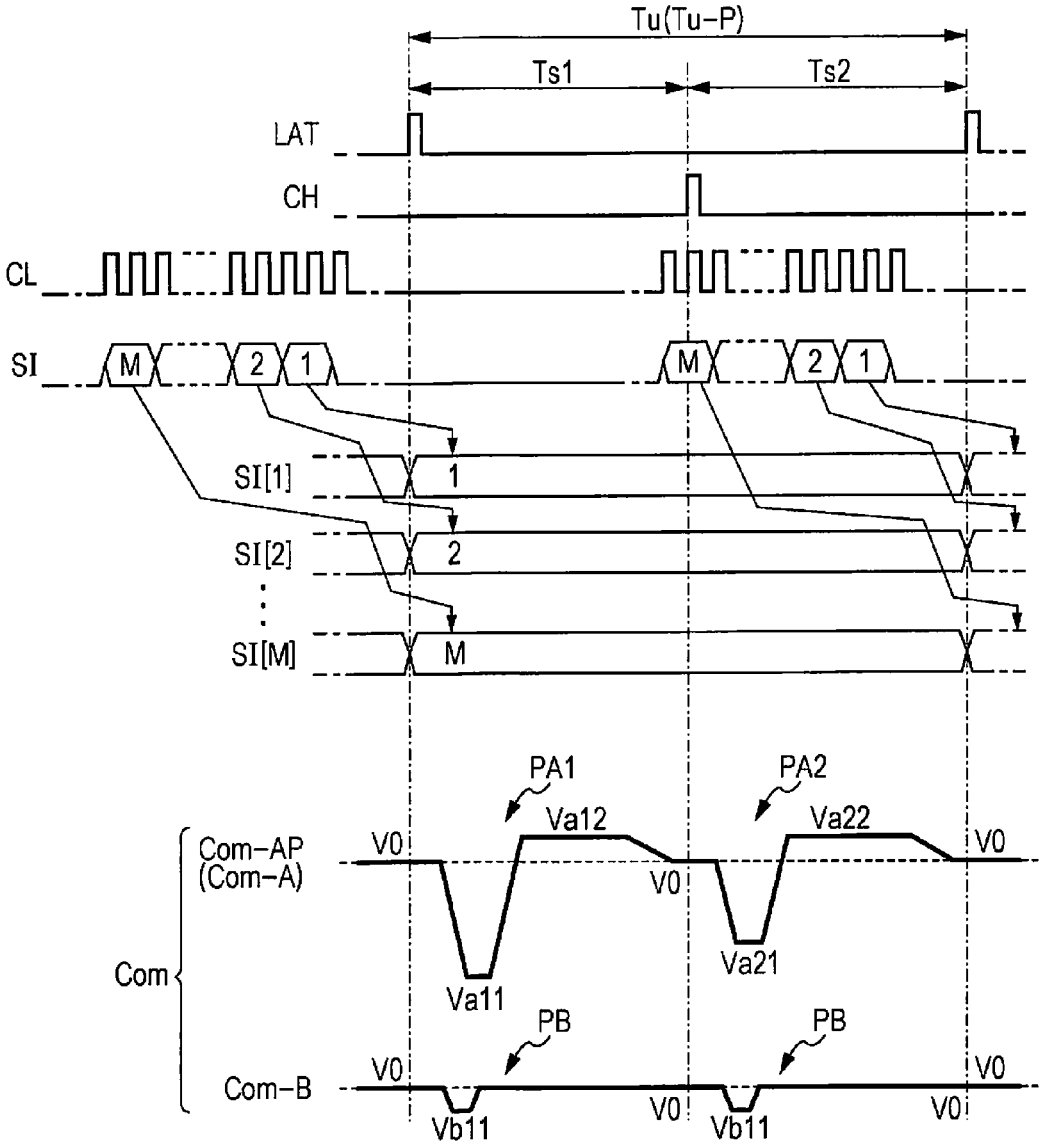
FIG. 16 is a timing chart illustrating operation of the drive unit.
Figure 17:
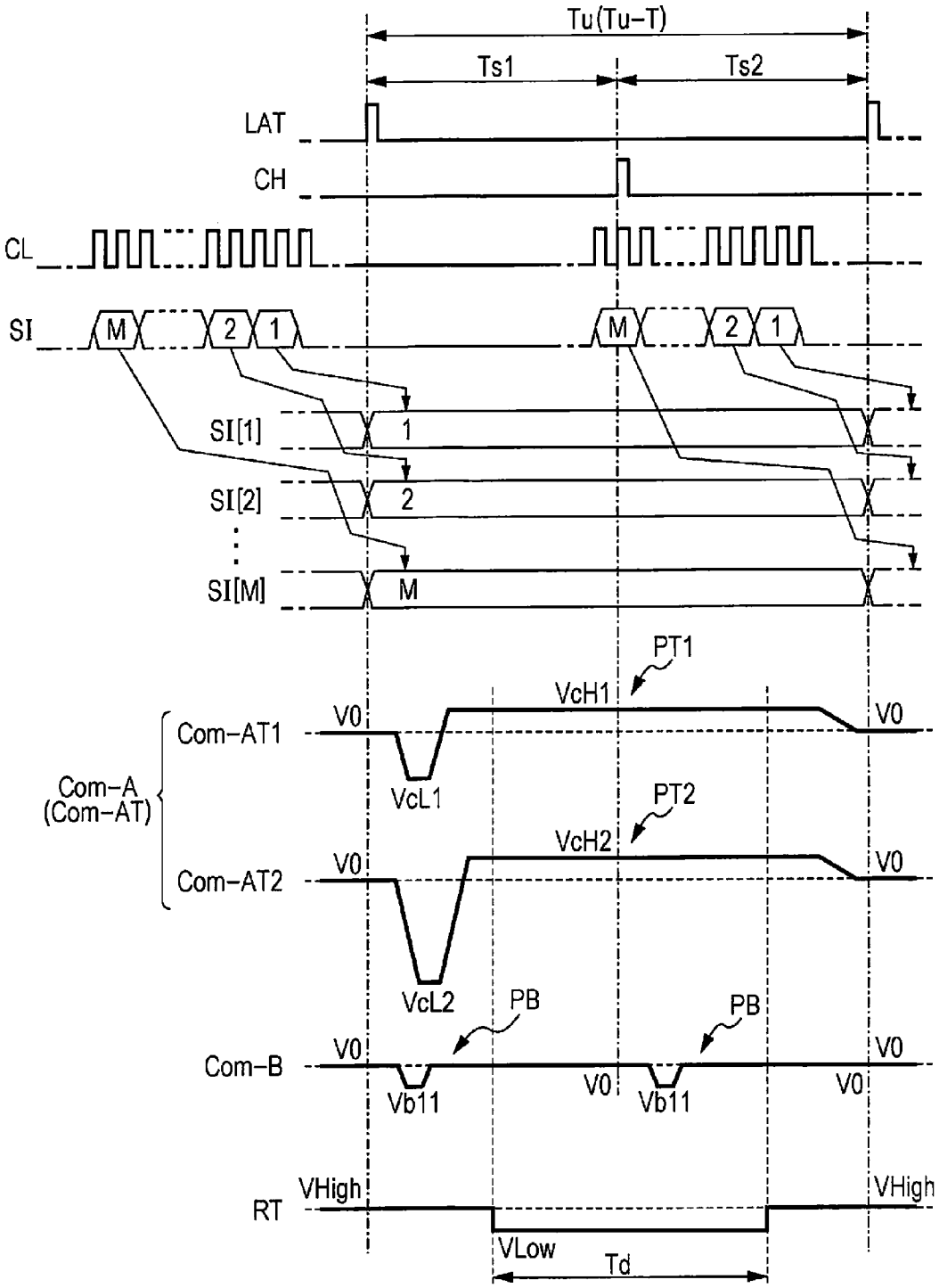
FIG. 17 is a timing chart illustrating operation of the drive unit.

FIG. 16 and FIG. 17 are timing charts for describing the drive waveform signal Com that the control unit 6 outputs during each unit operation time period Tu.

FIG. 16 illustrates an example of the drive waveform signal Com that the control unit 6 outputs during the unit printing operation time period Tu-P of performing the printing process, and FIG. 17 illustrates an example of the drive waveform signal Com that the control unit 6 outputs during the unit determination operation time period Tu-T of performing the discharge state determination process.

In the present embodiment, the waveform of the drive waveform signal Com-A that the control unit 6 outputs is different in the unit printing operation time period Tu-P and in the unit determination operation time period Tu-T. The control unit 6 selects the waveform of the drive waveform signal Com-A by, for example, referring to a setting parameter (not illustrated) stored on the storage unit 60.

In the description below, the drive waveform signal Com-A that the control unit 6 outputs during the unit printing operation time period Tu-P will be referred to as a printing drive waveform signal Com-AP (refer to FIG. 16), and the drive waveform signal Com-A that the control unit 6 outputs during the unit determination operation time period Tu-T will be referred to as a determination drive waveform signal Com-AT (refer to FIG. 17).

The printing drive waveform signal Com-AP that the control unit 6 outputs during the unit printing operation time period Tu-P is a signal that has a unit waveform PA1 provided during the control time period Ts1 and a unit waveform PA2 provided during the control time period Ts2 as illustrated in FIG. 16.

The unit waveform PA1 is a waveform that causes an approximately medium amount of ink corresponding to a medium dot to be discharged from the discharging unit D when the signal of the unit waveform PA1 is supplied as the drive signal Vin to the discharging unit D.

The unit waveform PA2 is a waveform that causes an approximately small amount of ink corresponding to a small dot to be discharged from the discharging unit D when the signal of the unit waveform PA2 is supplied as the drive signal Vin to the discharging unit D.

For example, the potential difference between a minimum potential Van and a maximum potential Va12 of the unit waveform PA1 is set to be greater than the potential difference between a minimum potential Va21 and a maximum potential Va22 of the unit waveform PA2.

As illustrated in FIG. 16 and FIG. 17, the drive waveform signal Com-B that the control unit 6 outputs during the unit operation time period Tu (the unit printing operation time period Tu-P and the unit determination operation time period Tu-T) is a signal that has two unit waveforms PB of which one is provided during the control time period Ts1, and the other is provided during the control period Ts2. The unit waveform PB is a waveform that causes ink not to be discharged from the discharging unit D even when the signal of the unit waveform PB is supplied as the drive signal Vin to the discharging unit D. For example, the potential difference between a minimum potential Vb11 and the maximum potential (a reference potential V0 in FIG. 16) of the unit waveform PB is set to be smaller than the potential difference between the minimum potential Va21 and the maximum potential Va22 of the unit waveform PA2.

In the present embodiment, as illustrated in FIG. 17, there are two types of signal, a non-discharge drive waveform signal Com-AT1 and a discharge drive waveform signal Com-AT2 in the determination drive waveform signal Com-AT. That is, the control unit 6 outputs the drive waveform signal Com-B and outputs one of the non-discharge drive waveform signal Com-AT1 and the discharge drive waveform signal Com-AT2 as the drive waveform signal Com-A (determination drive waveform signal Com-AT) during the unit determination operation time period Tu-T.

The non-discharge drive waveform signal Com-AT1 is a signal that has a unit waveform PT1 provided as if extending across the control time period Ts1 and the control time period Ts2. The unit waveform PT1 is a waveform that causes ink not to be discharged from the discharging unit D even when the signal of the unit waveform PT1 is supplied as the drive signal Vin to the discharging unit D. For example, the potential difference between a minimum potential VcL1 and a maximum potential VcH1 of the unit waveform PT1 is set to be smaller than the potential difference between the minimum potential Va21 and the maximum potential Va22 of the unit waveform PA2.

The discharge drive waveform signal Com-AT2 is a signal that has a unit waveform PT2 provided as if extending across the control time period Ts1 and the control time period Ts2. The unit waveform PT2 is a waveform that causes ink to be discharged from the discharging unit D when the signal of the unit waveform PT2 is supplied as the drive signal yin to the discharging unit D. For example, the potential difference between a minimum potential VcL2 and a maximum potential VcH2 of the unit waveform PT2 is set to be greater than the potential difference between the minimum potential VcL1 and the maximum potential VcH1 of the unit waveform PT1.

In the description below, the minimum potentials VcL1 and VcL2 may be collectively referred to as a minimum potential VcL of the determination drive waveform signal Com-AT, and the maximum potentials VcH1 and VcH2 may be collectively referred to as a maximum potential VcH of the determination drive waveform signal Com-AT.

The discharge state determination process that the determining unit 62 performs has a so-called "non-discharge inspection" and a so-called "discharge inspection" in the present embodiment. The non-discharge inspection is the case where the state of discharge of ink in the discharging unit D is determined on the basis of the residual vibration occurring in the discharging unit D when the discharging unit D is driven to not discharge ink. The discharge inspection is the case where the state of discharge of ink in the discharging unit D is determined on the basis of the residual vibration occurring in the discharging unit D when the discharging unit D is driven to discharge ink.

The control unit 6 outputs the non-discharge drive waveform signal Com-AT1 as the drive waveform signal Com-A during the unit determination operation time period Tu-T of performing the discharge state determination process through the non-discharge inspection. The control unit 6 outputs the discharge drive waveform signal Com-AT2 as the drive waveform signal Com-A during the unit determination operation time period Tu-T of performing the discharge state determination process through the discharge inspection.

The unit operation time period Tu is defined by the latch signal LAT that the control unit 6 outputs as illustrated in FIG. 16 and FIG. 17. The control time periods Ts1 and Ts2 included in the unit operation time period Tu are defined by the latch signal LAT and the change signal CH that the control unit 6 outputs.

The latch circuit LT in the m-th stage, as illustrated in FIG. 16 and FIG. 17, outputs the printing signal SI[m] at the timing when the latch signal LAT rises, and the unit operation time period Tu is started. The decoder DC in the m-th stage outputs the selection signals Sa and Sb during each of the control time periods Ts1 and Ts2 on the basis of the printing signal SI[m] that the latch circuit LT in the m-th stage outputs. The transmission gates TGa and TGb in the m-th stage select one of the drive waveform signals Com-A and Com-B on the basis of the selection signals Sa and Sb that the decoder DC in the m-th stage outputs during each control time period Ts (Ts1 and Ts2). The transmission gates TGa and TGb in the m-th stage output the selected drive waveform signal Com as the drive signal Vin[m].

A detection time period specification signal RT illustrated in FIG. 17 is a signal that defines a detection time period Td of detecting the residual vibration occurring in the discharging unit D. The detection time period specification signal RT and the detection time period Td will be described later.

4.3. Drive Signal

Figure 18:
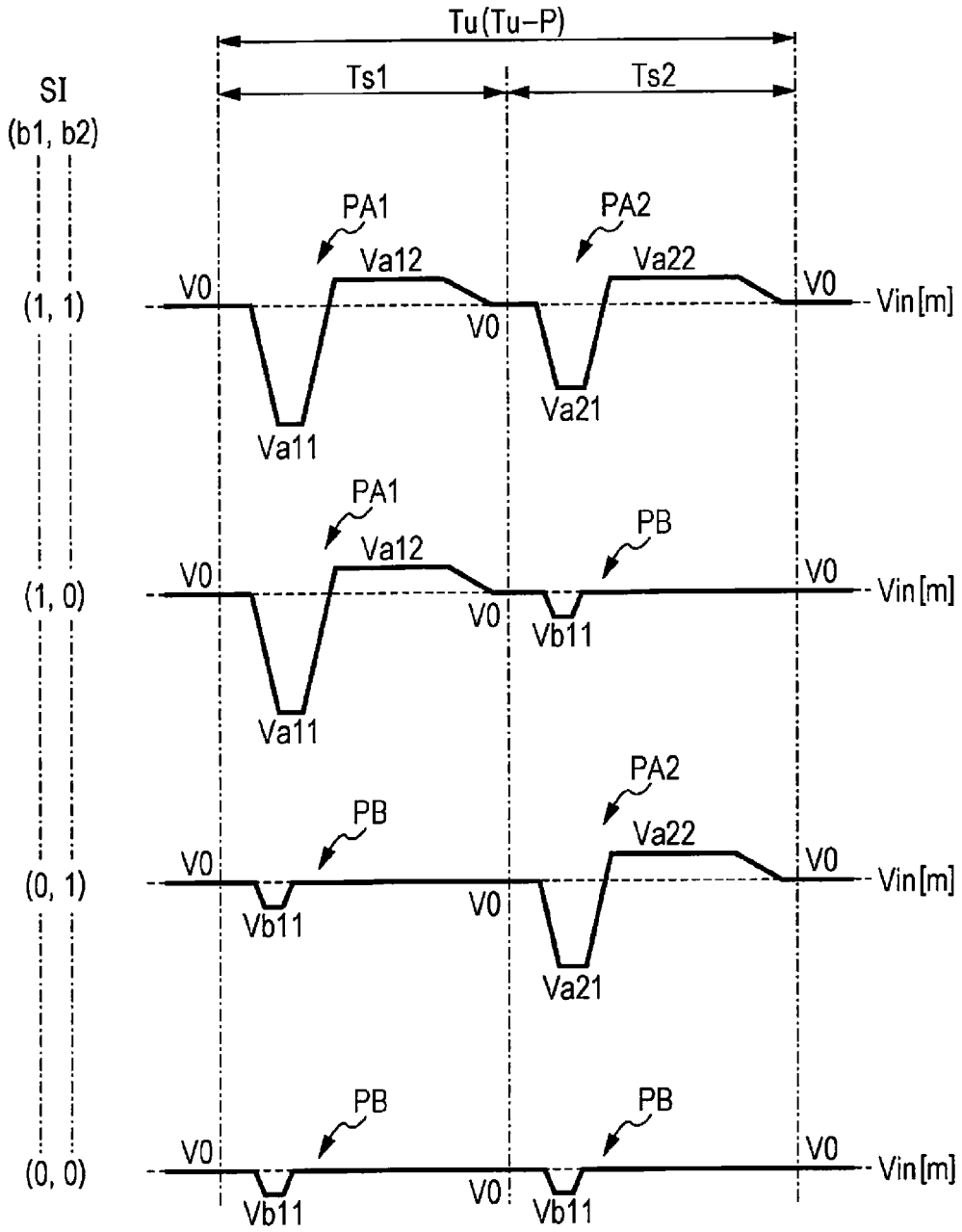
FIG. 18 is a timing chart representing waveforms of the drive signal.

Next, the waveform of the drive signal Vin that the drive unit 51 outputs during the unit printing operation time period Tu-P of the unit operation time period Tu will be described with reference to FIG. 18.

When the printing signal SI[m] that is supplied during the unit printing operation time period Tu-P is (b1, b2)=(1, 1), the selection signal Sa is at the H level in the control time period Ts1. The transmission gate TGa is ON, and the drive waveform signal Com-A is selected. Then, the unit waveform PA1 is output as the drive signal Vin[m]. Similarly, the drive waveform signal Com-A is also selected during the control time period Ts2, and the unit waveform PA2 is output as the drive signal Vin[m]. Accordingly, when the printing signal SI[m] is (b1, b2)=(1, 1), the drive signal Vin[m] for the printing process that is supplied to the discharging unit D[m] includes the unit waveform PA1 and the unit waveform PA2 during the unit printing operation time period Tu-P. In consequence, the discharging unit D[m] discharges an approximately medium amount of ink based on the unit waveform PA1 and an approximately small amount of ink based on the unit waveform PA2, and the ink that is discharged twice is combined to form a large dot on the recording paper P.

The drive waveform signal Com-A is selected during the control time period Ts1, and the drive waveform signal Com-B is selected during the control time period Ts2 when the printing signal Slim) that is supplied during the unit printing operation time period Tu-P is (b1, b2)=(1, 0). Thus, the drive signal Vin[m] for the printing process that is supplied to the discharging unit D[m] includes the unit waveform PA1 and the unit waveform PB. In consequence, the discharging unit D[m] discharges an approximately medium amount of ink based on the unit waveform PA1 to form a medium dot on the recording paper P.

The drive waveform signal Com-B is selected during the control time period Ts1, and the drive waveform signal Com-A is selected during the control time period Ts2 when the printing signal SI[m] that is supplied during the unit printing operation time period Tu-P is (b1, b2)=(0, 1). Thus, the drive signal Vin[m] for the printing process that is supplied to the discharging unit D[m] includes the unit waveform PB and the unit waveform PA2. In consequence, the discharging unit D[m] discharges an approximately small amount of ink based on the unit waveform PA2 to form a small dot on the recording paper P.

The drive waveform signal Com-B is selected during the control time periods Ts1 and Ts2 when the printing signal SI[m] that is supplied during the unit printing operation time period Tu-P is (b1, b2)=(0, 0). Thus, the drive signal Vin[m] for the printing process that is supplied to the discharging unit D[m] includes two unit waveforms PB. In consequence, ink is not discharged from the discharging unit D[m], and a dot is not formed on the recording paper P (non-recorded).

The unit waveform PB is a waveform for preventing thickening of ink by applying minute vibrations to the ink in the discharging unit D. That is, when the discharging unit D is driven to perform the printing process or the discharge state determination process, the discharging unit D is supplied with the drive signal Vin that has a waveform at least other than the unit waveform PB.

In the description below, supplying the drive signal Vin having a waveform other than the unit waveform PB (PA1, PA2, PT1, or PT2) to the discharging unit D during the unit operation time period Tu will be represented as "the discharging unit D is driven" during the unit operation time period Tu. In addition, supplying the drive signal Vin having only the unit waveform PB to the discharging unit D during the unit operation time period Tu will be represented as "the discharging unit D is not driven" during the unit operation time period Tu.

In the present embodiment, as illustrated in FIG. 15B, the printing signal SI[m] that the control unit 6 outputs during the unit determination operation time period Tu-T is (b1, b2)=(1, 1) or =(0, 0).

More specifically, the control unit 6 sets the printing signal SI[m] to (1, 1) when driving the discharging unit D[m] during the unit determination operation time period Tu-T and sets the printing signal SI[m] to (0, 0) when not driving the discharging unit D[m] during the unit determination operation time period Tu-T.

Accordingly, the drive signal Vin[m] that is supplied to the discharging unit D[m] during the unit determination operation time period Tu-T is the determination drive waveform signal Com-AT when the discharging unit D[m] is driven during the unit determination operation time period Tu-T. The drive signal Vin[m] is the drive waveform signal Com-B when the discharging unit D[m] is not driven during the unit determination operation time period Tu-T.

In the description below, the discharging unit D that is the target of determining the state of discharge of ink may be referred to as a determination target discharging unit D-J (an example of a "target discharging unit"). In addition, in the description below, the discharging unit D that is driven by the drive unit 51 to determine the state of discharge of ink in the determination target discharging unit D-J may be referred to as a drive target discharging unit D-R (an example of a "drive discharging unit").

For example, the discharging unit D[m] corresponds to the determination target discharging unit D-J and also corresponds to the drive target discharging unit D-R when the drive unit 51 drives the discharging unit D[m] so as to determine the state of discharge of ink in the discharging unit D[m] through the discharge state determination process.

4.4. Switching Unit

Figure 19:
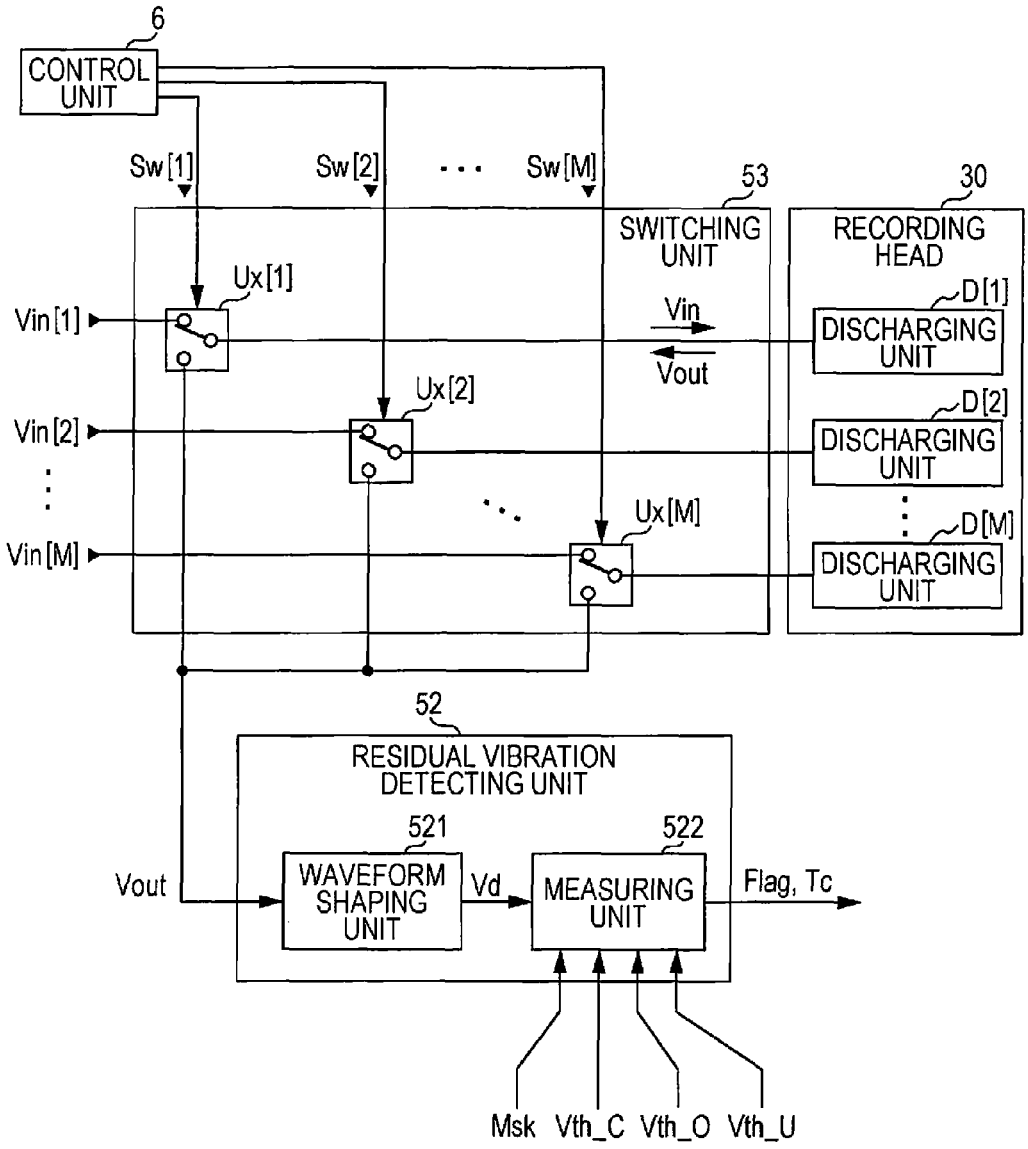
FIG. 19 is a block diagram illustrating configurations of a residual vibration detecting unit and a switching unit.

FIG. 19 is a block diagram illustrating an example of configurations of the residual vibration detecting unit 52 and the switching unit 53 disposed in the head driver 50.

As illustrated in FIG. 19, the switching unit 53 is provided with M numbers of switching circuits Ux (Ux[1], Ux[2], . . . , Ux[M]) in the first stage to the M-th stage that are in one-to-one correspondence with the M numbers of discharging units D.

The switching circuit Ux[m] in the m-th stage electrically connects the upper electrode 302 of the piezoelectric element 300 of the discharging unit D[m] in the m-th stage to one of the output terminal OTN in the m-th stage provided in the drive unit 51 and the residual vibration detecting unit 52.

In the description below, the state where the switching circuit Ux[m] electrically connects the discharging unit D[m] and the output terminal OTN of the drive unit 51 in the m-th stage will be referred to as a first connection state. In addition, the state where the switching circuit Ux[m] electrically connects the discharging unit D[m] and the residual vibration detecting unit 52 will be referred to as a second connection state.

The control unit 6 outputs a switching control signal Sw to each switching circuit Ux so as to control the connection state of each switching circuit Ux.

Specifically, the control unit 6 supplies the switching control signal Sw[m] to the switching circuit Ux[m] during the unit printing operation time period Tu-P of performing the printing process, in which the switching control signal Sw[m] causes the switching circuit Ux[m] to maintain the first connection state during the entire unit printing operation time period Tu-P. Thus, the discharging unit D[m] is supplied with the drive signal Vin[m] from the drive unit 51 during the entire unit printing operation time period Tu-P.

The control unit 6 supplies the switching control signal Sw[m] to the switching circuit Ux[m], in which the switching control signal Sw[m] causes the switching circuit Ux[m] to be in the first connection state during the unit determination operation time period Tu-T except for the detection time period Td and to be in the second connection state during the detection time period Td when the discharging unit D[m] is the determination target discharging unit D-J which is the determination target of the discharge state determination process during the unit determination operation time period Tu-T of performing the discharge state determination process (for the detection time period Td, refer to FIG. 17).

Thus, when the discharging unit D[m] is the determination target discharging unit D-J during the unit determination operation time period Tu-T, the drive signal Vin[m] is supplied to the discharging unit D[m] from the drive unit 51 during the unit determination operation time period Tu-T except for the detection time period Td, and the residual vibration signal Vout is supplied to the residual vibration detecting unit 52 from the discharging unit D[m] during the detection time period Td of the unit determination operation time period Tu-T.

Meanwhile, the control unit 6 supplies the switching control signal Sw[m] to the switching circuit Ux[m], in which the switching control signal Sw[m] causes the switching circuit Ux[m] to maintain the first connection state during the entire unit determination operation time period Tu-T when the discharging unit D[m] is not the determination target discharging unit D-J during the unit determination operation time period Tu-T.

Thus, when the discharging unit D[m] is not the determination target discharging unit D-J during the unit determination operation time period Tu-T, the discharging unit D[m] is supplied with the drive signal Vin[m] from the drive unit 51 during the entire unit determination operation time period Tu-T.

The present embodiment includes the assumption that the ink jet printer 1 is provided with only one residual vibration detecting unit 52 for the M numbers of discharging units D as illustrated in FIG. 19, and the residual vibration detecting unit 52 can detect the residual vibration occurring in one discharging unit D during one unit operation time period Tu. That is, the determining unit 62 according to the present embodiment selects one discharging unit D from the M numbers of discharging units D as the determination target discharging unit D-J and determines the state of discharge of ink in the selected determination target discharging unit D-J during one unit determination operation time period Tu-T.

Thus, the control unit 6 generates the switching control signal Sw so as to electrically connect the discharging unit D selected as the determination target discharging unit D-J during each unit determination operation time period Tu-T to the residual vibration detecting unit 52 in the second connection state during the detection time period Td of the unit determination operation time period Tu-T.

The detection time period Td, as described above, is a time period for detecting the residual vibration occurring in the discharging unit D which is the target of the discharge state determination process (determination target discharging unit D-J). Specifically, in the present embodiment, the detection time period Td, as illustrated in FIG. 17, is a part of or the entire time period during which the potential of the determination drive waveform signal Com-AT maintains the maximum potential VcH after the potential of the determination drive waveform signal Com-AT changes from the minimum potential VcL to the maximum potential VcH to cause the vibrating plate 310 of the discharging unit D which is the target of the discharge state determination process to be significantly displaced. The residual vibration detecting unit 52 detects a change in the electromotive force of the piezoelectric element 300 of the discharging unit D (determination target discharging unit D-J) as the residual vibration signal Vout during the detection time period Td.

The control unit 6 according to the present embodiment sets the potential of the detection time period specification signal RT to a potential VLow during the detection time period Td as illustrated in FIG. 17.

4.5. Residual Vibration Detecting Unit

The residual vibration detecting unit 52, as described above, outputs the detection signal Tc that represents the length in time of one cycle of the residual vibration on the basis of the residual vibration signal Vout.

As illustrated in FIG. 19, the residual vibration detecting unit 52 is provided with a waveform shaping unit 521 and a measuring unit 522. The waveform shaping unit 521 generates a shaped waveform signal Vd on the basis of the residual vibration signal Vout. The measuring unit 522 generates the detection signal Tc on the basis of the shaped waveform signal Vd. The shaped waveform signal Vd is a signal obtained by removing noise components from the residual vibration signal Vout and furthermore, adjusting the amplitude of the residual vibration signal Vout from which noise components are removed to an amplitude appropriate for processes in the measuring unit 522.

The waveform shaping unit 521 is provided with, for example, a high-pass filter and a low-pass filter and includes a configuration capable of outputting the shaped waveform signal Vd obtained by limiting the frequency range of the residual vibration signal Vout and removing noise components from the residual vibration signal Vout. The waveform shaping unit 521 may be configured to include a negative feedback amplifier for adjusting the amplitude of the residual vibration signal Vout, a voltage follower for converting the impedance of the residual vibration signal Vout to output the shaped waveform signal Vd having a low impedance, and the like.

The measuring unit 522, as illustrated in FIG. 19, is supplied with the shaped waveform signal Vd that the waveform shaping unit 521 outputs, a mask signal Msk that the control unit 6 generates, a threshold potential Vth-C that is set to the potential of the central amplitude level of the shaped waveform signal Vd, a threshold potential Vth-O that is set to a higher potential than the threshold potential Vth-C, and a threshold potential Vth-U that is set to a lower potential than the threshold potential Vth-C. The measuring unit 522 outputs the detection signal Tc and a validity flag Flag on the basis of these signals and the like. The validity flag Flag indicates whether the detection signal Tc has a valid value.

Figure 20:
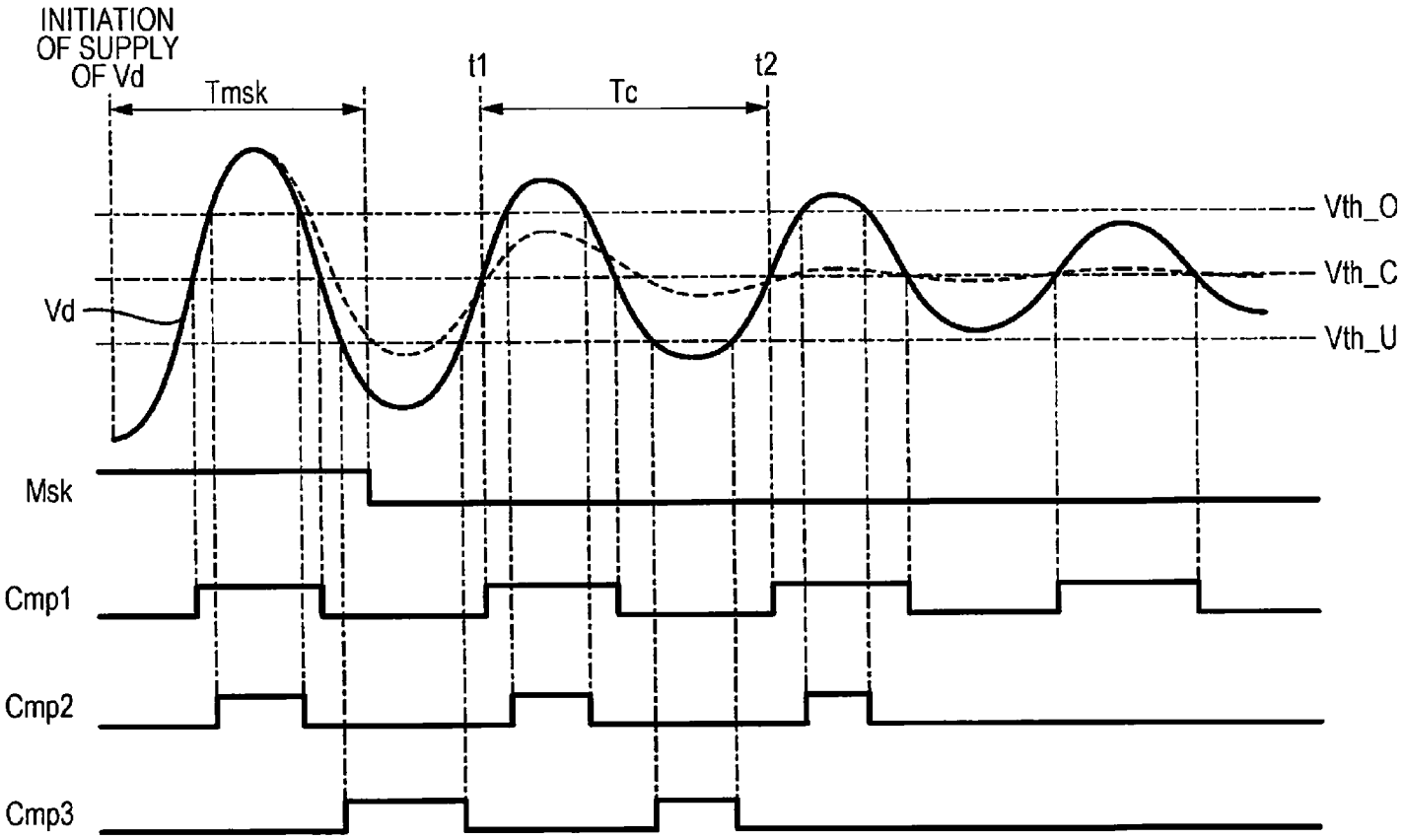
FIG. 20 is a timing chart illustrating operation of the residual vibration detecting unit.

FIG. 20 is a timing chart illustrating operation of the measuring unit 522.

As illustrated in FIG. 20, the measuring unit 522 compares the potential indicated by the shaped waveform signal Vd and the threshold potential Vth-C and generates a comparison signal Cmp1 that is at a high level when the potential indicated by the shaped waveform signal Vd is greater than or equal to the threshold potential Vth-C and is at a low level when the potential indicated by the shaped waveform signal Vd is less than the threshold potential Vth-C.

In addition, the measuring unit 522 compares the potential indicated by the shaped waveform signal Vd and the threshold potential Vth-O and generates a comparison signal Cmp2 that is at a high level when the potential indicated by the shaped waveform signal Vd is greater than or equal to the threshold potential Vth-O and is at a low level when the potential indicated by the shaped waveform signal Vd is less than the threshold potential Vth-O.

In addition, the measuring unit 522 compares the potential indicated by the shaped waveform signal Vd and the threshold potential Vth-U and generates a comparison signal Cmp3 that is at a high level when the potential indicated by the shaped waveform signal Vd is less than the threshold potential Vth-U and is at a low level when the potential indicated by the shaped waveform signal Vd is greater than or equal to the threshold potential Vth-U.

The mask signal Msk is a signal that is at a high level only for a predetermined time period Tmsk from when supply of the shaped waveform signal Vd from the waveform shaping unit 521 is initiated. In the present embodiment, it is possible to accurately obtain the detection signal Tc from which noise components that are superimposed immediately after the start of the residual vibration are removed by targeting the shaped waveform signal Vd only after the time period Tmsk is passed for generating the detection signal Tc.

The measuring unit 522 is provided with a counter (not illustrated). The counter initiates counting a clock signal (not illustrated) at a time t1 that is the timing when the potential indicated by the shaped waveform signal Vd initially becomes equal to the threshold potential Vth-C after the mask signal Msk falls down to a low level. That is, the counter initiates counting a clock signal at the time t1 that is an earlier one of the timing when the comparison signal Cmp1 initially rises up to a high level and the timing when the comparison signal Cmp1 initially falls down to a low level after the mask signal Msk falls down to a low level.

Then, the counter, after initiating the count, ends counting of the clock signal at a time t2 that is the timing when the potential indicated by the shaped waveform signal Vd becomes the threshold potential Vth-C for the second time and outputs the obtained count value as the detection signal Tc. That is, the counter ends counting of the clock signal at the time t2 that is an earlier one of the timing when the comparison signal Cmp1 rises up to a high level for the second time and the timing when the comparison signal Cmp1 falls down to a low level for the second time after the mask signal Msk falls down to a low level. As such, the measuring unit 522 generates the detection signal Tc by measuring the length in time between the time t1 and the time t2 as the length in time of one cycle of the shaped waveform signal Vd.

The detection signal Tc may not be accurately measured when the amplitude of the shaped waveform signal Vd is small as illustrated by a broken line in FIG. 20. In addition, even if it is determined that the state of discharge in the discharging unit D is normal on the basis of only the result of the detection signal Tc, an abnormal discharge may occur in actuality when the amplitude of the shaped waveform signal Vd is small. For example, it is considered that ink is not poured into the cavity 320 when the amplitude of the shaped waveform signal Vd is small, and thus ink cannot be discharged.

Therefore, the present embodiment determines whether the amplitude of the shaped waveform signal Vd is sufficient for measuring the detection signal Tc and outputs the result of the determination as the validity flag Flag.

Specifically, the measuring unit 522 sets the value of the validity flag Flag to the value "1" that indicates the detection signal Tc is valid when the potential indicated by the shaped waveform signal Vd exceeds the threshold potential Vth-O and falls below the threshold potential Vth-U during the time period of counting by the counter, that is, during the time period between the time t1 and the time t2. In other cases, the measuring unit 522 sets the value of the validity flag Flag to the value "0" and then outputs the validity flag Flag. More specifically, the measuring unit 522 sets the value of the validity flag Flag to "1" when the comparison signal Cmp2 rises up to a high level from a low level and then falls down to a low level again, and the comparison signal Cmp3 rises up to a high level from a low level and then falls down to a low level again during the time period between the time t1 and the time t2. In other cases, the measuring unit 522 sets the value of the validity flag Flag to "0".

The measuring unit 522 according to the present embodiment, as such, generates the detection signal Tc that indicates the length in time of one cycle of the shaped waveform signal Vd and also generates the validity flag Flag that indicates whether the amplitude of the shaped waveform signal Vd is sufficient for measuring the detection signal Tc.

The determining unit 62 of the control unit 6 performs the discharge state determination process of determining the state of discharge of ink in the discharging unit D on the basis of the detection signal Tc and the validity flag Flag that the measuring unit 522 generates.

5. Discharge State Determination Process

Hereinafter, the discharge state determination process that the determining unit 62 of the control unit 6 performs will be described with reference to FIG. 21 to FIG. 29.

5.1. Determination Mode of Discharge State Determination Process

The discharge state determination process has been described thus far as specifying one discharging unit D as the determination target discharging unit D-J during one unit operation time period Tu. However, the ink jet printer 1 is provided with the plurality of discharging units D. Thus, determining the state of discharge of ink in the plurality of discharging units D is required in the discharge state determination process.

As described above, the determining unit 62 according to the present embodiment can only determine the state of discharge of ink in one discharging unit D during one unit determination operation time period Tu-T. Thus, it is necessary to perform the discharge state determination process which targets multiple numbers of discharging units D (determination target discharging unit D-J) during a plurality of unit determination operation time periods Tu-T so as to determine the state of discharge of ink in the plurality of discharging units D. Therefore, in the present embodiment, the discharge state determination process is performed for multiple numbers of discharging units D as the determination target discharging unit D-J during a determination time period configured of the plurality of unit determination operation time periods Tu-T.

The determination time period, in principle, is a time period configured of the plurality of continuous unit determination operation time periods Tu-T. The determination time period may include the unit operation time period Tu during which the discharge state determination process is not performed due to a delay in the process or the like (that is, the unit operation time period Tu which is not the unit determination operation time period Tu-T). Although the determination time period is configured of the plurality of unit determination operation time periods Tu-T in principle, the determination time period may be one unit determination operation time period Tu-T. In summary, the determination time period may be any time period during which processes such as the printing process and the maintenance process other than the discharge state determination process are not performed.

The length of the determination time period during which the discharge state determination process is performed may be increased when the discharge state determination process is performed for the multiple numbers of discharging units D as the determination target discharging unit D-J by securing the determination time period configured of the plurality of unit determination operation time periods Tu-T. Accordingly, the discharge state determination process is preferably performed after considering temporal restrictions depending on the status of use of the ink jet printer 1 and setting the determination time period as not impeding the use of the ink jet printer 1 (for example, not impeding the printing process).

The accuracy of determination required in the discharge state determination process may be different depending on the status of use of the ink jet printer 1. For example, it may be necessary to simply determine only presence of an abnormal discharge while it may be necessary to further determine whether there is a failure in the discharging unit D in addition to presence of an abnormal discharge. That is, the discharge state determination process is preferably performed with the accuracy of determination into which the status of use of the ink jet printer 1 is considered.

Thus, the discharge state determination process is required to be performed after appropriately setting the length of the determination time period, the accuracy of determination, and the like depending on the status of use of the ink jet printer 1.

In the present embodiment, therefore, a plurality of determination modes having different determination time periods or different determination accuracy is provided. A determination mode appropriate for the status of use of the ink jet printer 1 is selected, and the discharge state determination process is performed in the selected determination mode.

Specifically, the determining unit 62 according to the present embodiment selects a determination mode from three determination modes of a full nozzle determination mode (an example of a "first determination mode"), a partial nozzle determination mode (an example of a "second determination mode"), and a failed nozzle determination mode (an example of a "third determination mode") depending on the status of use of the ink jet printer 1 and performs the discharge state determination process in the selected determination mode.

The full nozzle determination mode is a determination mode in which the discharge state determination process is performed for all of the discharging units D (M numbers of discharging units D) provided in the ink jet printer 1 as the target of determination during the determination time period.

The partial nozzle determination mode is a determination mode in which the discharge state determination process is performed for a part of the discharging units D among the M numbers of discharging units D provided in the ink jet printer 1 as the target during the determination time period. In the partial nozzle determination mode, the determination time period can be decreased in comparison with the full nozzle determination mode. Thus, when, for example, the printing process is intermittently performed, the discharge state determination process can be performed during a short time period of an interval between the printing processes.

The failed nozzle determination mode is a determination mode in which the discharge state determination process is performed so as to determine whether an abnormal discharge occurs in the discharging unit D and further determine whether a failure occurs in the discharging unit D by determining the state of discharge of ink in the discharging unit D in further detail.

Hereinafter, the discharge state determination process in each of these three determination modes will be described.

5.2. Full Nozzle Determination Mode

Figure 21:
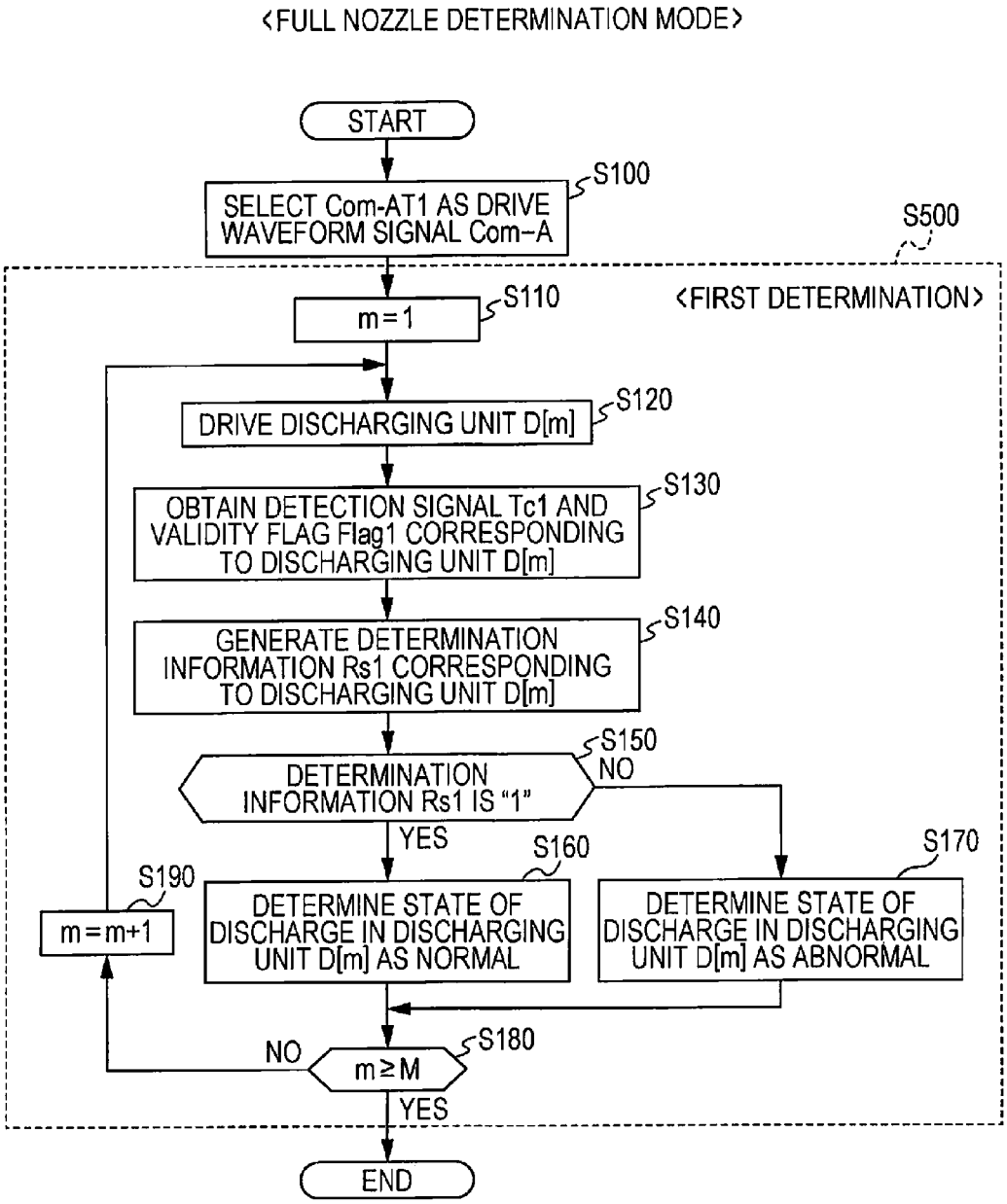
FIG. 21 is a flowchart illustrating a discharge state determination process in a full nozzle determination mode.

FIG. 21 is a flowchart for describing an example of operation of the ink jet printer 1 when the discharge state determination process is performed in the full nozzle determination mode.

The control unit 6, as illustrated in FIG. 21, in the case of performing the discharge state determination process in the full nozzle determination mode, first selects the non-discharge drive waveform signal Com-AT1 as the drive waveform signal Com-A and determines the waveform of the drive waveform signal Com so that the discharge state determination process is performed as the non-discharge inspection (step S100).

Next, the control unit 6 sets the variable m that indicates the stage number of the discharging unit D to "1" (step S110).

Next, the control unit 6 controls the drive unit 51 so as to drive the discharging unit D[m] (step S120). Specifically, the control unit 6 outputs various signals including the drive waveform signal Com and the printing signal SI[m] to the drive unit 51 so that the determination drive waveform signal Com-AT is supplied to the discharging unit D[m], and the drive waveform signal Com-B is supplied to the discharging units D other than the discharging unit D[m]. That is, the control unit 6 employs the discharging unit D[m] as the drive target discharging unit D-R.

Next, the control unit 6 obtains the detection signal Tc and the validity flag Flag that the residual vibration detecting unit 52 generates on the basis of the residual vibration signal Vout which indicates the residual vibration occurring in the discharging unit D[m] (step S130). That is, the control unit 6 employs the discharging unit D[m] as the determination target discharging unit D-J.

Next, the control unit 6 generates determination information Rs that corresponds to the discharging unit D[m] on the basis of the detection signal Tc and the validity flag Flag obtained in step S130 (step S140).

FIG. 22 is a descriptive diagram for describing a process of generating the determination information Rs performed in step S140.

As illustrated in FIG. 22, the control unit 6 compares the length in time indicated by the detection signal Tc with three thresholds (or a part of three thresholds) of a threshold Tth1, a threshold Tth2 that represents a longer length in time than the threshold Tth1, and a threshold Tth3 that represents a further longer length in time than the threshold Tth2.

The threshold Tth1 is a value that indicates a boundary between the length in time of one cycle of the residual vibration when an air bubble occurs in the cavity 320 to increase the frequency of the residual vibration and the length in time of one cycle of the residual vibration when the state of discharge is normal.

The threshold Tth2 is a value that indicates a boundary between the length in time of one cycle of the residual vibration when a foreign object such as paper dust is attached near the outlet of the nozzle N to decrease the frequency of the residual vibration and the length in time of one cycle of the residual vibration when the state of discharge is normal.

The threshold Tth3 is a value that indicates a boundary between the length in time of one cycle of the residual vibration when thickening or solidification of ink near the nozzle N further decreases the frequency of the residual vibration than in the case of attachment of a foreign object such as paper dust and the length in time of one cycle of the residual vibration when a foreign object such as paper dust is attached near the outlet of the nozzle N.

The control unit 6, as illustrated in FIG. 22, determines that the state of discharge of ink in the discharging unit D is normal when the value of the validity flag Flag is "1", and the detection signal Tc satisfies "Tth1≤Tc≤Tth2" and sets the determination information Rs to the value "1" that indicates the state of discharge is normal.

The control unit 6 determines that an abnormal discharge occurs due to an air bubble occurring in the cavity 320 when the value of the validity flag Flag is "1", and the detection signal Tc satisfies "Tc<Tth1" and sets the determination information Rs to the value "2" that indicates an abnormal discharge due to an air bubble occurs.

The control unit 6 determines that an abnormal discharge occurs due to a foreign object such as paper dust attached near the outlet of the nozzle N when the value of the validity flag Flag is "1", and the detection signal Tc satisfies "Tth2<Tc≤Tth3" and sets the determination information Rs to the value "3" that indicates an abnormal discharge due to attachment of a foreign object such as paper dust occurs.

The control unit 6 determines that an abnormal discharge occurs due to thickening of ink in the cavity 320 when the value of the validity flag Flag is "1", and the detection signal Tc satisfies "Tth3<Tc" and sets the determination information Rs to the value "4" that indicates an abnormal discharge due to thickening of ink occurs.

The control unit 6, when the value of the validity flag Flag is "0", sets the determination information Rs to the value "5" that indicates an abnormal discharge occurs due to a cause such that ink is not poured.

As such, the control unit 6 determines the state of discharge in the discharging unit D on the basis of the detection signal Tc and the validity flag Flag and generates the determination information Rs that indicates the determination result.

In the full nozzle determination mode, the detection signal Tc and the validity flag Flag are obtained once from each discharging unit D, and the determination information Rs corresponding to each discharging unit D is generated once by driving each discharging unit D once. However, in the failed nozzle determination mode that is described later, there may be the case where the detection signal Tc and the validity flag Flag are obtained twice from the discharging unit D, and the determination information Rs corresponding to the discharging unit D is generated twice by driving the same discharging unit D twice.

Thus, in the description below, when distinction is necessary for convenience of description, the detection signal Tc and the validity flag Flag that are obtained first will be referred to as a detection signal Tc1 and a validity flag Flag1 while the detection signal Tc and the validity flag Flag that are obtained second will be referred to as a detection signal Tc2 and a validity flag Flag2. In addition, the determination information Rs that is generated first may be referred to as determination information Rs1, and the determination information Rs that is generated second may be referred to as determination information Rs2.

In the full nozzle determination mode illustrated in FIG. 21, the detection signal Tc and the validity flag Flag are obtained once from each discharging unit D, and the determination information Rs corresponding to each discharging unit D is generated once. Accordingly, it can be said that the detection signal Tc1 and the validity flag Flag1 are obtained in step S130, and the determination information Rs1 is generated in step S140.

The control unit 6, as illustrated in FIG. 21, determines whether the value indicated by the determination information Rs is the value "1" that indicates the state of discharge of ink in the discharging unit D[m] is normal (step S150).

The control unit 6 determines that the state of discharge of ink in the discharging unit D[m] is normal when the determination result in step S150 is positive. Then, the control unit 6 associates the determination result with identifiable information of the discharging unit D[m] (for example, the stage number m) and stores the association on the storage unit 60 (step S160).

Meanwhile, the control unit 6 determines that the state of discharge of ink in the discharging unit D[m] is abnormal (an abnormal discharge occurs in the discharging unit D[m]) when the determination result in step S150 is negative. Then, the control unit 6 associates the detection signal Tc1, the validity flag Flag1, and the determination information Rs1 relevant to the discharging unit D[m] with the identifiable information of the discharging unit D[m] and stores the association on the storage unit 60 (step S170).

Next, the control unit 6 determines whether the state of discharge of ink is determined, and the determination information Rs is generated for all of the M numbers of discharging units D provided in the ink jet printer 1 (step S180). Specifically, the control unit 6 determines whether the stage number m is greater than or equal to "M".

The control unit 6 ends the discharge state determination process illustrated in FIG. 21 when the determination result in step S180 is positive.

Meanwhile, the control unit 6 adds "1" to the variable m (step S190) and causes the process to proceed to step S120 when the determination result in step S180 is negative. Accordingly, the processes of steps S120 to S170 are performed until the state of discharge is determined for all of the (M numbers of) discharging units D provided in the ink jet printer 1.

In the full nozzle determination mode, as such, the state of discharge is determined, and the determination information Rs is generated for all of the M numbers of discharging units D provided in the ink jet printer 1. Thus, it is possible to find an abnormal discharge when an abnormal discharge occurs in any of the M numbers of discharging units D. Accordingly, it is possible to prevent a decrease in printing quality due to an abnormal discharge.

The determination time period during which the discharge state determination process is performed in the full nozzle determination mode illustrated in FIG. 21 is a time period from the unit determination operation time period Tu-T during which the initial discharging unit D among the M numbers of discharging units D (the discharging unit D[1] in the example of FIG. 21) is driven to the unit determination operation time period Tu-T during which the last discharging unit D among the M numbers of discharging units D (the discharging unit D[M] in the example of FIG. 21) is driven in step S120.

Although the state of discharge is determined by driving the M numbers of discharging units D in order of the first stage→the second stage→ . . . →the M-th stage in the example illustrated in FIG. 21, this is merely for illustrative purposes only. Driving and determining the state of discharge for the M numbers of discharging units D may be performed in any order. In summary, the state of discharge may be desirably determined for all of the M numbers of discharging units D without omission.

5.3. Partial Nozzle Determination Mode

Figure 23:
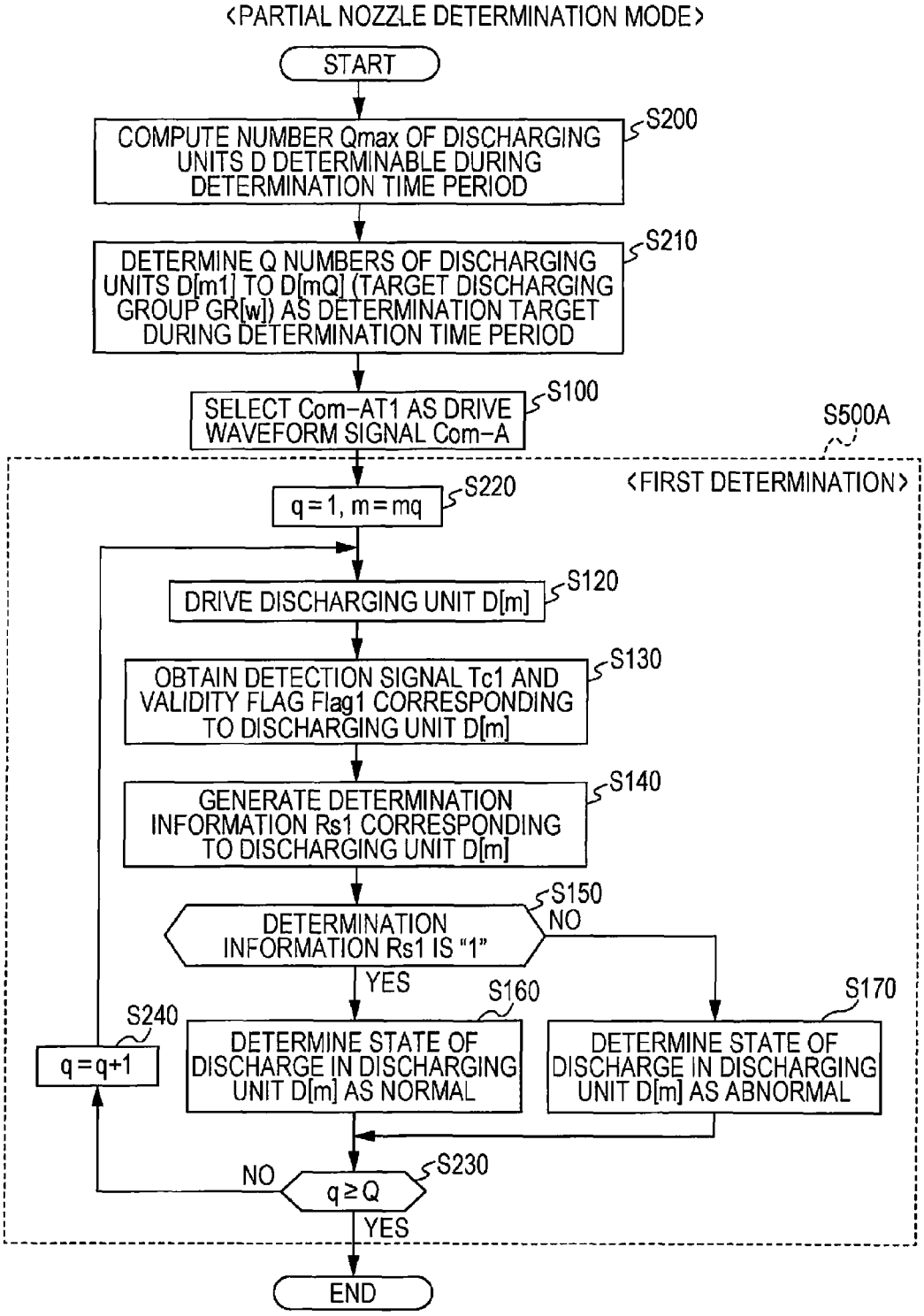
FIG. 23 is a flowchart illustrating the discharge state determination process in a partial nozzle determination mode.

FIG. 23 is a flowchart for describing an example of operation of the ink jet printer 1 when the discharge state determination process is performed in the partial nozzle determination mode.

The discharge state determination process performed in the partial nozzle determination mode illustrated in FIG. 23 is the same as the discharge state determination process performed in the full nozzle determination mode illustrated in FIG. 21 except that the processes of steps S200 and S210 are performed, the process of step S220 is performed instead of step S110, the process of step S230 is performed instead of step S180, and the process of step S240 is performed instead of step S190.

In FIG. 23, steps in which the control unit 6 performs the same processes as the processes according to the full nozzle determination mode illustrated in FIG. 21 are given the same reference signs as in FIG. 21.

The control unit 6, as illustrated in FIG. 23, in the case of performing the discharge state determination process in the partial nozzle determination mode, computes the length of the determination time period that is securable for performing the discharge state determination process and computes a maximum number Qmax (an example of a "determinable number") of discharging units D that can be targeted for determination of the state of discharge during the determination time period by considering, for example, the status of use of the ink jet printer 1 (step S200). The number Qmax is a natural number satisfying $1 \leq Qmax < M$. The assumption "Qmax=M" may be made when the determination time period having a sufficient length can be secured. However, in this case, the discharge state determination process is performed in the full nozzle determination mode, not the partial nozzle determination mode.

Next, the control unit 6 determines Q numbers of determination target discharging units D-J that are the target of the discharge state determination process in the partial nozzle determination mode (step S210). The number Q is a natural number satisfying $1 \leq Q \leq Qmax$.

In the description below, the Q numbers of determination target discharging units D-J that are the target of discharge in the partial nozzle determination mode may be referred to as a target discharging group GR. In addition, in the description below, the Q numbers of determination target discharging units D-J included in the target discharging group GR will be represented as discharging units D[m1], D[m2], . . . , D[mq], . . . , D[mQ] (where a variable q is a natural number satisfying $1 \leq q \leq Q$).

A computation method for the determination time period and a determination method for the target discharging group GR will be described later.

The control unit 6, as illustrated in FIG. 23, selects the non-discharge drive waveform signal Com-AT1 as the drive waveform signal Com-A (step S100). Then, the control unit 6 sets the variable m indicating the stage number of the discharging unit D to "m1" that is the stage number of the discharging unit D for which the state of discharge is initially determined among the Q numbers of determination target discharging units D-J included in the target discharging group GR (step S220) and performs the processes of steps S120 to S170 described in FIG. 21. Then, the control unit 6 determines whether the state of discharge is completely determined for all of the Q numbers of discharging units D included in the target discharging group GR (step S230) when the processes of steps S120 to S170 are performed. Specifically, the control unit 6 determines whether the variable q is greater than or equal to "Q".

The control unit 6 ends the discharge state determination process illustrated in FIG. 23 when the determination result in step S230 is positive. Meanwhile, the control unit 6 adds "1" to the variable q, sets the variable m to "mq" (step S240), and causes the process to proceed to step S120 when the determination result in step S230 is negative. Accordingly, the processes of steps S120 to S170 are performed until a determination of the state of discharge ends for all of the Q numbers of discharging units D that are to be the target of the discharge state determination process during the determination time period.

In the partial nozzle determination mode, as such, the state of discharge is determined, and the determination information Rs is generated for a part of the M numbers of discharging units D provided in the ink jet printer 1. Thus, the discharge state determination process can be performed during a short time period such as an interval between the printing processes.

5.4. Failed Nozzle Determination Mode

Next, the failed nozzle determination mode and failure of the discharging unit D that is detected through the discharge state determination process in the failed nozzle determination mode will be described.

Figure 24A:
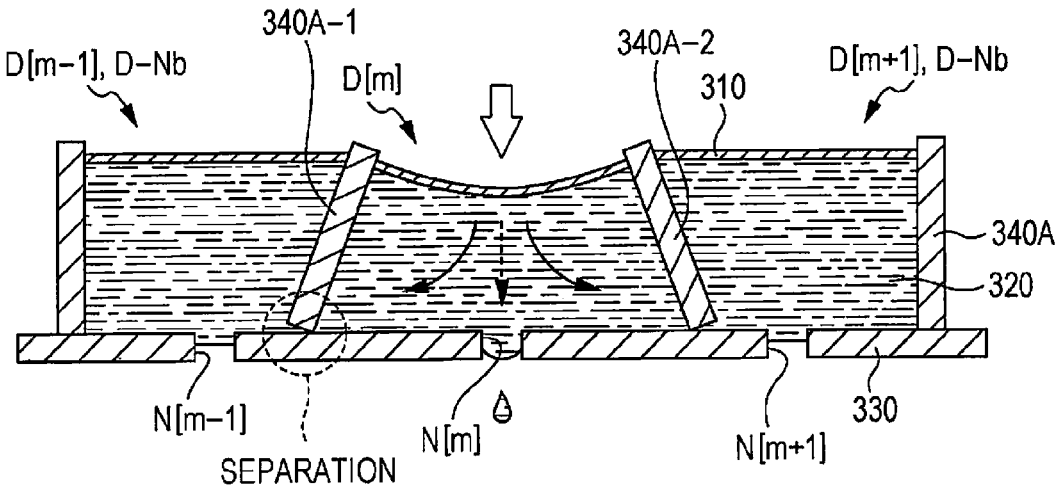
FIGS. 24A and 24B are descriptive diagrams for describing the discharge state determination process in a failed nozzle determination mode.
Figure 24B:
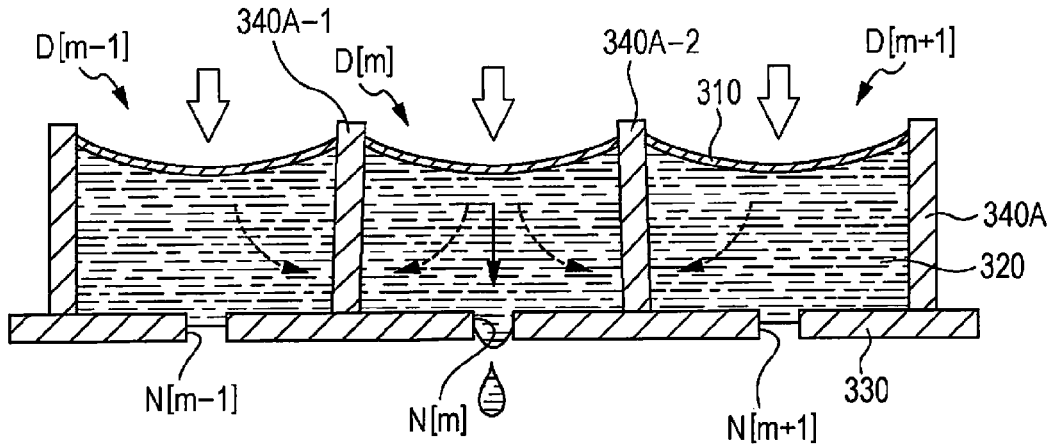

FIGS. 24A and 24B are descriptive diagrams for describing failure of the discharging unit D.

As described above, the plurality of cavities 320 is disposed in correspondence with the plurality of discharging units D, and the plurality of cavities 320 is divided by the cavity plate 340 (refer to FIG. 3 and FIG. 4) in the recording head 30. Hereinafter, the part of the cavity plate 340 that divides the cavity 320 will be referred to as a partition 340A.

As illustrated in FIG. 24A, the partition 340A may be separated from the nozzle plate 330 (hereinafter, simply referred to as "separation of the partition 340A") due to temporal degradation and the like in the discharging unit D. The discharge state determination process in the failed nozzle determination mode detects failure of the discharging unit D due to separation of the partition 340A.

FIGS. 24A and 24B illustrate the case where the cavity 320 of the discharging unit D[m] and the cavity 320 of the discharging unit D[m−1] are divided by a partition 340A-1, the cavity 320 of the discharging unit D[m] and the cavity 320 of the discharging unit D[m+1] are divided by a partition 340A-2, and the partition 340A-1 and the partition 340A-2 are separated.

In the description below, when the cavity 320 of one discharging unit D neighbors the cavity 320 of another discharging unit D through the partition 340A, the other discharging unit D will be referred to as a neighboring discharging unit D-Nb of the one discharging unit D. FIGS. 24A and 24B illustrate the case where the discharging unit D[m−1] and the discharging unit D[m+1] are the neighboring discharging units D-Nb of the discharging unit D[m].

If, as illustrated in FIG. 24A, pressure is applied to the inside of the cavity 320 of the discharging unit D[m] by bending the vibrating plate 310 with the drive signal Vin to cause the cavity 320 to contract, the pressure escapes to the cavity 320 of the neighboring discharging unit D-Nb through the partition 340A when the partition 340A (340A-1 and 340A-2) of the discharging unit D[m] is separated. In this case, it is considered that the compliance Cm in the residual vibration calculation model illustrated in FIG. 6 is increased.

Thus, when the partition 340A of the discharging unit D[m] is separated, the amplitude of the residual vibration occurring in the discharging unit D[m] is decreased, and the frequency of the residual vibration occurring in the discharging unit D[m] is decreased in comparison with the case where the state of discharge in the discharging unit D[m] is normal. Therefore, the residual vibration occurring in the discharging unit D[m] when the partition 340A of the discharging unit D[m] is separated has a waveform close to the residual vibration when a foreign object such as paper dust is attached near the nozzle N of the discharging unit D[m], the residual vibration when the ink in the cavity 320 of the discharging unit D[m] is thickened, or the residual vibration when ink is not poured into the cavity 320 of the discharging unit D[m]. In other words, if the discharge state determination process is performed for the discharging unit D[m] as both of the drive target discharging unit D-R and the determination target discharging unit D-J, the determination information Rs obtained from the discharging unit D[m] may probably indicate one of the values of "3", "4", and "5" when the partition 340A of the discharging unit D[m] is separated.

An abnormal discharge is not resolved even through the maintenance process when the discharging unit D fails. Thus, when the discharging unit D fails, a measure for minimizing influences due to failure of the discharging unit D, such as replacing the recording head 30 that includes the failed discharging unit D or performing a complementation process of discharging ink from the discharging unit D that is different from the failed discharging unit D instead of discharging ink from the failed discharging unit D, is required to suppress degradation of quality of the image formed through the printing process. Therefore, when an abnormal discharge occurs in the discharging unit D, it is important to distinguish whether the abnormal discharge is due to thickening and the like of ink from which the state of discharge is recoverable through the maintenance process or whether the abnormal discharge is due to a failure of the discharging unit D from which the state of discharge is unrecoverable through the maintenance process.

Pressure is applied to the inside of the cavity 320 of the discharging unit D[m] and is also applied to the inside of the cavity 320 of the neighboring discharging units D-Nb as illustrated in FIG. 24B when the discharging unit D[m] and the neighboring discharging units D-Nb of the discharging unit D[m] (the discharging units D[m−1] and D[m+1] in the example illustrated in FIG. 24B) are driven simultaneously. Accordingly, in this case, even if the partition 340A of the discharging unit D[m] is separated, it is possible to suppress escape of the pressure applied to the inside of the cavity 320 of the discharging unit D[m] to the neighboring discharging units D-Nb through the partition 340A to a smaller extent. In this case, for example, the discharging unit D[m] behaves as if the state of discharge is normal.

As such, the residual vibration occurring in the discharging unit D[m] when the discharging unit D[m] is driven alone and the residual vibration occurring in the discharging unit D[m] when the discharging unit D[m] and the neighboring discharging units D-Nb are simultaneously driven may probably have a different waveform when a failure (separation of the partition 340A) occurs in the discharging unit D[m]. In other words, it is possible to distinguish whether an abnormal discharge occurring in the discharging unit D[m] is due to thickening and the like of ink from which the state of discharge is recoverable through the maintenance process or due to failure of the discharging unit D from which the state of discharge is unrecoverable through the maintenance process by comparing the detection signal Tc1, the validity flag Flag1, and the determination information Rs1 obtained by driving the discharging unit D[m] alone with the detection signal Tc2, the validity flag Flag2, and the determination information Rs2 obtained by simultaneously driving the discharging unit D[m] and the neighboring discharging units D-Nb of the discharging unit D[m].

On the basis of the above theory, in the discharge state determination process in the failed nozzle determination mode according to the present embodiment, when it is determined that the state of discharge in the discharging unit D[m] is abnormal by driving the discharging unit D[m] alone, a determination of whether a failure occurs in the discharging unit D[m] is performed by simultaneously driving the discharging unit D[m] and the neighboring discharging units D-Nb.

A determination of the state of discharge in the discharging unit D[m] by driving the discharging unit D[m] alone will be referred to as a "first determination" (corresponds to step S500 in FIG. 21 and step S500A in FIG. 23), and a determination of whether a failure occurs in the discharging unit D[m] by simultaneously driving the discharging unit D[m] and the neighboring discharging units D-Nb will be referred to as a "second determination". In addition, the discharging unit D that is determined as having an abnormal state of discharge in the first determination may be referred to as an abnormal discharging unit D-B.

Hereinafter, the discharge state determination process in the failed nozzle determination mode will be described.

Figure 25:
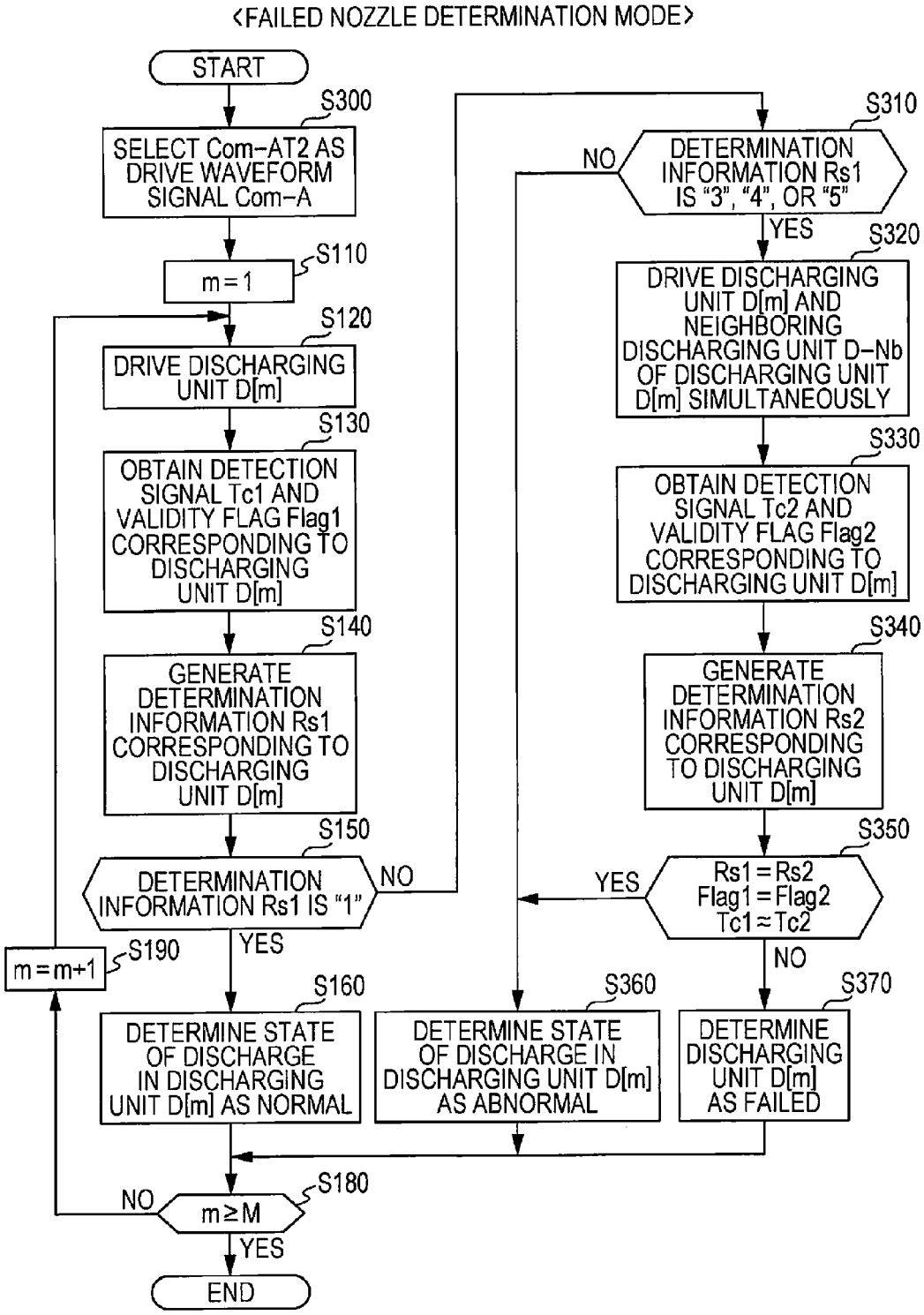
FIG. 25 is a flowchart illustrating the discharge state determination process in the failed nozzle determination mode.

FIG. 25 is a flowchart for describing an example of operation of the ink jet printer 1 when the discharge state determination process is performed in the failed nozzle determination mode.

In FIG. 25, steps in which the control unit 6 performs the same processes as the processes according to the full nozzle determination mode illustrated in FIG. 21 are given the same reference signs as in FIG. 21.

The control unit 6, as illustrated in FIG. 25, in the case of performing the discharge state determination process in the failed nozzle determination mode, first selects the discharge drive waveform signal Com-AT2 as the drive waveform signal Com-A and determines the waveform of the drive waveform signal Com so that the discharge state determination process is performed as the discharge inspection (step S300). The reason why the discharge state determination process in the failed nozzle determination mode is performed as the discharge inspection is that the failed nozzle determination mode has a purpose of detecting a failure in the discharging unit D in addition to detecting an abnormal discharging in the discharging unit D, and thus it is preferable to detect the state of discharge of ink in the discharging unit D more accurately in comparison with the other determination modes.

The control unit 6, as illustrated in FIG. 25, sets the variable m indicating the stage number of the discharging unit D to "1" (step S110), employs the discharging unit D[m] as the drive target discharging unit D-R and drives the discharging unit D[m] alone (step S120), employs the discharging unit DM as the determination target discharging unit D-J and obtains the detection signal Tc1 and the validity flag Flag1 corresponding to the discharging unit D[m] (step S130), generates the determination information Rs1 corresponding to the discharging unit D[m] (step S140), and determines whether the value indicated by the determination information Rs1 is "1" (step S150) in the same manner as in the full nozzle determination mode (refer to FIG. 21).

Then, the control unit 6 determines that the state of discharge of ink in the discharging unit D[m] is normal when the determination result in step S150 is positive and stores the determination result on the storage unit 60 (step S160) and determines whether the state of discharge is completely determined for all of the M numbers of discharging units D (step S180).

Then, the control unit 6 ends the discharge state determination process illustrated in FIG. 25 when the determination result in step S180 is positive. The control unit 6 adds "1" to the variable m (step S190) and causes the process to proceed to step S120 when the determination result in step S180 is negative.

The control unit 6, as illustrated in FIG. 25, determines whether the value indicated by the determination information Rs1 corresponds to any one of "3", "4", and "5" when the determination result in step S150 is negative, that is, when the discharging unit D[m] corresponds to the abnormal discharging unit D-B (step S310).

The control unit 6 employs the discharging unit D[m] and the neighboring discharging units D-Nb of the discharging unit D[m] as the drive target discharging unit D-R and simultaneously drives the employed drive target discharging units D-R when the determination result in step S310 is positive (step S320). Specifically, the control unit 6 outputs various signals including the drive waveform signal Com and the printing signal SI[m] to the drive unit 51 so that the determination drive waveform signal Com-AT is supplied to the discharging unit D[m] and the neighboring discharging units D-Nb, and the drive waveform signal Com-B is supplied to the discharging units D other than the discharging unit D[m] and the neighboring discharging units D-Nb. The neighboring discharging units D-Nb of the discharging unit D[m] may be all of the discharging units D that neighbor the discharging unit D[m] through the partition 340A or may be a part of the discharging units D that neighbor the discharging unit D[m] through the partition 340A.

Next, the control unit 6 employs the discharging unit D[m] as the determination target discharging unit D-J and obtains the detection signal Tc2 and the validity flag Flag2 corresponding to the discharging unit D[m] (step S330).

Then, the control unit 6 generates the determination information Rs2 corresponding to the discharging unit D[m] on the basis of the detection signal Tc2 and the validity flag Flag2 obtained in step S330 (step S340).

Afterward, the control unit 6 determines whether the determination information Rs1 and the determination information Rs2 indicate the same value, whether the validity flag Flag1 and the validity flag Flag2 indicate the same value, and whether the detection signal Tc1 and the detection signal Tc2 indicate approximately the same value (step S350).

In the present specification, the expression "approximately the same" includes the case that is regarded as the same when considering various errors due to manufacturing error, noise, and the like in addition to the case of complete sameness. That is, the control unit 6 may determine that the detection signal Tc1 and the detection signal Tc2 indicate approximately the same value in step S350 when the difference between the value indicated by the detection signal Tc1 and the value indicated by the detection signal Tc2 is less than or equal to a predetermined allowable value.

The control unit 6 according to the present embodiment performs a first comparison of comparing the determination information Rs1 and the determination information Rs2, a second comparison of comparing the detection signal Tc1 and the detection signal Tc2, and a third comparison of comparing the validity flag Flag1 and the validity flag Flag2 in step S350. However, the control unit 6 may perform at least one of the first to the third comparisons. In summary, the control unit 6 may be desirably capable of determining whether the residual vibration occurring in the discharging unit D[m] in step S120 and the residual vibration occurring in the discharging unit D[m] in step S320 have approximately the same waveform in step S350. In order to increase accuracy of determination, it is preferable to perform all of the first to the third comparisons.

In addition, the control unit 6 according to the present embodiment performs the process of step S340 in the failed nozzle determination mode. However, the control unit 6 may not perform the process of step S340 when not performing the first comparison in step S350.

The control unit 6, as illustrated in FIG. 25, determines that the state of discharge of ink in the discharging unit D[m] is abnormal when the determination result in step S350 is positive or when the determination result in step S310 is negative (that is, when the value indicated by the determination information Rs1 is "2"). Then, the control unit 6 associates the determination information Rs relevant to the discharging unit D[m] with the identifiable information of the discharging unit D[m] and stores the association on the storage unit 60 (step S360) and causes the process to proceed to step S180.

Meanwhile, the control unit 6 determines that a failure occurs in the discharging unit D[m] when the determination result in step S350 is negative, that is, when the residual vibration occurring in the discharging unit D[m] in step S120 and the residual vibration occurring in the discharging unit D[m] in step S320 do not have approximately the same waveform. Then, the control unit 6 associates the determination result with the identifiable information of the discharging unit D[m] and stores the association on the storage unit 60 (step S370) and causes the process to proceed to step S180.

As such, in the discharge state determination process in the failed nozzle determination mode, it is possible to detect an abnormal discharge by determining the state of discharge of ink and also detect a failure for each of the M numbers of discharging units D provided in the ink jet printer 1. Accordingly, it is possible to prevent a decrease in printing quality due to an abnormal discharge, and it is possible to take a necessary measure early when a failure occurs in the discharging unit D.

In FIG. 25, for example, the processes of steps S110 to S160 are relevant to the first determination, and the processes of steps S320 to S370 are relevant to the second determination.

The first determination and the second determination are performed for each one discharging unit D in the discharge state determination process in the failed nozzle determination mode illustrated in FIG. 25. However, the invention is not limited to such an aspect. The first determination may be performed for all of the discharging units D provided in the ink jet printer 1, and the second determination may be subsequently performed for the abnormal discharging unit D-B in which an abnormal discharge is detected in the first determination (hereinafter, referred to as "another aspect").

Figure 26:
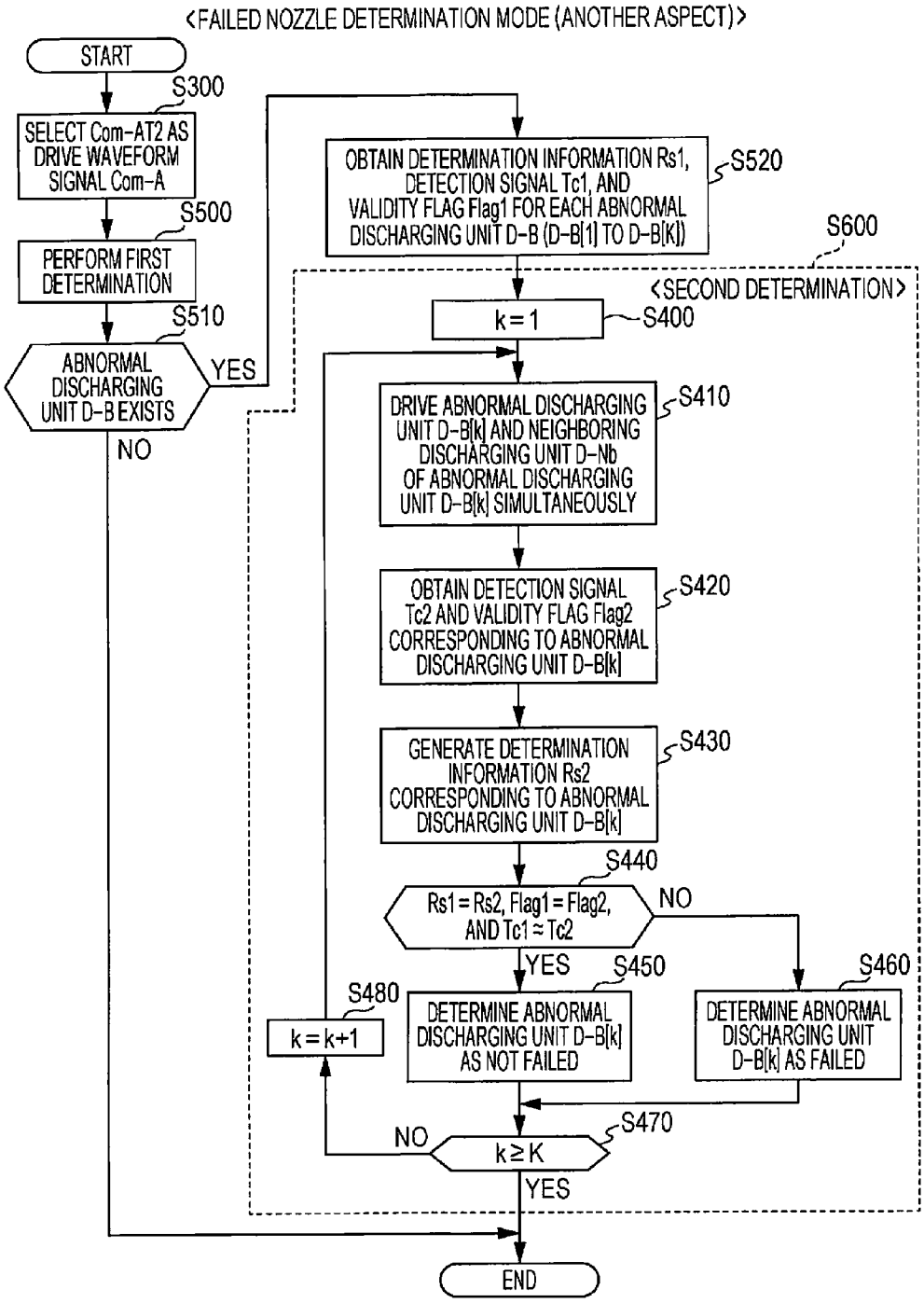
FIG. 26 is a flowchart illustrating the discharge state determination process in the failed nozzle determination mode.

FIG. 26 illustrates an example of operation of the ink jet printer 1 in the discharge state determination process performed in the failed nozzle determination mode according to another aspect.

As illustrated in FIG. 26, the control unit 6, in the case of performing the discharge state determination process in the failed nozzle determination mode according to another aspect, selects the discharge drive waveform signal Com-A as the drive waveform signal Com-AT2 (step S300) and performs the first determination in step S500 for the M numbers of discharging units D (refer to FIG. 21).

Then, the control unit 6 determines whether the discharging unit D that is recognized as the abnormal discharging unit D-B in the first determination exists (step S510).

The control unit 6 ends the discharge state determination process illustrated in FIG. 26 when the determination result in step S510 is negative. Meanwhile, the control unit 6 accesses the storage unit 60 and obtains the detection signal Tc1, the validity flag Flag1, and the determination information Rs1 that correspond to each discharging unit D recognized as the abnormal discharging unit D-B in the first determination in step S500 (step S520) when the determination result in step S510 is positive.

In the description below, the number of discharging units D recognized as the abnormal discharging unit D-B in the first determination will be denoted by K, and each abnormal discharging unit D-B will be represented as an abnormal discharging unit D-B[k] (where K is a natural number satisfying $1 \leq K \leq M$, and k is a natural number satisfying $1 \leq k \leq K$) so as to distinguish K numbers of abnormal discharging units D-B.

Next, the control unit 6 performs the second determination for the K numbers of abnormal discharging units D-B[1] to D-B[K] as illustrated in FIG. 26 (step S600).

The process of step S600 relevant to the second determination is configured of later-described processes of steps S400 to S480. Specifically, in the second determination, the control unit 6 first sets a variable k that specifies the abnormal discharging unit D-B[k] to "1" (step S400). Next, the control unit 6 employs the abnormal discharging unit D-B[k] and the neighboring discharging units D-Nb of the abnormal discharging unit D-B[k] as the drive target discharging unit D-R and simultaneously drives the employed drive target discharging units D-R (step S410). Next, the control unit 6 employs the abnormal discharging unit D-B[k] as the determination target discharging unit D-J and obtains the detection signal Tc2 and the validity flag Flag2 corresponding to the abnormal discharging unit D-B[k] (step S420). Next, the control unit 6 generates the determination information Rs2 on the basis of the detection signal Tc2 and the validity flag Flag2 obtained in step S420 (step S430).

Then, the control unit 6, in the same manner as above step S350, performs the first to the third comparisons (or at least one of these comparisons) and determines whether the residual vibration occurring in the abnormal discharging unit D-B[k] in the first determination and the residual vibration occurring in the abnormal discharging unit D-B[k] in the second determination are approximately the same (step S440).

The control unit 6 determines that the abnormal discharging unit D-B[k] does not fail although an abnormal discharge occurs in the abnormal discharging unit D-B[k] when the determination result in step S440 is positive. Then, the control unit 6 associates the determination result with the identifiable information of the abnormal discharging unit D-B[k] and stores the association on the storage unit 60 (step S450) and determines whether the second determination is completed for all of the K numbers of abnormal discharging units D-B[k] (step S470).

Meanwhile, the control unit 6 determines that a failure occurs in the abnormal discharging unit D-B[k] when the determination result in step S440 is negative. Then, the control unit 6 associates the determination result with the identifiable information of the abnormal discharging unit D-B[k] and stores the association on the storage unit 60 (step S460) and causes the process to proceed to step S470.

Then, the control unit 6 ends the discharge state determination process illustrated in FIG. 26 when the determination result in step S470 is positive. Meanwhile, the control unit 6 adds "1" to the variable k when the determination result in step S470 is negative (step S480) and causes the process to proceed to step S410.

5.5. Determination of Determination Mode Depending on Status of Use of Ink Jet Printer The control unit 6 selects one of the three determination modes described above depending on the status of use of the ink jet printer 1.

Hereinafter, selection of the determination mode by the control unit 6 depending on the status of use of the ink jet printer 1 will be described with reference to FIG. 27 to FIG. 29 while illustrating a series of flows from booting of the ink jet printer 1 until complete performance of a series of printing processes (print job) on the recording paper P by the ink jet printer 1 based on the print data Img and the copy number information CP supplied from the host computer 9.

Figure 27:
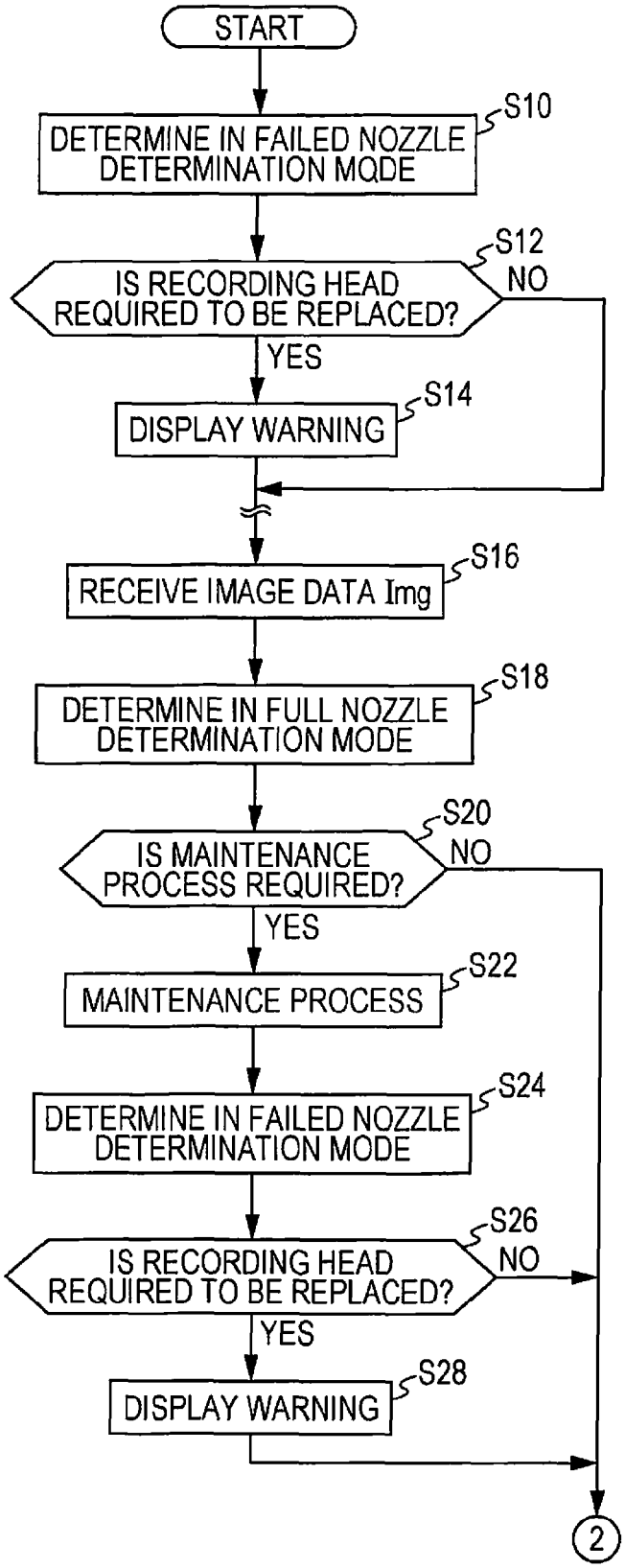
FIG. 27 is a flowchart illustrating operation of the ink jet printer.
Figure 28:
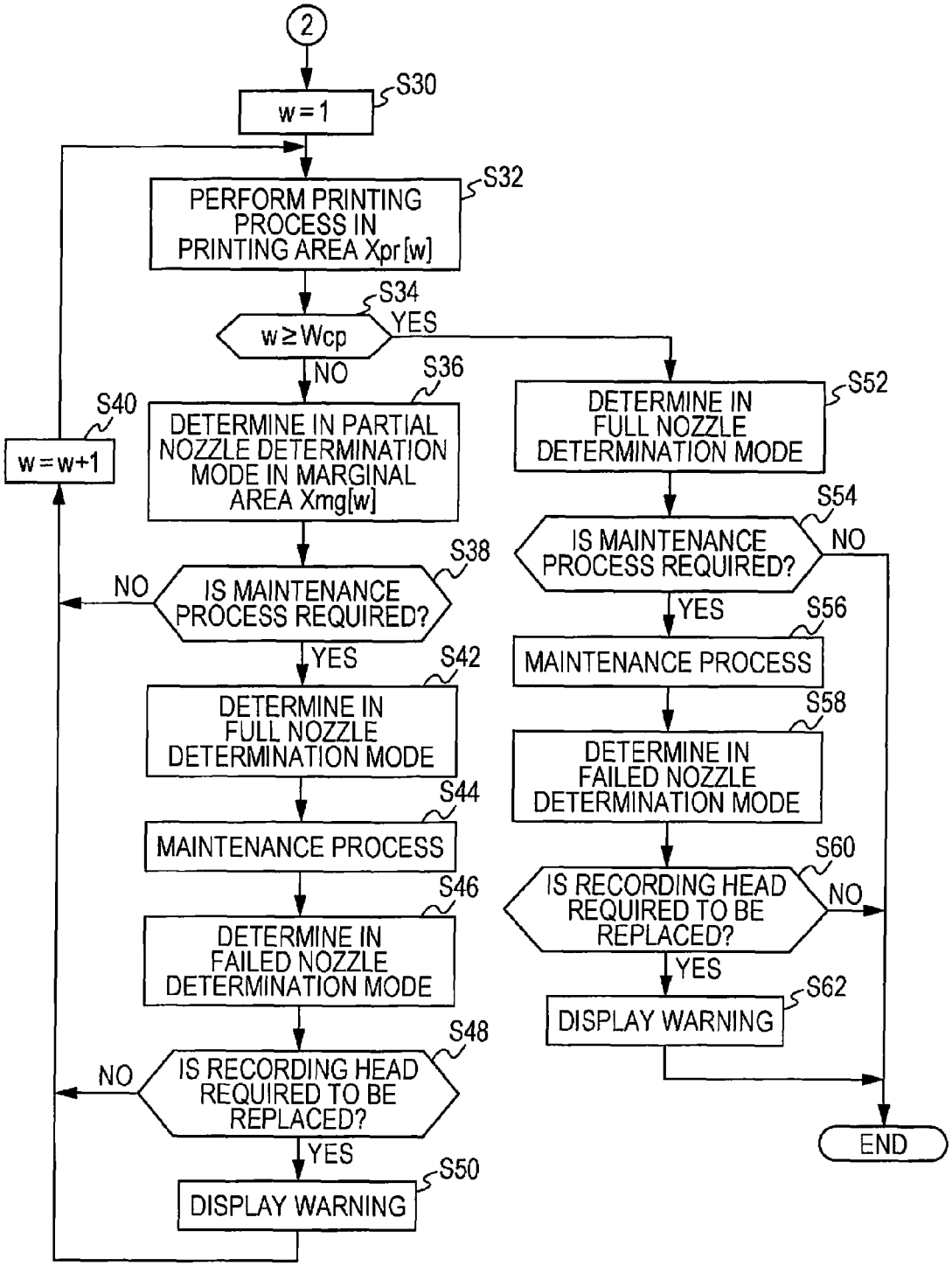
FIG. 28 is a flowchart illustrating operation of the ink jet printer.

FIG. 27 and FIG. 28 are flowcharts for describing an example of operation of the ink jet printer 1 from booting of the ink jet printer 1 until completion of a print job on the recording paper P. The processes illustrated in the flowcharts are initiated when the ink jet printer 1 is booted after the power of the ink jet printer 1 is ON.

The control unit 6, as illustrated in FIG. 27, performs the discharge state determination process in the failed nozzle determination mode when the power of the ink jet printer 1 is ON, and the ink jet printer 1 is booted (step S10). In the present embodiment, the discharge state determination process is performed in the failed nozzle determination mode at the time of booting of the ink jet printer 1. Thus, it is possible to promptly find an abnormal discharge or a failure after the ink jet printer 1 is booted even if an abnormal discharge or a failure occurs in the discharging unit D during the time period when the power of the ink jet printer 1 is OFF, and it is possible to prevent degradation of printing quality in advance.

Next, the control unit 6, as illustrated in FIG. 27, determines whether the recording head 30 is to be replaced on the basis of the determination result of the discharge state determination process performed in step S10 (step S12).

The determination of whether the recording head 30 is to be replaced may be performed in view of preventing degradation of quality of the image formed through the printing process. For example, it may be determined that the recording head 30 is to be replaced when it is determined that a predetermined number or more of discharging units D fail or when it is determined that a predetermined proportion or more of discharging units D fail among the M numbers of discharging units D through the discharge state determination process performed in the failed nozzle determination mode.

The control unit 6 waits until an instruction to perform the printing process or the like is sent from the host computer 9 or the like when the determination result in step S12 is negative. Meanwhile, the control unit 6 causes the display unit 81 to display a warning message indicating that a failure occurs in the recording head 30 (or the recording head 30 is to be replaced) when the determination result in step S12 is positive (step S14). Then, the control unit 6 waits until an instruction to perform the printing process or the like is sent from the host computer 9 or the like.

The control unit 6, as illustrated in FIG. 27, initiates the print job when receiving the print data Img and the copy number information CP that the host computer 9 supplies (step S16).

The control unit 6 performs the discharge state determination process in the full nozzle determination mode during a printing preparation time period that is a time period after initiation of the print job (after reception of the print data Img and the like) and before initiation of the printing process of forming an image in each printing area (step S18). In the present embodiment, the discharge state determination process is performed in the full nozzle determination mode during the printing preparation time period. Thus, it is possible to prevent degradation of image quality due to an abnormal discharge in the discharging unit D during the printing process performed after the printing preparation time period.

Next, the control unit 6, as illustrated in FIG. 27, determines whether the maintenance process is required on the basis of the determination result of the discharge state determination process performed in step S18 (step S20). The determination of whether the maintenance process is required may be performed in view of preventing degradation of image quality of the image formed through the printing process. For example, it may be determined that the maintenance process is required when it is determined that a predetermined number or more of discharging units D are the abnormal discharging unit D-B or when it is determined that a predetermined proportion or more of discharging units D are the abnormal discharging unit D-B among the M numbers of discharging units D through the discharge state determination process.

The control unit 6 performs the maintenance process when the determination result in step S20 is positive (step S22). Accordingly, it is possible to prevent degradation of image quality due to an abnormal discharge in the discharging unit D during the printing process performed after the printing preparation time period.

The control unit 6 performs the discharge state determination process in the failed nozzle determination mode after performing the maintenance process in step S22 (step S24). Accordingly, even if a failure occurs in the discharging unit D during the maintenance process, it is possible to promptly find the failure, and it is possible to prevent degradation of printing quality in advance.

Next, the control unit 6 determines whether the recording head 30 is to be replaced on the basis of the result of the discharge state determination process performed in step S24 (step S26).

The control unit 6 causes the display unit 81 to display a warning message indicating that a failure occurs in the recording head 30 when the determination result in step S26 is positive (step S28) and then causes the process to proceed to step S30.

The control unit 6 causes the process to proceed to step S30 when the determination result in step S20 or S26 is negative.

The processes of steps S30, S32, S34, and S40 illustrated in FIG. 28 represent a series of printing processes on the assumption that the printed copy number Wcp is more than one. The control unit 6, when the printed copy number Wcp is more than one, performs a series of printing processes of setting Wcp numbers of printing areas corresponding to the printed copy number Wcp on the recording paper P and then forming the image represented by the print data Img in each of the Wcp numbers of printing areas in the print job.

Figure 29:
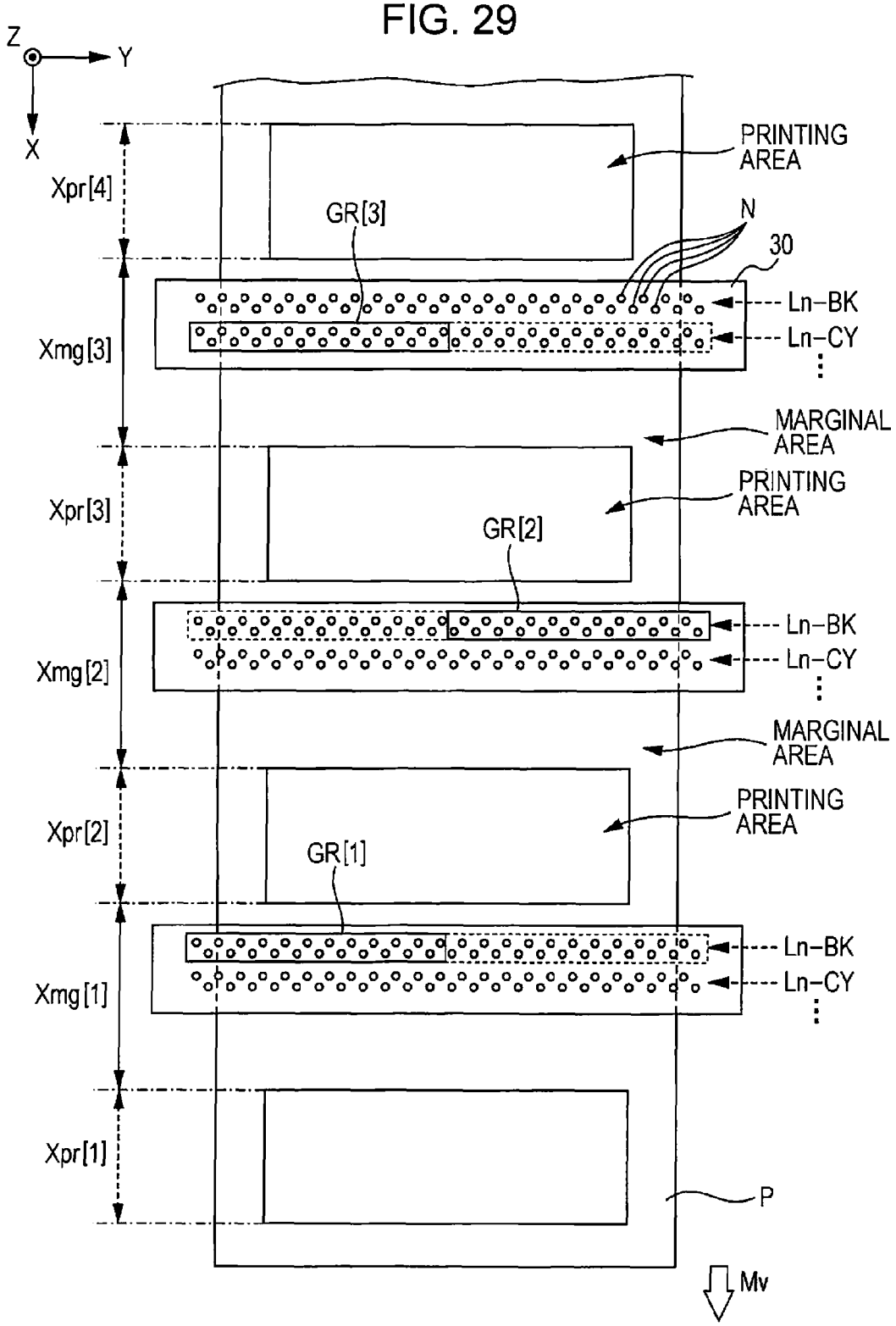
FIG. 29 is a descriptive diagram for describing a print job.

FIG. 29 is a descriptive diagram for describing the print job when the printed copy number Wcp is more than one. As illustrated in FIG. 29, when the printed copy number Wcp is more than one, the control unit 6 forms the image represented by the print data Img in each of the Wcp numbers of printing areas and meanwhile, does not form the image in the marginal area that divides the Wcp numbers of printing areas.

As illustrated in FIG. 29, the range of the w-th printing area among the Wcp numbers of printing areas in the X-axis direction will be referred to as a printing range Xpr[w], and the range of the marginal area that divides the printing ranges Xpr[w] and Xpr[w+1] in the X-axis direction will be referred to as a marginal range Xmg[w] (where a variable w is a natural number satisfying $1 \leq w \leq 5$ Wcp).

The ink jet printer 1 performs the printing process during the time period when at least a part of the recording head 30 is included in the printing range Xpr[w] in a plane view, and the ink discharged from the discharging unit D can hit the printing area of the recording paper P (referred to as a "printing area passing time period"). The ink jet printer 1 does not perform the printing process during the time period when the entire recording head 30 is included in the marginal range Xmg[w] in a plane view, and the ink discharged from the discharging unit D hits the marginal area of the recording paper P (referred to as a "marginal area passing time period").

Thus, in the present embodiment, the discharge state determination process is performed in the partial nozzle determination mode during the marginal area passing time period.

Typically, in a line printer, the transport speed Mv is high, and the marginal area passing time period is short in comparison with the time period that is necessary for performing the discharge state determination process for all of the M numbers discharging units D provided in the ink jet printer 1. Thus, if the ink jet printer 1 does not have the partial nozzle determination mode, the discharge state determination process is performed after the end of the print job. In this case, however, if an abnormal discharge occurs in the discharging unit D during performance of the print job, the abnormal discharge is detected after the end of the print job. Thus, printing quality may be degraded during performance of the print job.

Regarding this point, in the present embodiment, the discharge state determination process is performed in the partial nozzle determination mode during performance of the print job (during an interval between printing processes) by setting the determination time period within the marginal area passing time period. Thus, it is possible to detect an abnormal discharge during performance of the print job, and it is possible to prevent degradation (change) of printing quality during performance of the print job.

The length of the determination time period is appropriately determined on the basis of the length of the marginal area passing time period that is determined by the length of the marginal range Xmg[w] and the transport speed My when the discharge state determination process is performed in the partial nozzle determination mode during performance of the print job as illustrated in FIG. 28 and FIG. 29. The maximum number Qmax of the discharging units D determinable during the determination time period can be computed as the number of unit operation time periods Tu included in the determination time period (refer to step S200 in FIG. 23).

The control unit 6, as illustrated in FIG. 28, first sets the variable w to "1" in a series of printing processes of the print job (step S30). Next, the control unit 6 performs the printing process on the printing area in the printing range Xpr[w] (step S32). Afterward, the control unit 6 determines whether all of the printed copy number Wcp of printing processes that are to be performed in the print job are completed (step S34). Specifically, the control unit 6 determines whether the variable w is greater than or equal to "Wcp".

Then, the control unit 6 sets the determination time period within the marginal area passing time period during which the recording head 30 passes through the marginal range Xmg[w] when the determination result in step S34 is negative, that is, when the printed copy number Wcp of printing processes are not completed. The control unit 6 performs the discharge state determination process in the partial nozzle determination mode during the determination time period (step S36). Accordingly, even if an abnormal discharge occurs in the discharging unit D during performance of the print job in which the printing process is repeated only the printed copy number Wcp times, it is possible to minimally suppress degradation of image quality due to the abnormal discharge.

The target discharging group GR[w] that is the target of determination in the marginal range Xmg[w], for example, may be selected from the discharging units D other than the discharging units D included in the target discharging groups GR[1] to GR[w−1] that are the target of determination in the marginal ranges Xmg[1] to Xmg[w−1] when the discharge state determination process is performed in the partial nozzle determination mode during performance of the print job as illustrated in FIG. 28 and FIG. 29 (refer to step S210 in FIG.

23). In the case of the example illustrated in FIG. 29, when the target discharging group GR[1] is set as the target of the discharge state determination process in the marginal range Xmg[1], and the target discharging group GR[2] is set as the target of the discharge state determination process in the marginal range Xmg[2], the Q numbers of discharging units D may be selected as the target discharging group GR[3] in the marginal range Xmg[3] from the discharging units D among the M numbers of discharging units D other than the discharging units D belonging to the target discharging groups GR[1] and GR[2].

Next, the control unit 6, as illustrated in FIG. 28, determines whether the maintenance process is required on the basis of the determination result of the discharge state determination process performed in step S36 (step S38). In step S38, necessity of the maintenance process may be determined on the basis of the result of the w-th discharge state determination process (the number, the proportion, and the like of abnormal discharging units D-B) among the w numbers of discharge state determination processes performed in step S36, or necessity of the maintenance process may be determined on the basis of the results of the first to the w-th discharge state determination processes.

The control unit 6 adds "1" to the variable w when the determination result in step S38 is negative (step S40) and causes the process to proceed to step S32.

Meanwhile, the control unit 6 performs the discharge state determination process in the full nozzle determination mode when the determination result in step S38 is positive (step S42) and performs the maintenance process (step S44). Performing the discharge state determination process in the full nozzle determination mode before performing the maintenance process can clarify which discharging unit D is to be the target of the maintenance process.

Next, the control unit 6 performs the discharge state determination process in the failed nozzle determination mode (step S46) and determines whether the recording head 30 is to be replaced on the basis of the result of the discharge state determination process in step S46 (step S48). Then, the control unit 6 causes the process to proceed to step S40 when the determination result in step S48 is negative. The control unit 6 causes the display unit 81 to display a warning message indicating that a failure occurs in the recording head 30 when the determination result in step S48 is positive (step S50) and causes the process to proceed to step S40.

The control unit 6, as illustrated in FIG. 28, performs the discharge state determination process in the full nozzle determination mode when the determination result in step S34 is positive, that is, when all of the printed copy number Wcp of printing processes that are to be performed in the print job are completed (step S52). By performing the discharge state determination process in the full nozzle determination mode after the print job is completed, it is possible to promptly find an abnormal discharge even if a failure occurs in the discharging unit D during performance of the print job.

Next, the control unit 6 determines whether the maintenance process is required on the basis of the determination result of the discharge state determination process performed in step S52 (step S54).

The control unit 6 ends a series of processes including the print job illustrated in FIG. 28 when the determination result in step S54 is negative.

Meanwhile, the control unit 6 performs the maintenance process when the determination result in step S54 is positive (step S56) and then performs the discharge state determination process in the failed nozzle determination mode (step S58).

Then, the control unit 6 determines whether the recording head 30 is to be replaced on the basis of the result of the discharge state determination process in step S58 (step S60). The control unit 6 ends a series of processes including the print job illustrated in FIG. 28 when the determination result in step S60 is negative. The control unit 6 causes the display unit 81 to display a warning message indicating that a failure occurs in the recording head 30 when the determination result in step S60 is positive (step S62) and ends a series of processes including the print job illustrated in FIG. 28.

The determining unit 62 of the control unit 6 preferably performs the discharge state determination process in the following example cases in addition to the cases described in FIG. 28 and FIG. 29.

The control unit 6 preferably performs the discharge state determination process in the failed nozzle determination mode when the cavity 320 of the discharging unit D is initially filled with ink, such as when the recording head 30 is replaced. In this case, when there is an initial failure in the recording head 30, the initial failure can be detected early.

The control unit 6 may perform the discharge state determination process when the ink jet printer 1 can operate in a plurality of power modes having a different amount of power consumption, and the power mode in which the ink jet printer 1 operates changes.

Specifically, when the ink jet printer 1 can operate in a normal power mode that is a power mode for performing various processes such as the printing process and the maintenance process and in a power saving mode that is a power mode for waiting without performing various processes and is a power mode having a smaller amount of power consumption than the normal power mode, the control. unit 6 may perform the discharge state determination process in the full nozzle determination mode when the ink jet printer 1 transitions from operating in the power saving mode to operating in the normal power mode.

When the ink jet printer 1 operates with suppression of the amount of power consumption in the power saving mode, the drive waveform signal Com-B may not be supplied to the discharging unit D, and minute vibrations may not be applied to the ink in the cavity 320 of the discharging unit D. In this case, the ink in the cavity 320 may probably be thickened, and an abnormal discharge may probably occur due to thickening of the ink in the discharging unit D.

Regarding this point, in the present embodiment, the discharge state determination process is performed in the full nozzle determination mode when a transition is made from the power saving mode to the normal power mode. Thus, it is possible to promptly detect an abnormal discharge such as thickening of ink that occurs during operation of the ink jet printer 1 in the power saving mode.

The control unit 6 may perform the discharge state determination process in the full nozzle determination mode when the state in which transport of the recording paper P by the transport mechanism 7 becomes difficult (a so called paper jam) occurs, and a transport state recovery work is performed to recover the recording paper P to a transportable state.

The transport state recovery work (paper jam restoration work) that recovers the state of transport of the recording paper P is generally performed by, for example, the user of the ink jet printer 1 physically removing the recording paper P that is deviated from the transport path. Such a transport state recovery work may cause vibrations and the like. In addition, the recording paper P may be brought into contact with the nozzle plate 330 and the like of the recording head 30 during the transport state recovery work. Thus, in the case of performing the transport state recovery work, there may be a possibility of mingling of an air bubble in the discharging unit D due to vibrations and the like occurring during the transport state recovery work or a possibility of attachment of a foreign object to the nozzle plate 330 due to contact of the recording paper P with the recording head 30.

Regarding this point, in the present embodiment, the discharge state determination process is performed in the full nozzle determination mode when the transport state recovery work is performed. Thus, it is possible to early detect an abnormal discharge in the discharging unit D due to the transport state recovery work.

6. Conclusion of Embodiment

The ink jet printer 1 according to the present embodiment can perform the discharge state determination process in the plurality of determination modes as described above. Thus, it is possible to flexibly perform the discharge state determination process in response to the status of use of the ink jet printer 1.

Thus, the state of discharge of ink in the discharging unit D can be determined at an appropriate timing depending on the status of use of the ink jet printer 1 or with appropriate accuracy depending on the status of use of the ink jet printer 1. Therefore, it is possible to quickly detect an abnormal discharge in the discharging unit D or a failure of the discharging unit D, and it is possible to minimally suppress degradation of image quality due to an abnormal discharge.

In the present embodiment, the determining unit 62 of the control unit 6 determines the waveform of the drive waveform signal Com (determination drive waveform signal Com-AT) depending on the determination mode.

Specifically, the determining unit 62, as described above, sets the determination drive waveform signal Com-AT as the non-discharge drive waveform signal Com-AT1 in the full nozzle determination mode and in the partial nozzle determination mode and sets the determination drive waveform signal Com-AT as the discharge drive waveform signal Com-AT2 in the failed nozzle determination mode.

Thus, it is possible to accomplish both suppression of an increase in the amount of consumption of ink accompanied by the discharge state determination process and improvement of determination accuracy in the discharge state determination process by considering the status of use of the ink jet printer 1, and it is possible to appropriately perform the discharge state determination process depending on the status of use of the ink jet printer 1.

The control unit 6 functions as the determining unit 62 by performing the discharge state determination process in the full nozzle determination mode illustrated in FIG. 21, the discharge state determination process in the partial nozzle determination mode illustrated in FIG. 23, or the discharge state determination process in the failed nozzle determination mode illustrated in FIG. 25 or FIG. 26. In other words, the control unit 6 functions as the determining unit 62 by performing at least one of the processes of steps S10, S18, S24, S36, S42, S46, S52, and S58 that are processes relevant to the discharge state determination process in FIG. 27 and FIG. 28.

B. Modification Example

Each embodiment above may be modified in various manners. Specific aspects of modification are illustrated below. Two or more aspects arbitrarily selected from the illustration below may be appropriately combined to an extent without contradicting each other.

In the modification examples illustrated below, elements having the same action or function as in the embodiment will be given the signs referred to in the description above, and a detailed description of each of the elements will be appropriately omitted.

First Modification Example

The determining unit 62 determines the waveform of the determination drive waveform signal Com-AT depending on the determination mode in the above embodiment. However, the invention is not limited to such an aspect. The determination drive waveform signal Com-AT may have the same waveform in all of the plurality of determination modes.

For example, the determining unit 62 may set the determination drive waveform signal Com-AT as the non-discharge drive waveform signal Com-AT1 in all of the three determination modes. In this case, it is possible to suppress the amount of consumption of ink relevant to the discharge state determination process to a smaller extent, and it is possible to suppress the possibility of contamination of the recording paper P accompanied by the discharge state determination process to a smaller extent.

In addition, the determining unit 62 may set the determination drive waveform signal Com-AT as the discharge drive waveform signal Com-AT2 in all of the three determination modes. In this case, it is possible to increase accuracy of determination in the discharge state determination process.

Second Modification Example

The determining unit 62 can perform the discharge state determination process in the three determination modes of the full nozzle determination mode, the partial nozzle determination mode, and the failed nozzle determination mode in the above embodiment and the modification example. However, the invention is not limited to such an aspect. The determining unit 62 may be capable of performing the discharge state determination process in at least two determination modes of the three determination modes.

For example, the determining unit 62 may be capable of selecting the determination mode from the full nozzle determination mode and the partial nozzle determination mode and performing the discharge state determination process in the selected determination mode. Also in this case, it is possible to flexibly perform the discharge state determination process in response to temporal restrictions depending on the status of use of the ink jet printer 1.

In addition, for example, the determining unit 62 may be capable of selecting the determination mode from the full nozzle determination mode and the failed nozzle determination mode and performing the discharge state determination process in the selected determination mode. Also in this case, it is possible to perform the discharge state determination process with determination accuracy depending on the status of use of the ink jet printer 1.

In addition, for example, the determining unit 62 may be capable of selecting the determination mode from the partial nozzle determination mode and the failed nozzle determination mode and performing the discharge state determination process in the selected determination mode.

Third Modification Example

The ink jet printer 1 according to the above embodiment and the modification examples sets one discharging unit D as the determination target discharging unit D-J during one unit operation time period Tu. However, the invention is not limited to such an aspect. Two or more discharging units D may be set as the determination target discharging unit D-J during one unit operation time period Tu.

For example, the ink jet printer 1 may be configured to be provided with a plurality of residual vibration detecting units 52 and to be capable of detecting the residual vibration signal Vout from the plurality of discharging units D during each unit operation time period Tu (each unit determination operation time period Tu-T). In this case, the determining unit 62 provided in the control unit 6 may be capable of determining the state of discharge of ink in the plurality of discharging units D on the basis of a plurality of detection signals Tc and a plurality of validity flags Flag that the plurality of residual vibration detecting units 52 outputs.

Fourth Modification Example

The determining unit 62 is a functional block that is realized by the control unit 6 executing the control program of the ink jet printer 1 in the above embodiment and the modification examples. However, the invention is not limited to such an aspect. The determining unit 62 may be mounted as an electronic circuit on the head driver 50.

Fifth Modification Example

The ink jet printer 1 according to the above embodiment and the modification examples is a line printer in which the nozzle array Ln is disposed so that the range YNL includes the range YP. However, the invention is not limited to such an aspect. The ink jet printer 1 may be a serial printer in which the recording head 30 reciprocates in the Y-axis direction to perform the printing process.

When the ink jet printer 1 is a serial printer, the discharge state determination process in the partial nozzle determination mode may be performed when the ink discharged from the discharging unit D hits the outside of the printing area. Specifically, the discharge state determination process may be performed when the recording head 30 is transported to the position that does not overlap with the recording paper P in a plane view, when the printing area of the recording paper P is not present on the platen 74, or the like.

Sixth Modification Example

The ink jet printer 1 according to the above embodiment and the modification examples, for example, divides one long recording paper P into Wcp numbers of printing areas and the marginal area that divides the printing areas and forms Wcp numbers of images in one-to-one correspondence with the Wcp numbers of printing areas when performing the printing process. However, the invention is not limited to such an aspect. One image may be formed on the entire recording paper P.

In this case, for example, the recording paper P may have a rectangular shape such as an A4-size paper. In this case, during the printing process, the transport mechanism 7 may supply a plurality of recording papers P intermittently onto the platen 74, and one image may be formed on one recording paper P supplied onto the platen 74. In addition, in this case, the determining unit 62 may set the determination time period within the time period from transport of one recording paper P out of the platen 74 until supply of another recording paper P onto the platen 74 initially after the one recording paper P (that is, the time period during which the recording paper P is not present on the platen 74) and for example, may perform the discharge state determination process in the partial nozzle determination mode.

Seventh Modification Example

The ink jet printer 1 according to the above embodiment and the modification examples can discharge ink in four colors of CMYK. However, the invention is not limited to such an aspect. The ink jet printer 1 may be capable of discharging ink in at least one or more colors, and the color of ink may be any color other than CMYK.

In addition, the ink jet printer 1 according to the above embodiment and the modification examples is provided with at least four discharging units D in the recording head 30 (that is, M≥4). However, the invention is not limited to such an aspect. The ink jet printer 1 may be provided with at least two discharging units D (that is, M≥2).

Eighth Modification Example

The drive waveform signal Com includes the drive waveform signals Com-A and Com-B in the above embodiment and the modification examples. However, the invention is not limited to such an aspect. The drive waveform signal Com may be a signal that includes only one signal (for example, the drive waveform signal Com-A) or may be a signal that includes three or more signals (for example, drive waveform signals Com-A, Com-B, and Com-C).

In addition, although the printing signal SI is a two-bit signal in the above embodiment and the modification examples, the number of bits of the printing signal SI may be appropriately determined depending on the shades to display, the number of control time periods Ts included in the unit operation time period Tu, the number of signals included in the drive waveform signal Com, and the like.

Ninth Modification Example

The head driver 50 is provided with one drive unit 51, and the drive unit 51 is supplied with the single type drive waveform signal Com in the above embodiment and the modification examples. However, the invention is not limited to such an aspect. The head driver 50, for example, may be provided with a plurality of drive units 51 that is disposed for each color of ink that the discharging unit D discharges, and the control unit 6 may supply a plurality of types of drive waveform signal Com in one-to-one correspondence with the plurality of drive units 51 to the head driver 50.

Tenth Modification Example

The ink jet printer 1 drives the piezoelectric element 300 to cause the vibrating plate 310 to vibrate so as to discharge ink from the nozzle N in the above embodiment and the modification examples. However, the invention is not limited to such an aspect. For example, the ink jet printer 1 may be a so-called thermal type. In the thermal type, a heating element (not illustrated) is disposed in the cavity 320 and is heated to generate an air bubble in the cavity 320. Accordingly, the pressure in the cavity 320 is increased, and ink is discharged.

What is claimed is:

1. A liquid discharging apparatus that discharges liquid to a medium from a discharging unit, by applying a driving signal for driving a piezoelectric element, to form an image on the medium, the apparatus comprising:

a recording head that includes M numbers (where M is a natural number greater than or equal to two) of the discharging units;

a drive unit that drives the discharging unit;

a residual vibration detecting unit that detects change in an electromotive force of the piezoelectric element in accordance with residual vibration occurring in the discharging unit when the discharging unit is driven by the drive unit; and a determining unit that determines a state of discharge of the liquid in the discharging unit on the basis of a detection result of the residual vibration detecting unit, wherein the determining unit is capable of performing the determination in two or more determination modes, and determines at least one of one or a plurality of target discharging units that is to be a target of the determination during a determination time period, and a drive discharging unit that the drive unit is to drive so as to determine the state of discharge of the liquid in the target discharging unit from the M numbers of discharging units depending on the determination mode.

2. The liquid discharging apparatus according to claim 1, wherein the two or more determination modes include a first determination mode in which the M numbers of discharging units are set as the target discharging unit during the determination time period.

3. The liquid discharging apparatus according to claim 2, wherein the liquid discharging apparatus is capable of performing a printing process of forming an image on the medium on the basis of image data that represents an image which is to be formed on the medium, and the determining unit performs the determination in the first determination mode during a printing preparation time period from supply of the image data to the liquid discharging apparatus until initiation of the printing process by the liquid discharging apparatus.

4. The liquid discharging apparatus according to claim 2, wherein the liquid discharging apparatus is capable of performing a printing process of forming an image on the medium on the basis of image data that represents an image which is to be formed on the medium, and the determining unit performs the determination in the first determination mode when the printing process based on the image data is completed.

5. The liquid discharging apparatus according to claim 2, wherein the liquid discharging apparatus is capable of operating in a normal power mode, and a power saving mode in which the amount of power that the liquid discharging apparatus consumes is less than the amount of power that the liquid discharging apparatus consumes in the normal power mode, and the determining unit performs the determination in the first determination mode when the liquid discharging apparatus transitions from operating in the power saving mode to operating in the normal power mode.

6. The liquid discharging apparatus according to claim 2, further comprising:

a transport mechanism that transports the medium, wherein the determining unit performs the determination in the first determination mode when a recovery is made from a state where transport of the medium is difficult to a transportable state in the transport mechanism.

7. The liquid discharging apparatus according to claim 1, wherein the two or more determination modes include a second determination mode in which Q numbers (where Q is a natural number satisfying $1 \leq Q < M$) of discharging units are set as the target discharging unit during the determination time period.

8. The liquid discharging apparatus according to claim 7, wherein the medium includes a printing area in which an image is to be formed, the liquid discharging apparatus includes a transport mechanism that changes the position of the medium relative to the recording head, and the determining unit performs the determination in the second determination mode when the position of the medium relative to the recording head is a position where the liquid discharged from the discharging unit hits outside the printing area.

9. The liquid discharging apparatus according to claim 1, wherein the two or more determination modes include a third determination mode in which the target discharging unit and the discharging unit that is different from the target discharging unit are set as the drive discharging unit so as to determine the state of discharge of the liquid in the target discharging unit.

10. The liquid discharging apparatus according to claim 1, wherein the two or more determination modes include a third determination mode of performing a first determination of setting the target discharging unit as the drive discharging unit so as to determine the state of discharge of the liquid in the target discharging unit, and a second determination of setting an abnormal discharging unit that is the discharging unit determined as having an abnormal state of discharge of the liquid in the first determination and setting the abnormal discharging unit and the discharging unit that is different from the abnormal discharging unit as the drive discharging unit so as to determine the state of discharge of the liquid in the abnormal discharging unit.

11. The liquid discharging apparatus according to claim 9, wherein the determining unit performs the determination in the third determination mode when the liquid discharging apparatus is booted.

12. The liquid discharging apparatus according to claim 9, wherein the determining unit performs the determination in the third determination mode when the discharging unit is initially filled with the liquid.

13. The liquid discharging apparatus according to claim 9, wherein the liquid discharging apparatus is capable of performing a recovery process so as to set the state of discharge of the liquid in the discharging unit to normal, and the determining unit performs the determination in the third determination mode when the recovery process is performed.

14. The liquid discharging apparatus according to claim 1, wherein the drive unit drives the discharging unit by supplying a drive signal to the discharging unit, and the determining unit determines the waveform of the drive signal that the drive unit is to supply to the drive discharging unit depending on the determination mode.

15. The liquid discharging apparatus according to claim 14, wherein the determining unit is capable of performing the determination in a first determination mode in which the M numbers of discharging units are set as the target discharging unit during the determination time period, a second determination mode in which the Q numbers (where Q is a natural number satisfying $1 \leq Q < M$) of discharging units are set as the target discharging unit during the determination time period, and a third determination mode in which the target discharging unit and the discharging unit that is different from the target discharging unit are set as the drive discharging unit so as to determine the state of discharge of the liquid in the target discharging unit, and determines the waveform of the drive signal as a non-discharge waveform that causes the liquid not to be discharged from the drive discharging unit at the time of supply of the drive signal to the drive discharging unit when the determination is performed in the first determination mode or in the second determination mode.

16. The liquid discharging apparatus according to claim 14, wherein the determining unit determines the waveform of the drive signal as a discharge waveform that causes the liquid to be discharged from the drive discharging unit at the time of supply of the drive signal to the drive discharging unit when the determination is performed in the third determination mode.

17. The liquid discharging apparatus according to claim 1, further comprising:

a recovery mechanism that performs a recovery process so as to set the state of discharge of the liquid in the discharging unit to normal, wherein the recovery mechanism performs the recovery process when the determining unit determines that the state of discharge of the liquid is abnormal in a predetermined number or more of the discharging units.

* * * * *